US006984011B2

(12) United States Patent
Shimada et al.

(10) Patent No.: US 6,984,011 B2
(45) **Date of Patent: *Jan. 10, 2006**

(54) DOT FORMATION POSITION MISALIGNMENT ADJUSTMENT PERFORMED USING PIXEL-LEVEL INFORMATION INDICATING DOT NON-FORMATION

(75) Inventors: Kazumichi Shimada, Nagano-ken (JP); Toshihiro Hayashi, Nagano-ken (JP); Munehide Kanaya, Nagano-ken (JP); Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/366,457

(22) Filed: Feb. 14, 2003

(65) Prior Publication Data

US 2003/0122890 A1 Jul. 3, 2003

Related U.S. Application Data

(63) Continuation of application No. 09/708,620, filed on Nov. 9, 2000, now Pat. No. 6,547,355, which is a continuation of application No. PCT/JP00/01414, filed on Mar. 8, 2000.

(30) Foreign Application Priority Data

Mar. 10, 1999 (JP) ..... 11-62969
Mar. 1, 2000 (JP) ..... 2000-55480
Mar. 1, 2000 (JP) ..... 2000-55500
Mar. 1, 2000 (JP) ..... 2000-55516

(51) Int. Cl.
*B41J 29/393* (2006.01)
*B41J 29/38* (2006.01)

(52) U.S. Cl. ..... 347/19; 347/14

(58) Field of Classification Search ..... 347/5, 347/9, 12, 14, 19, 37, 39–41, 16, 104; 358/1.1, 358/1.9, 1.5, 1.8, 1.12, 1.14, 406, 502, 504; 400/76, 279
See application file for complete search history.

(56) References Cited

U.S. PATENT DOCUMENTS 4,463,444 A * 7/1984 Daniels et al. ..... 358/1.18
4,748,453 A * 5/1988 Lin et al. ..... 347/41
5,237,645 A * 8/1993 Nagata et al. ..... 358/1.16
5,442,385 A * 8/1995 Moon et al. ..... 347/43
5,923,344 A * 7/1999 Norum et al. ..... 347/9
6,168,251 B1 * 1/2001 Imanaka et al. ..... 347/9
6,547,355 B1 * 4/2003 Shimada et al. ..... 347/12

FOREIGN PATENT DOCUMENTS

EP 0 568 283 11/1993
EP 0 824 243 2/1998
EP 0 878 772 11/1998

(Continued)

*Primary Examiner*—Thinh Nguyen
(74) *Attorney, Agent, or Firm*—Oblon, Spivak, McClelland, Maier & Neustadt, P.C.

(57) ABSTRACT

While performing main scanning in which a head having a plurality of nozzles that eject ink is moved in prescribed forward and reverse main scanning directions relative to a print medium, print images are printed on the print medium by forming dots in each pixel aligned in the main scanning direction in accordance with print data. The dot formation position misalignment amount for each nozzle is corrected using image pixel value data indicating the existence of image pixels comprising images and adjustment pixel value data indicating the existence of adjustment pixels in which dots are not formed.

42 Claims, 35 Drawing Sheets

FOREIGN PATENT DOCUMENTS

| | | |
|---|---|---|
| JP | 58-5748 | 1/1983 |
| JP | 58-005749 | 1/1983 |
| JP | 58-195365 | 11/1983 |
| JP | 60-21254 | 2/1985 |
| JP | 02-227253 | 9/1990 |
| JP | 6-171078 | 6/1994 |
| JP | 08-150708 | 6/1996 |
| JP | 10-230595 | 9/1998 |
| JP | WO 98/43818 | 10/1998 |
| JP | 11-005301 | 1/1999 |
| JP | 11-005319 | 1/1999 |
| JP | 2000-037937 | 2/2000 |

* cited by examiner

Fig. 12

| INK | K | C | M | Y |
|---|---|---|---|---|
| MISALIGNMENT AMOUNT | −1 | −2 | 1 | 0 |

Fig. 13

| INK | | K | C | M | Y |
|---|---|---|---|---|---|
| NUMBER OF ADJUSTMENT PIXELS | LEFT | 3 | 4 | 1 | 2 |
| | RIGHT | 1 | 0 | 3 | 2 |

Fig. 14

| INK | | K | C | M | Y |
|---|---|---|---|---|---|
| NUMBER OF ADJUSTMENT PIXELS | LEFT | 2 | 3 | 0 | 1 |
| | RIGHT | 2 | 1 | 4 | 3 |

CORRECTED PIXEL VALUE DATA FOR FORWARD SCANNING

CORRECTED PIXEL VALUE DATA FOR REVERSE SCANNING

*Fig.31*

| | REFERENCE | TIMING ADJUSTMENT TARGET | | | | | | |
|---|---|---|---|---|---|---|---|---|
| EMBODIMENT | K FWD. | K REV. | C FWD. | C REV. | M FWD. | M REV. | Y FWD. | Y REV. |
| VARIATION 1 | K FWD. | K REV. | C FWD. | C REV. | M FWD. | M REV. | | |
| VARIATION 2 | K FWD. | K REV. | | | | | | |
| | C FWD. | C REV. | | | | | | |
| | M FWD. | M REV. | | | | | | |
| | Y FWD. | Y REV. | | | | | | |
| VARIATION 3 | K FWD. | K REV. | C FWD. | M FWD. | Y FWD. | | | |

FIRST MAIN SCANNING /FIRST PIXEL GROUP

SECOND MAIN SCANNING /SECOND PIXEL GROUP

THIRD MAIN SCANNING /THIRD PIXEL GROUP

FOURTH MAIN SCANNING /FOURTH PIXEL GROUP

DOT FORMATION POSITION MISALIGNMENT ADJUSTMENT PERFORMED USING PIXEL-LEVEL INFORMATION INDICATING DOT NON-FORMATION

TECHNICAL FIELD

The present invention pertains to a printing apparatus and printing method for printing images through formation of monochrome or multi-color dots on a recording medium during main scanning.

BACKGROUND ART

An inkjet printer is used as a device for outputing images processed by a computer or images captured by a digital camera. An inkjet printer forms dots by ejection of ink of various colors such as cyan, magenta, yellow and black, for example. Dots of each color are typically ejected from a print head while the print head is moving in a main scanning direction. If the positions at which the dots of each color are formed are misaligned, it would cause a problem of reduced image quality.

This problem of image quality deterioration due to dot formation misalignment occurs in both uni-directional recording and bi-directional recording. Here, uni-directional recording refers to a recording method in which, where the print head moves back and forth along the main scanning passes, the dots are ejected only when the print head is moving along one of the passes. Bi-directional printing refers to a recording method in which dots are ejected when the print head is moving along both of the main scanning passes. While the problem of dot position misalignment typically occurs with respect to dots of different colors in uni-directional printing, it occurs in bi-directional printing with respect to dots of the same color formed during forward and reverse passes.

In the conventional printer, the dot position misalignment may be reduced by adjusting the formation positions of color dots in the main scanning direction while using black dots as a reference, for example. This type of dot position misalignment adjustment is realized by a head drive circuit that supplies drive signals to the print head while changing the output timing of the drive signals.

However, the above-described conventional dot position misalignment adjustment method has various inherent limitations. For example, because the drive signal timing can be changed only for the entire print head in a typical printer, dot position misalignment adjustment is limited to what can be achieved by the timing change.

The present invention was made in order to resolve the abovementioned problem with the conventional art, and an object thereof is to provide the technique that reduces the dot position misalignment in the main scanning direction using a means other than changing the drive signal output timing from the head drive circuit, thereby improving image quality.

DISCLOSURE OF THE INVENTION

In order to attain the above object, in the present invention, while performing main scanning in which a head having a plurality of nozzles that eject ink is moved in prescribed forward and reverse directions relative to a print medium, sub-scanning is carrying out in which the print medium is forwarded in a sub-scanning direction perpendicular to the main scanning direction relative to the head. The head is driven in accordance with print data along at least one of the forward or reverse scanning passes. Dots are formed in at least some of the plurality of pixels aligned in the main scanning direction. The dot formation position misalignment for each nozzle in the main scanning direction are corrected using image pixel value data indicating a dot formation status regarding image pixels that constitute images, as well as adjustment pixel value data that indicates existence of adjustment pixels in which dots are not formed and are used to adjust positions of the image pixels in the main scanning direction. In this arrangement, as dots are formed in accordance with the print data, the misalignment of the formation positions of the dots from each nozzle in the main scanning direction is corrected using (i) image pixel value data indicating the dot formation status in image pixels that comprise the image, and (ii) adjustment pixel value data indicating the existence of adjustment pixels in which dots are not formed and which are used to adjust positions of the image pixels in the main scanning direction. Various aspects of the present invention will be explained below.

(1) Allocation of Adjustment Pixels at Either End of Main Scanning Direction

First, the allocation of the adjustment pixels are set to one or both ends of the image pixel value data so that the amount of the dot formation position misalignment is corrected. Here, the 'allocation of adjustment pixels to one or both ends' may include the case in which adjustment pixels are not allocated at one end. Raster data is generated from the image pixel value data and the allocation of the adjustment pixels. The raster data has the image pixel value data and the adjustment pixel value data placed at least one side of the image pixel value data. The print data including the raster data is then generated. The head is thereafter driven in accordance with the print data while main scanning is being performed.

According to this aspect of the present invention, the misalignment of the dot formation positions can be corrected and high-quality printing can be realized by giving the following characteristics to the print data for driving the head. Typically, print data includes those multi-level data for each of pixels arrayed in a predetermined number, which are converted from image tone values. This multi-level data corresponds to the image pixel data in the present invention. The print data in the present invention contains, in addition to the image pixel data, data regarding a prescribed number of adjustment pixels in the main scanning direction. The adjustment pixel data represent the blank left and right margins in the main scanning direction.

Through the use of print data having this structure, the printing apparatus of the present invention can correct dot formation position misalignment within the range attained by the adjustment pixels. An example will be described in which main scanning is performed from left to right. Assume that the head includes a nozzle that forms dots to the left of the target pixel position due to its ink expulsion characteristic. In the printing apparatus of the present invention, the amount of dot formation misalignment attributable to the nozzle is stored beforehand. Here, the amount of misalignment is assumed to be one pixel. In the present invention, the position at which a dot is formed by this nozzle is shifted in accordance with this stored misalignment amount, and print data is generated accordingly. In other words, print data is generated in which a dot is formed at a position that is shifted to the right by one pixel from the target pixel position. This is equivalent to setting the adjustment pixel allocation such that the number of adjustment pixels on the right side is reduced by one and the number of adjustment pixels on the left side is increased by one in the main scanning direction, relative to those in the case in which the dot could be formed at the correct position. When ink is ejected from this nozzle based on this print data, the above-mentioned dot formation shift occurs, and a dot is formed at the pixel on which it should be.

In the printing apparatus of the present invention, dot formation position misalignment may be corrected in pixel-width increments based on this principle. In recent years, pixel width in the main scanning direction has become extremely small, and it has become possible to sufficiently correct for dot formation position misalignment for each nozzle by shifting the dot formation position in pixel-width increments. Therefore, high-quality printing may be attained with the printing apparatus of the present invention. Moreover, because the present invention does not require new hardware for the head driving mechanism in order to carry out the above correction, it is possible to reduce the degree of dot formation position misalignment with relative ease.

In the present invention, the print data may be generated in various steps. For example, print data may be generated in two steps comprising a first step wherein basic data is generated in which a prescribed number of adjustment pixels are located at opposite ends of the image pixels along the main scanning direction, regardless of the amount of dot formation position misalignment, and a second step wherein the image pixels position is shifted in accordance with the amount of dot formation position misalignment, i.e., the allocation of adjustment pixels at both ends is changed.

Alternatively, print data may be generated in two steps comprising a first step wherein the allocation of adjustment pixels at opposite ends of the image pixels is specified in accordance with the amount of dot formation position misalignment, and a second step wherein adjustment pixels are added to the opposite ends of the image pixels pursuant to the specified allocation.

Furthermore, in the printing apparatus of the present invention, the number of adjustment pixels may be set to any appropriate value within the range that enables dot formation position misalignment to be corrected. This value may be one or more.

In the present invention, the allocation of adjustment pixels in accordance with the formation position misalignment amount may be carried out individually for each nozzle, but where ink of a prescribed color is ejected from each nozzle to form dots of various colors, the allocation is preferably set separately for each ink color.

In this aspect of the present invention, the dot formation position misalignment is corrected separately for each color. Typically, the print head characteristics regarding dot formation position are substantially identical for each color, due to the manufacturing process and the ink viscosity. Therefore, dot formation position misalignment may be corrected relatively easily using the arrangement described above. Furthermore, dot formation position misalignment has a significant effect on image quality when it occurs between dots of different colors. Because the arrangement described above allows such misalignment between dots of different colors to be easily reduced, it has the effect of substantially improving image quality.

Moreover, where the nozzles are classified into a plurality of nozzle rows that extend in the sub-scanning direction, and dots are formed using the nozzles in these a plurality of nozzle rows, which are themselves aligned in the main scanning direction, it is preferred that the allocation be set separately for each nozzle row. The dot formation position characteristics of the print head nozzles may be identical for all nozzles belonging to a given nozzle row. In such a case, image quality may be improved relatively easily by correcting dot formation position misalignment for each row.

The amount of dot formation position misalignment may be stored separately for each nozzle in a misalignment amount memory unit, and the allocation setting unit may have a function to set the adjustment pixel allocation separately for each nozzle. This function enables dot formation position misalignment to be corrected in a more precise fashion.

Where the image pixel value data is two-dimensional image data indicating pixels aligned in the two dimensions of the main scanning direction and the sub-scanning direction, it is preferable that adjustment pixel allocation be performed in the manner described below. The relationship between each nozzle mounted in the head and the two-dimensional image data is first determined in accordance with the amount of the sub-scanning forwarding, and the adjustment pixels are then allocated based on this determination.

Through this operation, it may be determined which nozzle will form each raster line, i.e., the pixels aligned in the main scanning direction, in the print data. The dot formation position misalignment may then be corrected based on the results of this determination. As a result, dot formation position misalignment may appropriately performed for each individual nozzle, and the quality of the printed images may be significantly improved. In a printing apparatus employing sub-scanning, because the print data is typically supplied to the head upon determination of the relationship between the raster lines and the nozzles, the determining means required to supply the print data may be employed as the determining means in the printing apparatus described above.

The generation of print data in a printing apparatus employing sub-scanning may be performed in various processes as well. For example, print data may be generated in two steps comprising a first step wherein a prescribed number of adjustment pixels are allocated at opposite ends of the image pixels regardless of the relationship of each raster line to the nozzles, and a second step wherein the raster/nozzle relationship is determined and the allocation of adjustment pixels is corrected. Naturally, it is acceptable if only image pixel data is prepared in the first step and the adjustment pixels are added in the second step.

Alternatively, print data may be generated in two steps comprising a first step wherein the raster/nozzle relationship is determined and the allocation of adjustment pixels is set, and a second step in which the adjustment pixels are added to the image pixels in accordance with the set allocation and print data is thereupon generated.

It is preferable for the head to be driven along both the forward and reverse passes of main scanning. Generally, where dots are formed along both the forward and reverse passes of main scanning, i.e., where bi-directional recording is performed, the degree of dot formation position misalignment increases. Let us consider an example in which dots are formed while the head is moving from the left to the right during forward movement, as well as while the head is moving from the right to the left during reverse movement. It will be assumed that during forward movement the dot formation position for a particular nozzle is misaligned to the left by one pixel relative to the target pixel position. Conversely, during reverse movement, the dot formation position for this nozzle is misaligned by one pixel to the right. As a result, the dot formed during forward movement and the dot formed during reverse movement are offset relative to each other by two pixels. In bi-directional recording, the dot formation position misalignment has a major effect on image quality as described above. Therefore, by applying the present invention in a printing apparatus that performs bi-directional recording, the dot formation position misalignment can be relieved, and the resulting improvement in image quality is striking.

The head may also be driven only along either the forward or the reverse scanning pass. Using this method enables the problem of dot formation position misalignment caused by the scanning in different directions to be avoided.

Where dot recording is concerned, it is preferred that the dot recording for each main scanning line be completed during one pass of the head. When this feature is adopted, each raster line is created by a single nozzle, and therefore dot formation position misalignment may be corrected relatively easily and with high precision. Incidentally, there is a so-called overlap method where each raster line is formed with a plurality of nozzles during recording. In the overlap method, odd-numbered pixels on a raster line are recorded by a first nozzle, and even-numbered pixels are recorded by a second nozzle after the recording medium is fed forward during sub-scanning. When this type of recording is performed, a single raster line is formed using two nozzles having different dot formation position characteristics. Therefore, the operation by which to correct dot formation position misalignment is exceedingly complex. On the other hand, where each raster line is formed using a single nozzle, the adjustment pixel allocation may be easily set for each raster line, allowing dot formation position misalignment to be carried out with relative ease. However, this does not mean that the present invention cannot be applied to the overlap method.

The present invention does not require that misalignment correction be carried out over the entire image data. Misalignment correction may be carried out only in areas in which dot misalignment has a significant effect on image quality. For example, misalignment correction may be omitted for dots of an ink color with relatively low visibility. It is also acceptable if misalignment correction is carried out only in areas in which dot misalignment has a significant effect on image quality, such as areas in which dots are formed with an intermediate level of recording density. If misalignment correction is carried out only where dot misalignment has a significant effect on image quality as described above, the burden on the processor during printing can be reduced and the speed of processing can be increased.

Prescribed test patterns designed to enable detection of the amount of dot formation position misalignment for each nozzle may be printed, and the amount of dot formation position misalignment may be subsequently specified based on these test patterns.

The amount of dot formation position misalignment depends on various factors, such the ink expulsion characteristic of each nozzle, the amount of backlash during the forward and reverse movement of the head, and changes in various factors such as the viscosity of the ink. Consequently, dot formation position misalignment can occur even after the product is shipped. Accordingly, the amount of misalignment may be specified by printing out test patterns and setting the amount of misalignment based on these test patterns. Therefore, even where dot formation position misalignment occurs after shipment, the user can relatively easily reset the misalignment amount stored in memory. As a result, high-quality printing may be relatively easily maintained, and the ease of use of the printing apparatus may be improved.

Various methods may adopted for the setting of the misalignment amount based on the test patterns. For example, the misalignment amount may be specified using a method of printing test patterns in which dots are formed at various pre-set timings and selecting the timing offering the best dot formation positions.

(2) Reversal of Placement of Adjustment Pixels on Occurrence of Prescribed Event The present invention may also be used in the following fashion. First, print data including raster data, sub-scan feed data and adjustment pixel placement data are generated. Here, raster data block has at least the image pixel value data with regard to each nozzle for each main scanning session. Sub-scan feed data indicates a feed amount for the sub-scanning performed after each main scanning session. Adjustment pixel placement data, that is separate from the raster data block, indicates numbers of adjustment pixels to be placed at opposite ends of the image pixel value data. The adjustment pixel placement data functions as at least a part of the adjustment pixel value data. The head is thereupon driven and dots are formed in both the forward and reverse scanning passes in accordance with the print data. When a direction of a scheduled pass for each raster data block is reversed, the reversal is detected. The raster data block is reconstructed by reversing placement of the adjustment pixels across the image pixels sandwiched between the adjustment pixels, for the raster data block regarding which the pass is reversed, and by aligning, based on the reversed placement of the adjustment pixels, the adjustment pixel value data at least one of the opposite ends of the image pixel value data.

Through this operation, dot formation misalignment may be appropriately corrected with regard to raster data to be recorded in a scanning direction reversal from the scanning direction assigned initially.

The raster data may include, as at least a part of the adjustment pixel value data, adjustment pixel data having the same format as the image pixel value data. In this arrangement, the printing unit that receives the print data can process the image pixel value data and the adjustment pixel data as a single block of pixel data, making processing simpler.

It is preferable for raster data to include a directional flag indicating the direction of the scheduled scanning pass for each raster data block. In this arrangement, the printing unit can know which scanning direction is allocated to the printing of each rasterline of the raster data.

Where a process is included in which dots of various colors are formed through ejection of ink of a prescribed color from each nozzle, it is preferred that the adjustment pixel placement number in the adjustment pixel placement data be set separately for each ink color. In this arrangement, dot formation positions may be corrected in accordance with the characteristics of each ink.

Where a plurality of nozzles are classified into a plurality of nozzle rows that extend in the sub-scanning direction and that are aligned in the main scanning direction, and dots are formed using the nozzles in these a plurality of nozzle rows, it is preferred that the adjustment pixel placement number in the adjustment pixel placement data be set separately for each nozzle row. Because the nozzles in a nozzle row have common characteristics, dot formation position misalignment may be corrected properly by this independent setting.

It is furthermore preferred that the adjustment pixel placement number in the adjustment pixel placement data be set separately for each nozzle. Because dot formation position misalignment may be corrected for each nozzle, the quality of the resulting printing will be improved.

(3) Dot Formation Using a Plurality of Base Drive Signals

Printing is sometimes performed in the following manner. First, a plurality of base drive signals are generated in which signals for the nozzles to record one pixel are repeated. Here, the plurality of base drive signals have same periods but different phases that are mutually offset from each other. Drive signals to drive the driving devices mounted in each nozzle to eject ink are generated from the base drive signals to form dots. In this case, it is preferred that the image pixels and the adjustment pixels aligned in each main scanning line are classified into a plurality of pixel groups when the print data is generated. Dots on respective pixels in the plurality of pixel groups are formed based on the different base drive signals respectively.

When this process is followed, dots can be recorded in accordance with a higher pixel density than is possible when dots are formed using a single base drive signal. Moreover, even where the placement of the adjustment pixels varies based on the dot formation position misalignment, this can be taken into account when dot recording is carried out.

Where the plurality of base drive signals includes N base drive signals having phases that are sequentially offset by an amount equal to 1/N of one period (N being a natural number equal to or greater than 2), it is preferred that the number of the pixel groups is N. In this arrangement, dot recording may be performed at a pixel density that is N times higher than would be possible where dots were formed using a single base drive signal. Moreover, because the phases of the base drive signals differ by a uniform amount, recording of an image may be carried out with a uniform pixel density.

Where the pixels are classified into a plurality of pixel groups, it is preferred that every Nth pixel of the image pixels and the adjustment pixels aligned in a main scanning line are classified into the same pixel group in the order of their placement. In this arrangement, high-quality printing may be performed using a simple and systematic process.

It is preferred that the head be driven along both the forward and reverse passes of main scanning. In this arrangement, the time required for printing may be reduced. The head may also be driven either the forward or reverse scanning passes. In this arrangement, the problem of dot formation position misalignment attributable to the different main scanning directions can be avoided.

(4) Misalignment Adjustment Performed Together with Compensation for Interval Between Nozzle Rows Where the plurality of nozzles classified into a plurality of nozzle rows that extend in the sub-scanning direction and that are aligned in the main scanning direction with a prescribed interval therebetween, the delay data may be used. The delay data indicates an amount of delay needed to correct for a difference in times that nozzles arrive at a particular pixel during main scanning in accordance with a design distance in the main scanning direction between the plurality of nozzles. In this case, it is preferred that the following steps occur. First, the delay data are readjusted, so that the dot formation position misalignment amount may be corrected. Then using the readjusted delay data as the adjustment pixel value data, serial data is generated. The serial data includes the readjusted delay data and the image pixel value data that follows the readjusted delay data, for each nozzle during each main scanning session. Dots are then formed based on the serial data. In this arrangement, the delay data to compensate for the interval between the nozzles in the main scanning direction is effectively used to correct dot formation position misalignment.

For generating dots, a plurality of base drive signals may be generated in which signals for the nozzles to record one pixel are repeated. Then from the base drive signals, drive signals may be generated to drive the driving devices mounted in each nozzle to eject ink. In this case, it is preferred that the following steps occur. First, the delay data is prepared in units of one period of the base drive signals. The delay data is then readjusted in units of one period of the base drive signals based on the misalignment amount. Drive signals are then generated from the base drive signals and the serial data for each nozzle. In this arrangement, the delay data may be adjusted in units of the number of drive signals to correct dot formation position misalignment.

It is preferred that the nozzle rows aligned in the main scanning direction are aligned with an interval therebetween equal to a multiple m (m being a natural number equal to or greater than 1) of a pixel pitch corresponding to the print resolution. Dot position misalignment caused by the intervals between these nozzles may be effectively eliminated using delay data prepared in units of one period of the base drive signals.

When generating the base drive signals, N base drive signals may be generated such that they have same periods but different phases that are sequentially offset by an amount equal to 1/N of one period, and the base drive signals may be supplied to the driving devices of the nozzle group corresponding to each the base drive signal. In this case, it is preferred that the following steps occur. First, the plurality of nozzles are classified into N nozzle groups (N being a natural number equal to or greater than 2). The drive signals are then generated from the aerial data for each nozzle and the base drive signals supplied to the driving device for each nozzle. In this arrangement, dot recording may be performed at a high pixel density that is a factor of N higher than it would be when dots were formed using a single base drive signal. Furthermore, processing to correct dot formation positioning misalignment may be carried out after the image pixels are assigned to each base drive signal. Therefore, dot formation position misalignment may be carried out using less data than would be required if pixel data after the correction were assigned to each base drive signal.

In addition, it is preferred in the above configuration that the nozzle rows aligned in the main scanning direction are aligned with an interval therebetween equal to a multiple (N×m) (m being a natural number equal to or greater than 1) of a pixel pitch corresponding to the print resolution. Dot position misalignment caused by the intervals between these nozzles may be effectively eliminated using delay data prepared in units of one period of the base drive signals, even where printing is performed with high dot density using a plurality of base drive signals.

It is preferred that the head be driven along both the forward and reverse passes of main scanning. In this arrangement, the time required for printing may be reduced. The head may also be driven either the forward or reverse scanning passes. In this arrangement, the problem of dot formation position misalignment attributable to the different main scanning directions can be avoided.

The present invention may be realized in the various aspects as follows.

(1) Printing apparatus. Printing control apparatus.

(2) Printing method. Printing control method.

(3) Computer program to implement the above apparatuses and methods.

(4) Recording medium on which is recorded the computer program to implement the above apparatuses and methods.

(5) Data signals embodied in a carrier wave, including the computer program to implement the above apparatuses and methods.

BRIEF DESCRIPTION OF THE DRAWINGS

FIG. 12 is a drawing showing an example of expulsion characteristic data;

FIG. 13 is a drawing showing an example of an adjustment data allocation table;

FIG. 14 is a drawing showing an example of an adjustment pixel allocation table in which black ink is set as a reference;

FIG. 31 is a drawing showing the relationship between a reference color and target colors for formation timing adjustment;

BEST MODE FOR CARRYING OUT THE INVENTION

Figure 1:
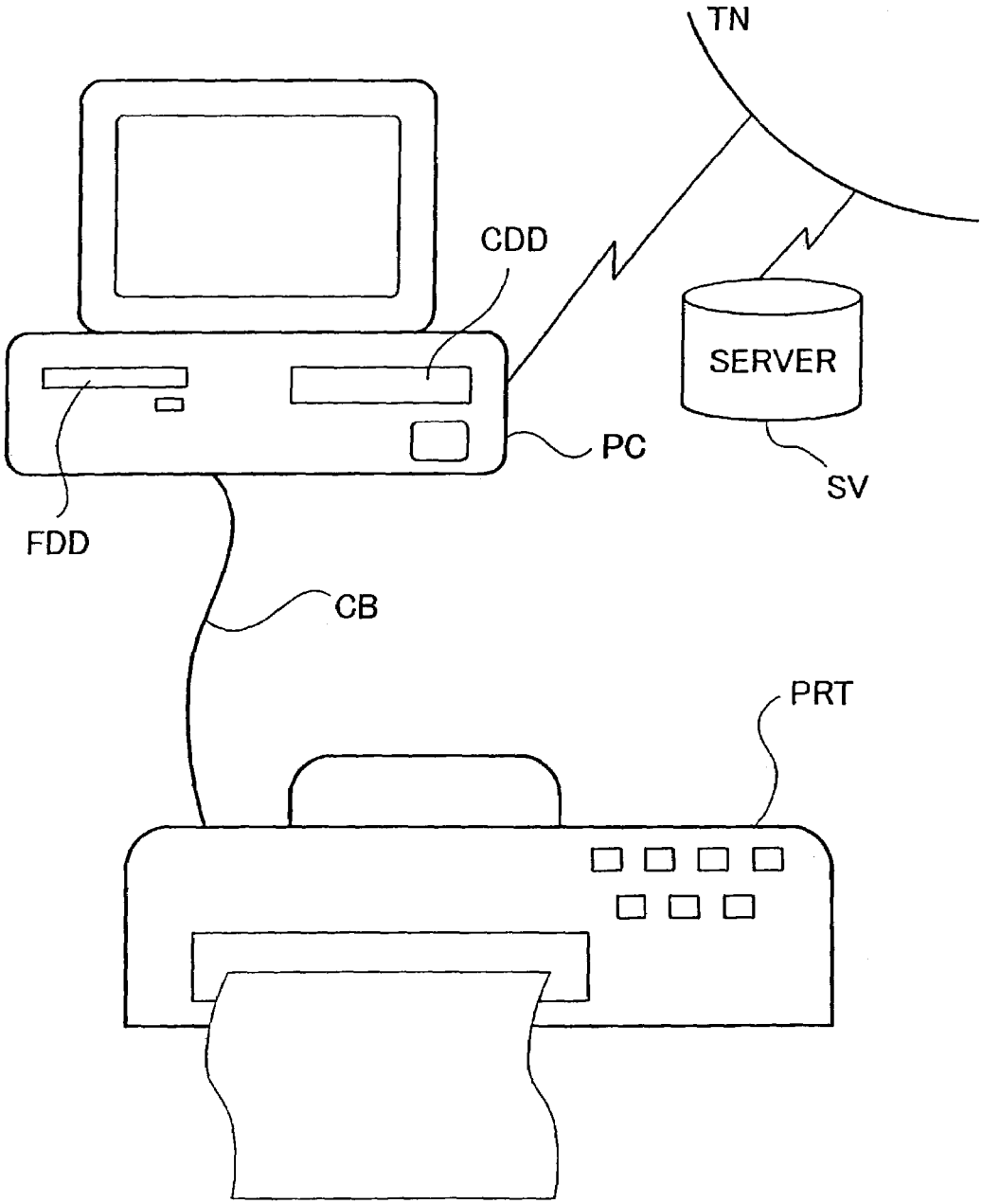
FIG. 1 is a drawing showing the basic configuration of an embodiment of a printing apparatus.

Embodiments of the present invention will be explained below according to the following sequence:

(1) Configuration of the apparatus (2) Dot formation process during uni-directional printing (3) Adjustment pixel allocation for each nozzle (4) First embodiment (5) Second embodiment
(6) Third embodiment
(7) Fourth embodiment (1) Configuration of the Apparatus FIG. 1 is a drawing showing the basic configuration of a printing apparatus embodying the present invention. The printing apparatus of this embodiment is formed by connecting a printer PRT to a computer PC via a cable CB. The computer PC sends print data to the printer PRT, and also controls the operation of the printer PRT. These processes are carried out based on programs called printer drivers.

The computer PC can load and execute programs from a recording medium such as a floppy disk or a CD-ROM via a floppy disk drive FDD or a CD-ROM drive CDD. The computer PC is also connected to an external network TN and can download programs by accessing a specified server SV. Naturally, these programs may be used by loading a single program that incorporates all of the programs needed for printing, or may be loaded in separate modules.

Figure 2:
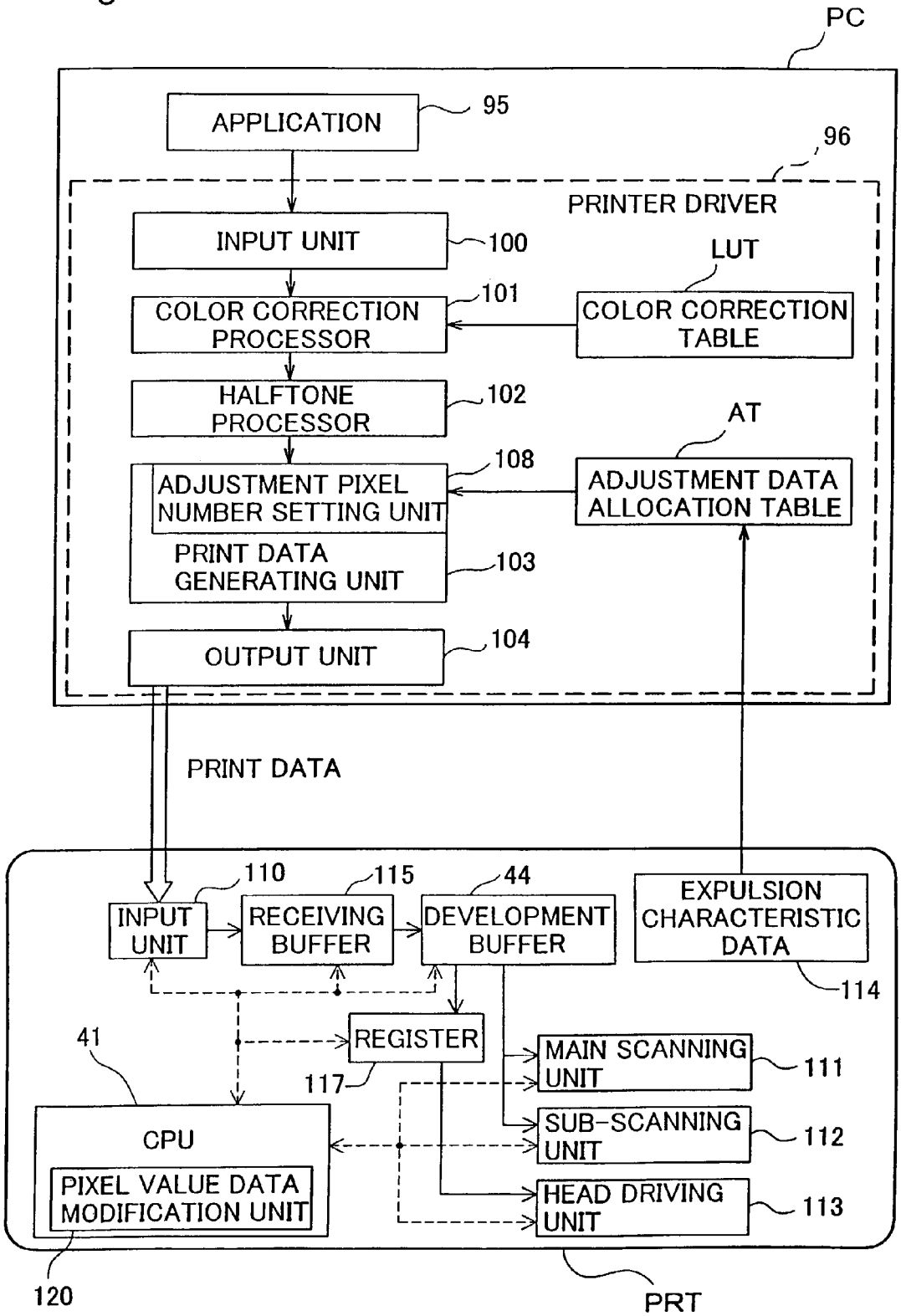
FIG. 2 is a drawing showing the function blocks of the printing apparatus.

FIG. 2 is a drawing showing the function blocks of the printing apparatus. In the computer PC, an application program 95 runs under a prescribed operating system. A printer driver 96 is incorporated in the operating system. The application program 95 carries out processing such as generation of image data. The printer driver 96 generates print data from the image data. In other words, the printer driver 96 functions as a raster data generating unit in the claimed invention.

The printer driver 96 has the function units of an input unit 100, a color correction processor 101, a color correction table LUT, a halftone processor 102, a print data generating unit (raster data generating unit) 103, an adjustment data allocation table AT and an output unit 104. In a narrow sense, the print data generating unit 103 could be regarded as the print data generating unit in the claimed invention.

When a print command is issued from the application program 95, the input unit 100 receives image data and stores it temporarily. This input unit 100 corresponds to the image pixel value data memory unit in the claimed invention. The color correction processor 101 carries out a color correction process to correct the color components of the image data so that they match the color components of the ink in the printer PRT. The color correction process is carried out with reference to the color correction table LUT that stores in advance the relationship between the color components of the image data and the color components of the ink in the printer PRT. The halftone processor 102 performs halftoning to express a tone value of each pixel of this color-corrected data in terms of dot recording density. The adjustment pixel number setting unit 108 included in the print data generating unit 103 adds the adjustment pixel data to the data obtained by the halftoning process, thereby generating print data with which the dot formation position misalignment will be corrected. The adjustment pixel number setting unit 108 corresponds to the allocation setting unit in the claimed invention. The allocation of adjustment pixel data is set with reference to expulsion characteristic data stored in an expulsion characteristic data memory unit (misalignment amount memory unit) 114 in the printer PRT, and is stored in the adjustment data allocation table AT. The print data generating unit 103 generates print data by rearranging the image data including the adjustment pixel data appended, in the order of printing in the printing apparatus, i.e., in the order of the passes made by the printing apparatus, and by then adding prescribed information such as image resolution. Here, a 'pass' refers to a single session of main scanning to form dots. The print data thus generated is output to the printer PRT by the output unit 104. This print data undergoes various types of conversion and processing to convert it into electrical signals to actually drive the machine, whereby printing is performed. Here, the term 'print data' means in a narrow sense the data generated by the print data generating unit 103, but in a wider sense means the data that has undergone the various types of subsequent conversion and processing and is undergoing various stages of conversion and processing.

The printer PRT has various function units such as an input unit 110, a receiving buffer 115, a development buffer 44, a register 117, a main scanning unit 111, a sub-scanning unit 112, and a head driving unit 113. These various components are controlled by the CPU 41. This printer PRT carries out the functions of the printing unit in the claimed invention.

In the printer PRT, the print data supplied from the printer driver 96 is received by the input unit 110 and stored temporarily in the receiving buffer 115. From the data stored in the receiving buffer 115, the data blocks obtained in one pass are sequentially sent to the development buffer 44. This data includes stored the dot formation information for one pass with regard to all of the nozzles used in one session of main scanning. In other words, the data sent to the development buffer 44 contains the pixel value data for multiple raster lines based on which dots are recorded in one session of main scanning. From the one-pass amount of dot formation information for these nozzles, one pixel's worth of dot formation information for each nozzle is prepared, extracted and sent to the register 117, in the order of dot formation for each nozzle. In other words, dot formation information for the pixels aligned in the direction perpendicular to the raster line (i.e., the sub-scanning direction, or the direction of the nozzle rows) is extracted from the dot formation information for the multiple raster lines in a parallel fashion, and is then sequentially sent to the register 117. The register 117 converts the extracted data into serial data and sends it to the head driving unit 113. The head driving unit 113 drives the head based on this serial data, and the image is printed. At the same time, data indicating the main scanning pass and data indicating the sub-scanning method are extracted from the one-pass data in the development buffer 44, and are sent to the main scanning unit 111 and the sub-scanning unit 112, respectively. The main scanning unit 111 and the sub-scanning unit 112 perform main scanning of the head based on the data and feed forward the printing paper. These functions of the various components of the printer PRT are carried out specifically by a CPU 41, a PROM 42, a RAM 43, a development buffer 44, etc., that comprise a control circuit 40 incorporated in the printer PRT.

Figure 3:
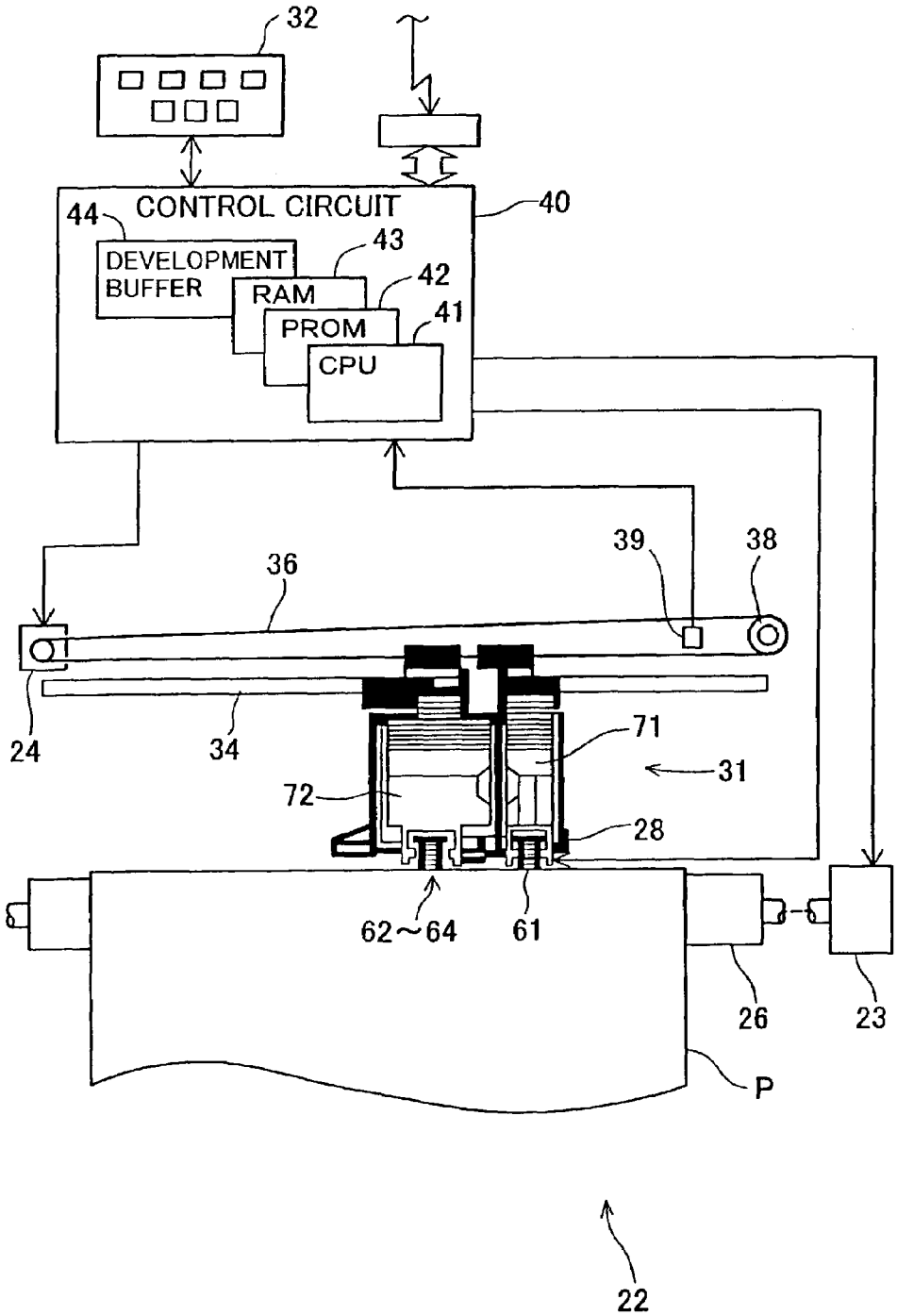
FIG. 3 is a drawing to explain the basic configuration of the printer PRT.

The basic configuration of the mechanical parts of the printer PRT will now be explained with reference to FIG. 3. As shown in the drawing, the printer PRT comprises a circuit that feeds forward the paper P using a paper feed motor 23, a circuit that moves a carriage 31 back and forth along the axis of a platen 26 using a carriage motor 24, a circuit that drives the print head 28 mounted to the carriage 31 and carries out ink expulsion and dot formation, and a control circuit 40 that controls the exchange of signals with the paper feed motor 23, the carriage motor 24, the print head 28 and the operation panel 32.

The circuit that moves the carriage 31 back and forth along the axis of the platen 26 comprises a sliding shaft 34 that is mounted parallel to the axis of the platen 26 and holds the carriage 31 such that it can slide, a pulley 38 that suspends a continuous drive belt 36 between it and the carriage motor 24, a position detection sensor 39 that detects the original position of the carriage 31, etc.

A black ink (K) cartridge and a color ink cartridge 72 that stores ink of the three colors of cyan (C), magenta (M) and yellow (Y) may be mounted to the carriage 31 of the printer PRT. Four actuators 61 through 64 are formed on the print head 28 on the bottom of the carriage 31.

Figure 4:
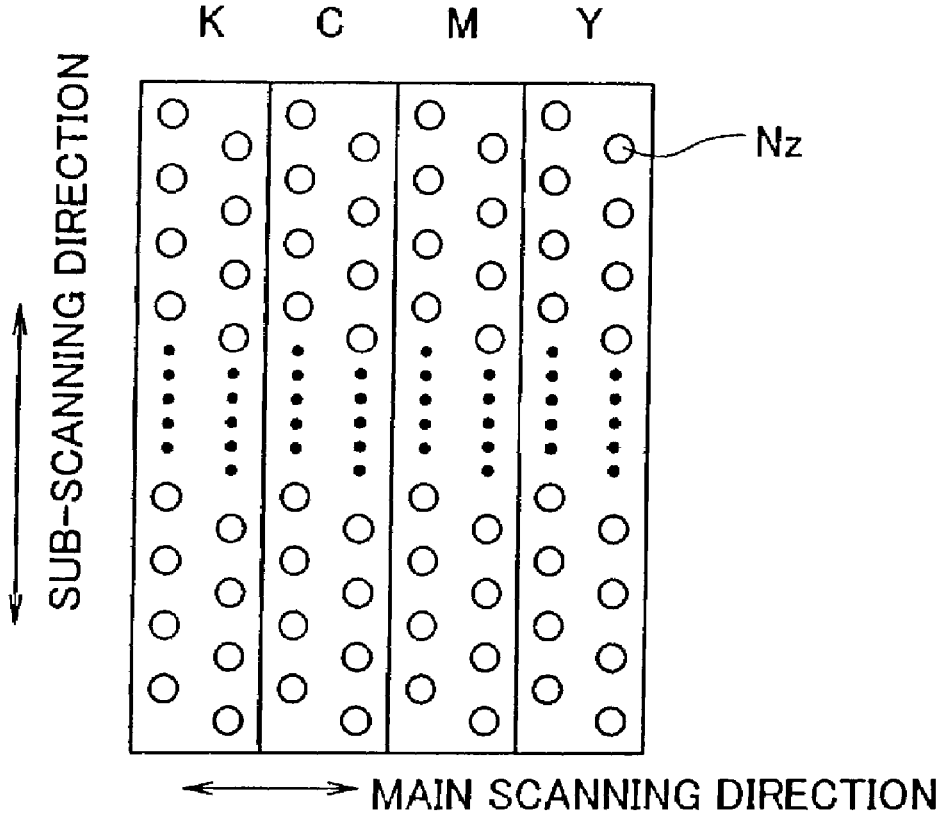
FIG. 4 is a drawing showing the alignment of the nozzles NZ in the actuators 61 through 64.

FIG. 4 is a drawing that shows the alignment of the nozzles Nz in the actuators 61 through 64. These nozzles comprise four nozzle arrays each eject ink of one color. Each nozzle array comprises 48 nozzles Nz that are aligned in a zigzag fashion at a fixed nozzle pitch. In other words, each nozzle array comprises two nozzle rows that extend in the sub-scanning direction, and the nozzles that form each nozzle row are each located in a different location along the sub-scanning direction. The nozzle arrays themselves are aligned along the main scanning direction such that the nozzle arrays are evenly aligned with each other along the sub-scanning direction.

Figure 5:
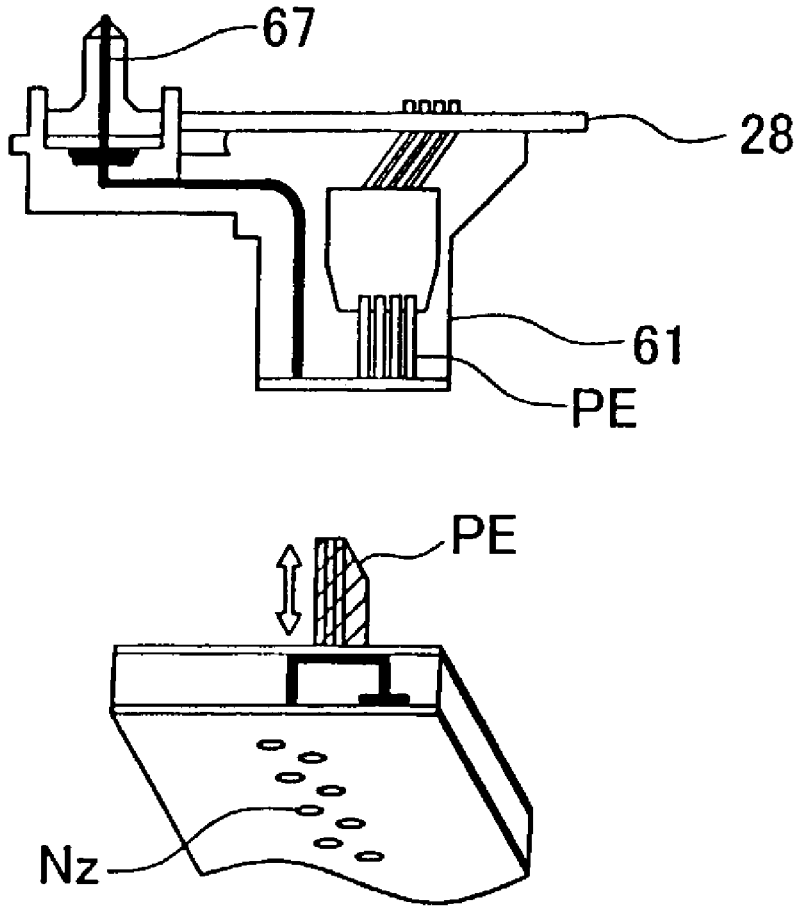
FIG. 5 is a drawing showing the detailed configuration of the piezoelectric elements PE and the nozzles Nz.

FIG. 5 is a drawing showing the detailed configuration of the piezoelectric elements PE and the nozzles Nz. An ink passage 68 to supply ink from the ink cartridge 71 or 72 is formed in each nozzle. Piezoelectric elements (driving devices) PE are located near each ink passage 68. When the control circuit 40 applies a prescribed drive voltage to the piezoelectric elements PE, the ink passage 68 deforms due to the distortion in the piezoelectric elements PE, thereby ejecting ink Ip.

The control circuit 40 (see FIG. 3) comprises a microcomputer that contains a CPU 41, a PROM 4, a RAM 43. It also contains a transmitter that periodically outputs a drive voltage to drive the print head 28 and a development buffer 44 that stores information for each nozzle indicating whether the dot for each pixel is ON or OFF. When the data stored in the development buffer 44 is sequentially output to the print head 28 when main scanning is performed, ink is ejected to each pixel from each nozzle in accordance with the data.

In this embodiment, a mechanism by which ink is ejected using piezoelectric elements is used, but a printer that ejects ink using another method is also acceptable. For example, the present invention may be applied in the type of printer that charges a heater located in the ink passage and ejects the ink through the use of bubbles occurring in the ink passage.

(2) Dot Formation Process During Uni-directional Printing

Figure 6:
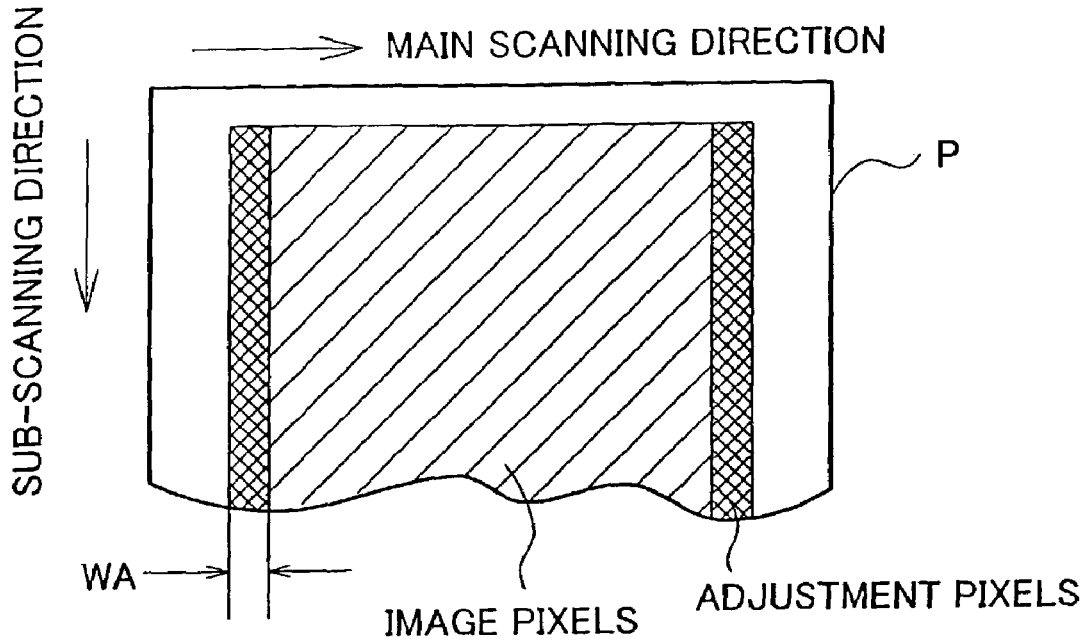
FIG. 6 is a drawing showing the arrangement of the pixels printed by the printer PRT.

The control process to perform dot position misalignment correction during uni-directional printing will first be explained below. FIG. 6 is a drawing showing the arrangement of pixels printed by the printer PRT. As shown in the drawing, dots are formed on the printing paper P in pixels aligned in the two dimensions of the main scanning direction and the sub-scanning direction. In the present invention, two types of pixels, i.e., image pixels and adjustment pixels, are used. As shown in the drawing, the image pixels are aligned in the middle ares of the paper along the main scanning direction, while the adjustment pixels are aligned at opposite ends of the middle area. Dots are formed in the image pixels in order to reproduce the image received from the application program 95. As a result, the image pixels are aligned along the two dimensions of the main scanning direction and the sub-scanning direction, and comprise two-dimensional image data. The adjustment pixels, as described below, are pixels that are used to adjust the printing position of the image along the main scanning direction in accordance with the amount of dot formation position misalignment.

Figure 7:
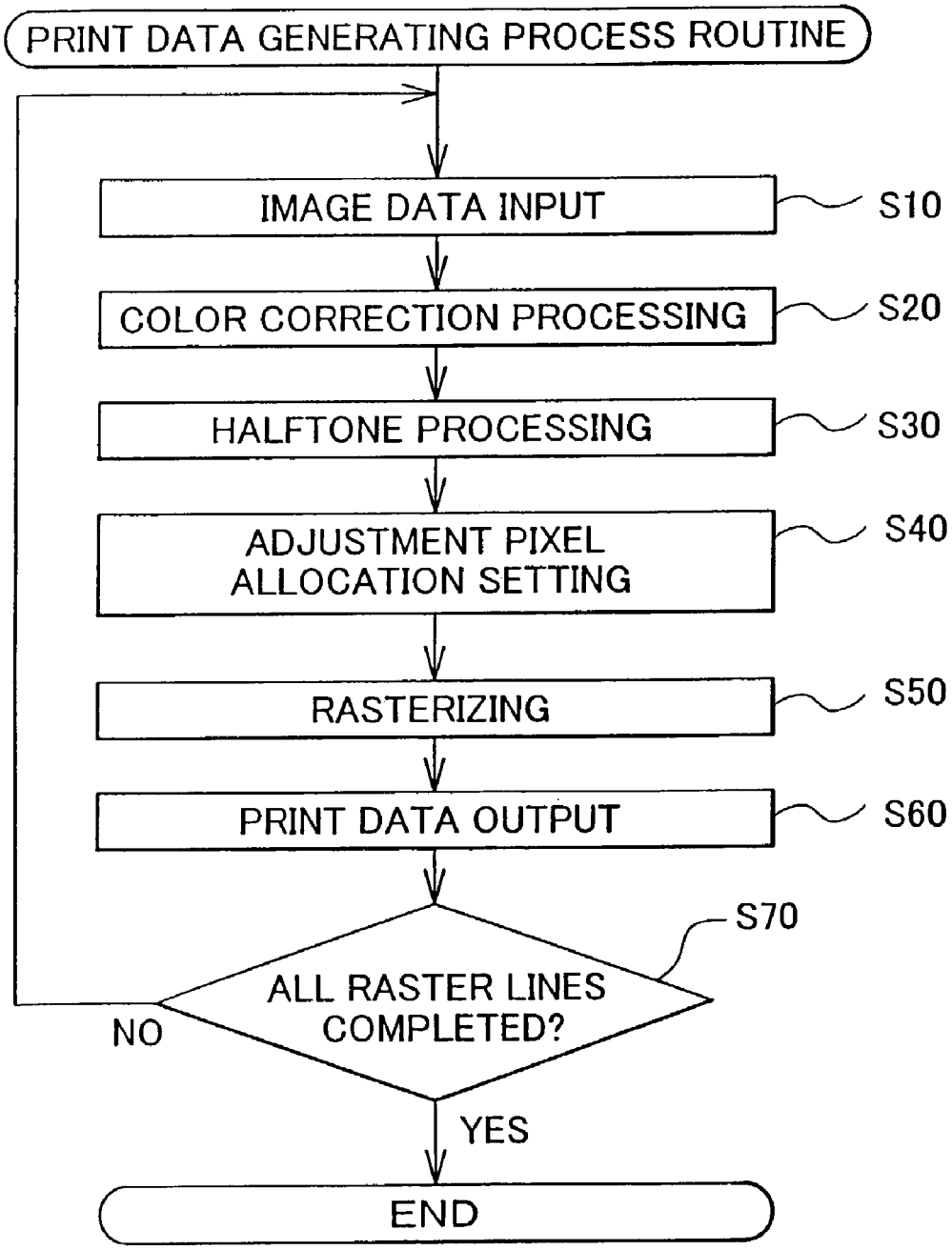
FIG. 7 is a flow chart of the print data generating process routine.

FIG. 7 is a flow chart of the print data generating process routine. This process is executed by the printer driver 96 (see FIG. 2) in the computer PC. When this process is begun, image data is input (step S10) from the input unit 100 (see FIG. 2). The input image data is received from the application program 95 shown in FIG. 2, and contains tone values of 256 tone levels ranging from 0 to 255, for each of the colors of R, G and B for each of the pixels that form the image. The resolution of this image data varies in accordance with the resolution of the original image data ORG.

The color correction processor 101 (see FIG. 2) of the printer driver 96 performs color correction to the input image data (step S20). The color correction process is a process in which the image data comprising R, G and B tone values is converted to tone value data for each ink used by the printer PRT. This process is carried out using the color correction table LUT (see FIG. 2). Various public domain technologies are available for the process by which color is corrected using a color correction table, and the interpolation calculation method, for example, may be applied.

When the color correction process is completed, the halftone processor 102 (see FIG. 2) performs halftoning for each ink (step S30). Halftoning is a process in which the tone values of the original image data (here, 256 tone levels are available) are converted to n-bit (n being a natural number) image pixel value data indicating the dot formation status for each pixel. Halftoning may be carried out using any of various public domain methods, such as the error diffusion method or the dithering method.

Figure 8:
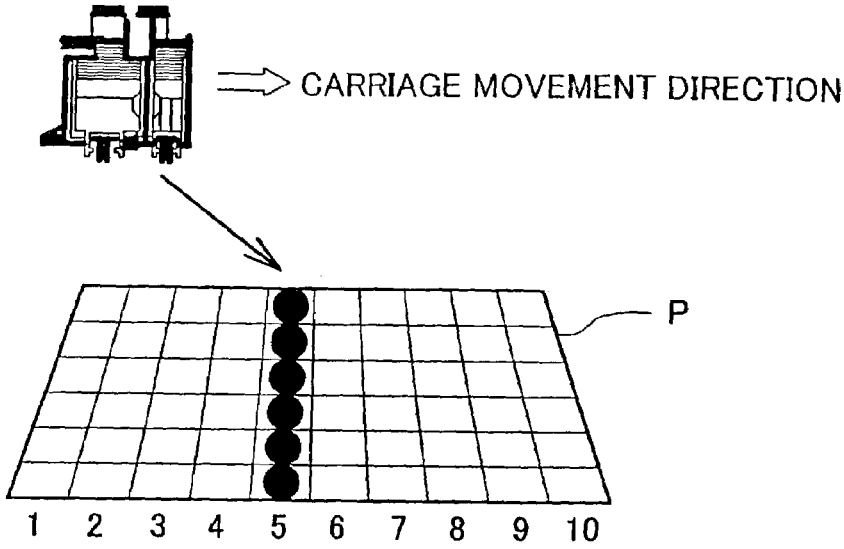
FIG. 8 is a drawing showing the arrangement of dots formed at a correct timing.

When halftoning is completed, adjustment pixel allocation setting is performed by the adjustment pixel setting unit 108 (see FIG. 2) incorporated in the print data generating unit 103, based on a process described below. FIG. 8 is a drawing showing the placement of dots formed at the correct timings. The rectangles in the drawing indicate pixels aligned in two dimensions on the paper P. The numbers 1 through 10 indicate positions along the main scanning direction. As shown in the drawing, when ink is ejected at prescribed timings while the carriage is moving in the main scanning direction, dots are formed in the fifth column.

Figure 9:
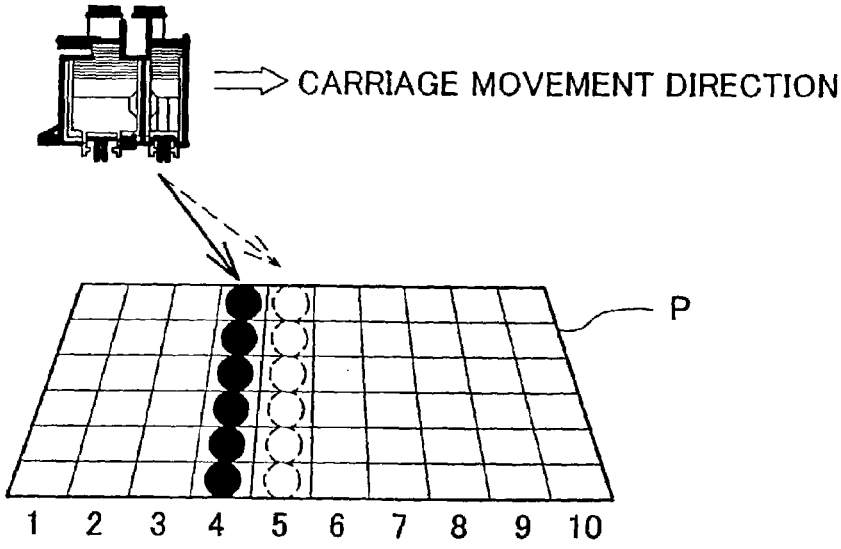
FIG. 9 is a drawing showing the arrangement of dots formed by a nozzle that causes dot formation position misalignment.

FIG. 9 is a drawing showing the placement of dots formed by nozzles which cause formation position misalignment. Even when the ink is ejected at the timing at which dots could originally be formed in the fifth pixel column, the dot formation position may be misaligned due to the ink expulsion characteristic of each nozzle. Here, the situation in which the dots are shifted to the left along the main scanning direction is shown in the drawing. As a result, the dots that should have been formed by the ink traveling in the direction indicated by the dashed arrow are instead formed in the pixels in the fourth column.

Figure 10:
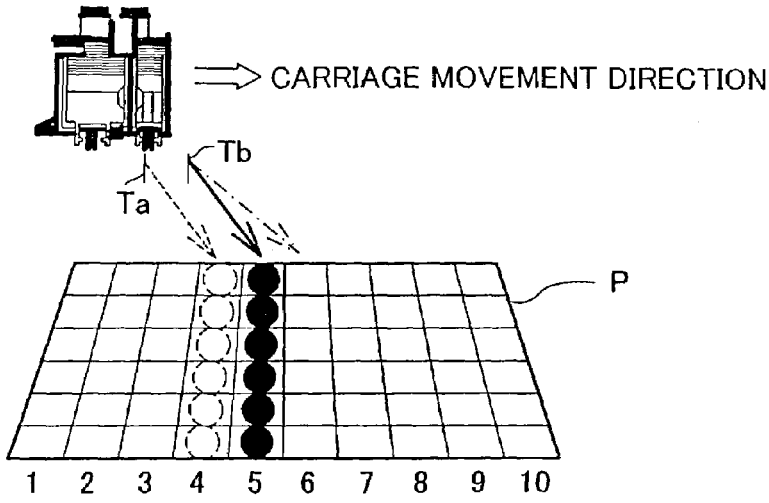
FIG. 10 is a drawing showing the correction of dot formation position misalignment through image data adjustment.

FIG. 10 is a drawing showing the correction of dot formation position misalignment carried out through image data adjustment. Let us consider the case in which the dots were formed to the left of the original pixels, as shown in FIG. 9. In other words, where ink is ejected at a timing Ta in order to form dots in the fifth pixel column, the dot formation position is shifted and the dots are formed in the fourth pixel column. In this situation, the image data is adjusted and the ink is ejected at a timing Tb suitable to form the dots in the sixth pixel column. If the ink expulsion characteristics were correct, and if the ink were ejected at the timing Tb, dots would be formed in the sixth pixel column, as indicated by the one-dot chain line in the drawing. However, because the nozzle's ink expulsion characteristic is such that the dots are misaligned, the ink in actuality travels in the direction indicated by the solid arrow, and dots are formed in the fifth pixel column. In other words, by adjusting the image data in consideration of the amount of misalignment, dots may be formed in the pixels in which they were originally formed. Adjustment pixel allocation setting is carried out in order to correct the dot formation position misalignment using this process.

Figure 11:
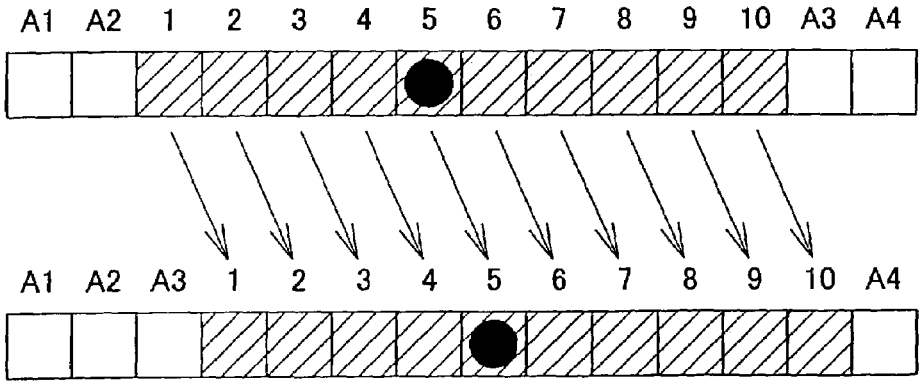
FIG. 11 is a drawing showing the correction of dot formation position misalignment through adjustment pixel allocation setting.
Figure 15A:
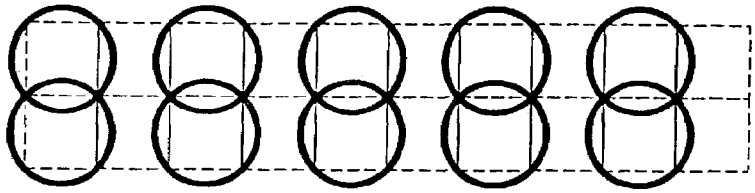
FIGS. 15(*a*)–15(*e*) are a drawings showing misalignment correction performed by the printing apparatus of the embodiment.
Figure 15B:
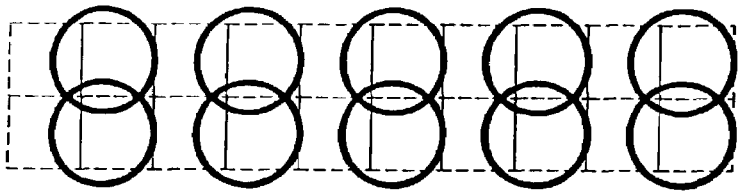
Figure 15C:
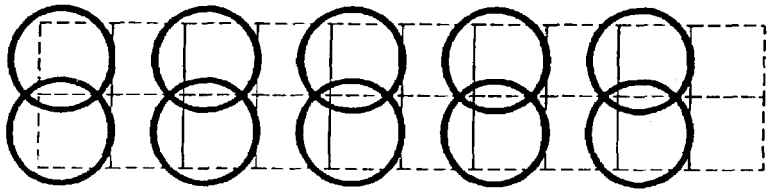
Figure 15D:
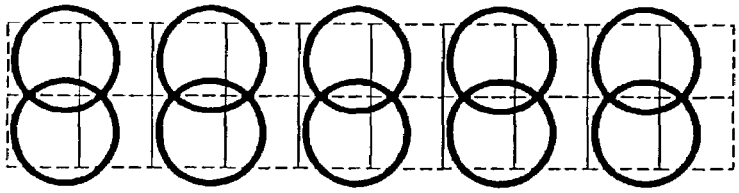
Figure 15E:
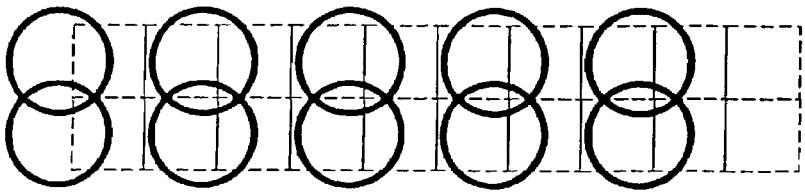

FIG. 11 is a drawing showing the correction of dot formation position misalignment carried out through adjustment pixel allocation setting. The squares in the drawing indicate the placement of print data (hereinafter referred to as 'raster data') corresponding to one raster line. The pixels to which the numbers 1 through 10 are assigned are image pixels. The pixels A1 through A4 at either end are adjustment pixels. Here, two adjustment pixels are located at either end. Image pixel value data that has undergone halftoning in accordance with the image data is allocated to each image pixel. Adjustment pixel value data having a value that indicates that a dot is not formed is allocated to each adjustment pixel.

The top part of FIG. 11 shows the raster data before adjustment pixel allocation setting is performed. The solid circle in the fifth pixel position means that a dot is formed in the fifth pixel column as described above with reference to FIGS. 8 through 10. Where the dot formation position is correct, a dot is formed in the fifth pixel by executing printing based on this data. The bottom part of FIG. 11 indicates data in the case where adjustment is carried out as described above with reference to FIGS. 9 and 10. As explained above, for a nozzle having an expulsion characteristic such that its dot formation position is shifted to the left by one pixel, the raster data should be changed such that dots from that nozzle are formed one pixel to the right, so that they are formed in the target fifth pixel position. In other words, all of the raster data should be shifted one pixel to the right, as shown in FIG. 11. This situation is equivalent to a situation in which the original allocation of two adjustment pixels to either side is changed to an allocation of three pixels on the left side and one pixel on the right side. If printing is performed based on this raster data, dots are formed in the positions in which they should be formed, as shown in FIG. 10.

The number of adjustment pixels to be allocated to the left and right is set in accordance with the dot formation position misalignment for each nozzle. The formation position misalignment for each nozzle is stored in the printer PRT as expulsion characteristic data. FIG. 12 is a drawing showing an example of expulsion characteristic data. Here, a table is used that provides misalignment amounts for each color of ink. The amounts of dot formation position misalignment due to differences in ink expulsion characteristics are often virtually identical for different nozzles for the same ink. In addition, dot formation position misalignment occurring between different colors has a substantial effect on image quality. From this standpoint, the table in FIG. 12 corrects for dot formation position misalignment on a uniform basis for each color, not individually for each nozzle.

As shown in the drawing, values that indicate the amount of dot formation position misalignment for each color in units of one pixel are stored as expulsion characteristic data. For example, the value −1 is stored for black (K), indicating that dots are formed at a position that is shifted by one pixel from the target pixel in the direction opposite the direction of carriage movement. In other words, black (K) has the ink expulsion characteristic indicated in FIGS. 9 and 10. The value −2 is set for cyan (C), indicating that dots are formed at a position that is shifted by two pixels from the target pixel in the direction opposite the direction of carriage movement. The value 1 is set for magenta (M), indicating that dots are formed at a position that is shifted by one pixel from the target pixel in the direction of carriage movement. The value set for yellow (Y) is 0, indicating that there is no dot formation position misalignment. Naturally, the expulsion characteristic values for each individual printer PRT are stored as these values.

The flow chart in FIG. 7 shows the adjustment pixel allocation setting process that occurs during the print data generating process routine. In practice, the CPU of the computer PC reads the misalignment amount table stored in the printer PRT (see FIG. 12) at the moment the printer driver 96 is activated and creates an adjustment data allocation table in which the adjustment pixel allocation is specified for each color. FIG. 13 is a drawing showing an example of this adjustment data allocation table. It shows a table corresponding to the expulsion characteristic data in FIG. 12. In this case, a total of four adjustment pixels are allocated, in accordance with the example shown in FIG. 11. As explained with reference to FIG. 11, in order to correct the dot formation misalignment for black (K), three adjustment pixels are allocated to the left side and one adjustment pixel is allocated to the right side. By the same token, for cyan (C), four pixels are allocated to the left side and no pixels are allocated to the right side. For magenta (M), one pixel is allocated to the left side and three pixels are allocated to the right side. Because yellow (Y) dots are formed at the correct positions, two pixels are allocated to both the left side and the right side. The number of adjustment pixels is not limited to four, and any desired number that permits the correction of dot formation misalignment may be used. In step S40, the allocation of adjustment pixels is set for each color through the reading of the adjustment data allocation table created in the manner described above.

When the adjustment pixel allocation is set as described above, the print data generating unit 103 (see FIG. 2) rasterizes the image pixel value data, as shown in FIG. 7, and generates the raster data shown in the lower part of FIG. 11 (step 50). Rasterizing is a process in which image pixel value data that has undergone halftoning is rearranged in the order in which it is sent to the printer PRT. In this process, the adjustment pixels described above are combined with the halftone-processed image pixel value data. For example, where the left side is given three adjustment pixels and the right side is given one adjustment pixel, first, the three-pixel data corresponding to the adjustment pixels, i.e., data indicating the non-formation of dots is placed for three pixels, as shown in FIG. 11, the data corresponding to the halftone-processed image data is then aligned in the direction of carriage movement, and finally the one-pixel data corresponding to the adjustment pixel to be positioned on the right side is placed. The data resulting from the combining of the adjustment pixels and the halftone-processed image pixels is called raster data. The print data supplied to the printer PRT includes this raster data as well as data indicating the amount of sub-scan feed.

The output unit 104 (see FIG. 2) outputs the print data created in this way to the printer PRT (step S60). The above processes are carried out for each raster line (step S70). The control circuit 40 of the printer PRT forms dots and prints images while carrying out main scanning in accordance with the sent print data.

In the above explanation, the halftone-processed image pixel data is generated first (step S30), and print data is created by combining this halftone-processed image data with the adjustment pixels that are allocated in a separate process. However, the print data may also be generated using the following process. First, together with the halftoning, first print data is generated in which a prescribed number of adjustment pixels are placed at the left and right. The number of adjustment pixels placed corresponds to the number placed when dots are formed in the correct positions. This data is equivalent to the data indicated in the top part of FIG. 11. Next, the positions of the image pixels are adjusted in accordance with the expulsion characteristic data so that the dot formation position misalignment is corrected. For example, for black (K) ink having the expulsion characteristic shown in FIG. 12, the positions of all of the image pixels are shifted to the right by one pixel, as shown in the bottom part of FIG. 11. The print data may be generated in any sequence, as described above, so long as the number of adjustment pixels to the left and right in the print data may be adjusted in accordance with the expulsion characteristic data.

In the print data, the number of adjustment pixels need not be set such that the dot positions are absolutely correct. What affects image quality is the relative positioning of the dots. Therefore, the number of adjustment pixels may be set such that the formation positions for dots of different colors match those for dots of a prescribed color used as a reference. FIG. 14 is a drawing showing an example of an adjustment pixel allocation table in which black ink is set as the reference. This is a table created based on the expulsion characteristic data shown in FIG. 12. As shown in FIG. 12, black (K) has the characteristic that dots are formed in a misaligned position relative to the target positions. In the adjustment pixel allocation table of FIG. 13 explained above, the adjustment pixel allocation is set so that black dots are formed at the correct positions. By contrast, the adjustment pixel allocation table of FIG. 14 sets the adjustment pixel allocation using black dots as the reference. Therefore, the allocation of adjustment pixels for black is set so that an equal number of pixels is allocated to the left and the right. In this example, two adjustment pixels are allocated to the left and the right.

On the other hand, adjustment pixels for other colors are allocated so that the positions of the dots of those colors will be proper relative to the black dots. According to the expulsion characteristic data shown in FIG. 12, cyan (C) dots are formed at positions that are shifted relative to black by one pixel in the direction opposite the direction of carriage movement. To correct this misalignment, adjustment pixel setting is made such that three pixels are allocated to the left side and one pixel is allocated to the right side. Similarly, for magenta (M), adjustment pixel setting is made such that no pixels are allocated to the left side and four pixels are allocated to the right side. For yellow, while the dots are formed at the correct timings according to the expulsion characteristic table in FIG. 12, when black is used as the reference, the dots are relatively shifted by one pixel in the direction of carriage movement. Therefore, the setting is made such that one pixel is allocated to the left side and three pixels are allocated to the right side. Adjustment pixel setting may be carried out using a prescribed color as a reference in this fashion. Because adjustment pixels for black are always set to a fixed allocation, this method offers the advantage of easy processing.

Using the printing apparatus described above, dot formation position misalignment can be corrected through the use of print data in which adjustment pixels are allocated to either side of the image pixels and by changing the allocation of adjustment pixels. Therefore, dot misalignment is reduced, and high-quality printing without color shift is attained.

FIG. 15 is a drawing showing misalignment amount correction in a printing apparatus. The squares of the dashed lines in the drawing indicate pixels. The circles indicate dots. The printer PRT achieves printing at extremely high resolution, and forms dots that are sufficiently large relative to the size of the pixels such that there is no gap between adjacent dots.

FIG. 15(*a*) shows dots formed at the correct positions. FIG. 15(*b*) shows a case in which the dot formation positions are shifted to the right due to the nozzle's expulsion characteristic. The dot formation position misalignment does not always occur in units of the pixel-width as shown in FIG. 9. FIG. 15(*b*) shows a case in which the formation position misalignment amount is less than one pixel. In this case as well, misalignment correction is performed in units of one pixel. Here, adjustment pixel allocation setting is carried out so that dots are formed one pixel to the left. FIG. 15(*c*) shows the arrangement of the dots after this correction is performed. Because the amount of misalignment is less than one pixel, the dot formation positions are still misaligned even in FIG. 15(*c*). However, it can be seen that the amount of misalignment has been reduced relative to FIG. 15(*b*).

FIG. 15(*d*) shows a case involving different expulsion characteristics. Here, the amount of misalignment of the formed dots is less than half a pixel. In this case, if misalignment is corrected in units of one pixel, the amount of misalignment will actually increase, as shown in FIG. 15(*e*). Therefore, misalignment correction is not performed in this case. The determination of whether or not correction is to be carried out in accordance with the expulsion characteristic is controlled based on the expulsion characteristic data. Where the degree of misalignment shown in FIG. 15(*b*) exists, if the value '1' is stored in the expulsion characteristic data table (see FIG. 12), correction by one pixel is performed, and printing is performed as shown in FIG. 15(*c*). Where only a slight amount of misalignment exists, as shown in FIG. 15(*d*), if the value '0' is stored in the expulsion characteristic data table (see FIG. 12), misalignment correction is not performed, and printing is carried out as shown in FIG. 15(*d*). In the case in which the amount of misalignment is greater than one pixel, a proper value should also be set as expulsion characteristic data in accordance with the misalignment amount.

In this way, minute adjustment of dot formation positions is carried out in increments of one pixel by allocating adjustment pixels in accordance with the expulsion characteristic data. In a printer PRT capable of very high-resolution printing, because the width of one pixel is extremely small, dot formation positions in the main scanning direction is sufficiently adjusted.

Using the method described above, dot formation position misalignment can be corrected through adjustment of the positional relationship between image pixels and adjustment pixels. In other words, new hardware is not required to correct the misalignment. Therefore, the method offers the advantages that it allows the misalignment to be corrected relatively easily and enables image quality to be improved. Furthermore, this method may be applied to both unidirectional printing and bi-directional printing, and achieves the effect described above in either case.

The above explanation involved correction of misalignment for all of the image data to be printed. However, correction may be performed for only the areas in which dot misalignment has a major impact on image quality. For example, misalignment correction may be omitted for dots of yellow ink, which among the various inks incorporated in the printer PRT has a relatively low visibility. Furthermore, it is known that dot misalignment generally has the largest effect on image quality in the areas having an intermediate level of recording density. In low-level areas having a low dot recording density and in high-level areas having a high dot recording density, dot formation position misalignment is difficult to perceive and has little impact on image quality. Therefore, it is acceptable if dot formation position misalignment correction is performed only in intermediate density areas in which such misalignment has a significant effect on image quality, and omitted in other areas. If misalignment correction is carried out only in areas in which dot misalignment has a large impact on image quality in this way, the burden on the processor when print data generation is performed is reduced, and printing is performed in a relatively short amount of time.

(3) Adjustment Pixel Allocation for Each Nozzle

Figure 16:
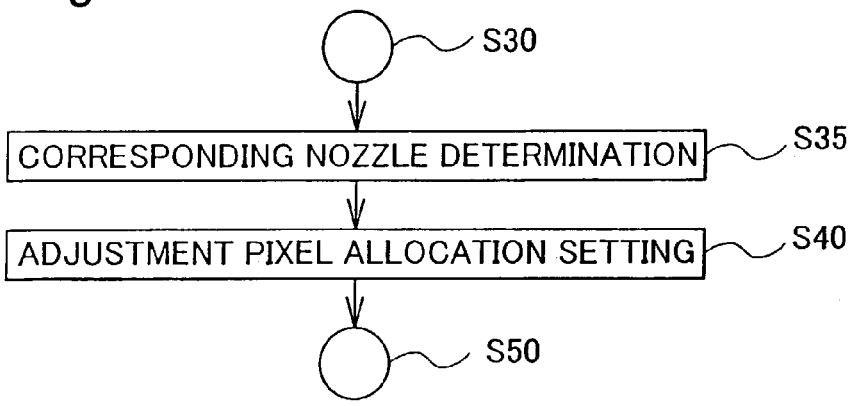
FIG. 16 is a flow chart of a different form of the print data generating process routine.

FIG. 16 is a flow chart of a different form of the print data generating process routine. In the drawing, only the parts that are different from the routine shown in FIG. 7 are shown. As shown in the drawing, this method differs from the previous method in that the subject nozzle is determined (step S35) before the adjustment pixel allocation setting process (step S40) is performed. In the method described previously, adjustment pixel allocation setting is performed on a global basis for each color, but in this method, adjustment pixel allocation setting is performed for each nozzle. As a result, prior to adjustment pixel allocation setting, it is first determined which nozzle will form the raster line that will be the subject of the processing (step S35).

Figure 17:
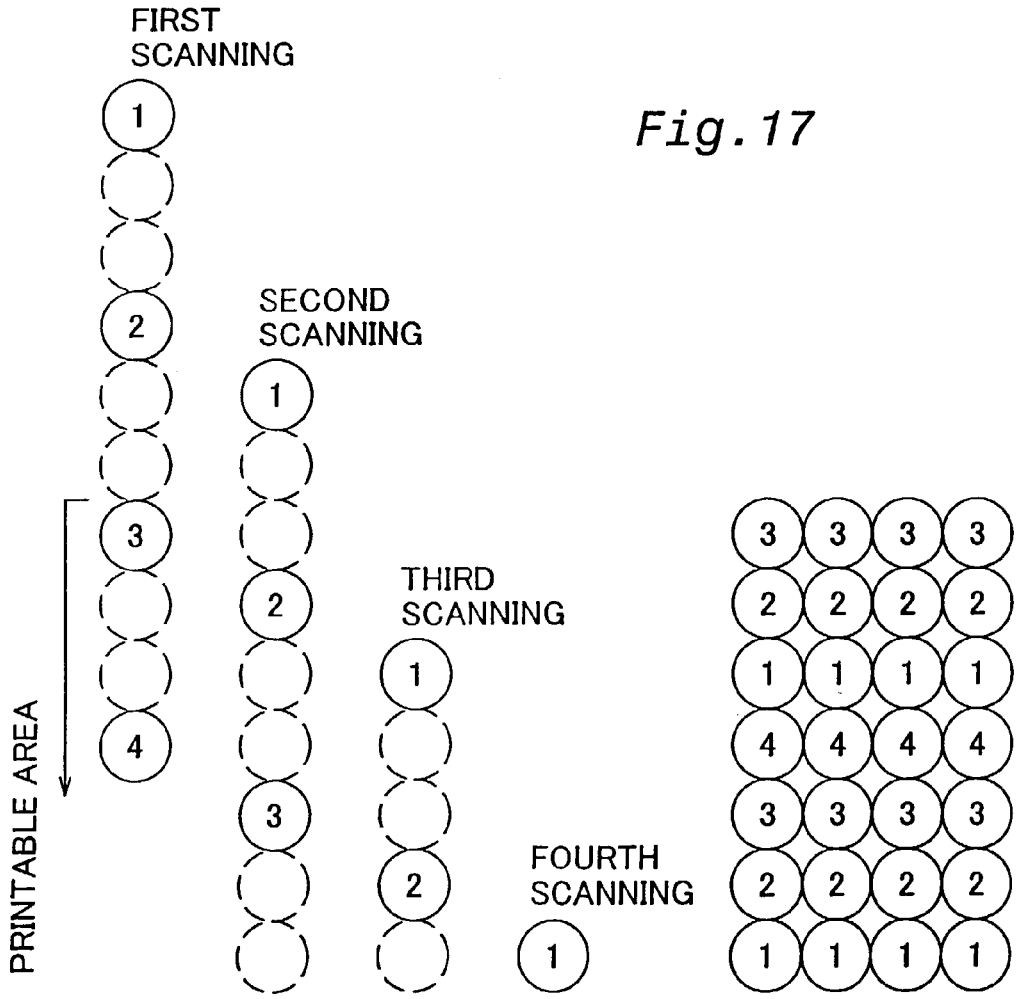
FIG. 17 is a drawing showing image printing according to the interlace method.

The method by which the subject nozzle is determined will now be explained. As shown in FIG. 4, the print head 28 of the printer PRT has a plurality of nozzles aligned in the sub-scanning direction at a fixed nozzle pitch. The printer PRT prints images using the so-called interlace method, in which sub-scanning is performed using a prescribed feed amount. FIG. 17 is a drawing explaining the manner in which an image is printed using the interlace method.

The left side of the drawing shows in a simplified fashion the positions of the nozzles during each main scanning session. The numbers inside the solid circles indicate nozzles. The circles of dashed lines located between the nozzles indicate the nozzle pitch. Here, the drawing shows a case in which the head has four nozzles, with a nozzle pitch of three dots. When sub-scanning is performed by an amount equivalent to four dots, the head sequentially moves from the 'first scanning' position through the 'fourth scanning' position in the drawing. The arrangement of the dots formed by the main scanning of the head at these positions is shown in the right-hand part of FIG. 17. The numbers in this part correspond to the numbers of the nozzles forming each dot. As is clear from the drawing, the reason that dots are not formed by the No. 1 nozzle and the No. 2 nozzle during the first main scanning and by the No. 1 nozzle during the second scanning is that raster lines cannot be contiguously formed in subsequent scanning sessions.

Where printing is carried out using the interlace method in this way, the nozzles that form each raster line is determined on the basis of one nozzle per raster line, as shown in FIG. 17. In step S35, the nozzles by which each raster line is formed are determined based on these raster/nozzle relationships. As is known in the art, printing using the interlace method may be carried out using various feed amounts depending on the nozzle pitch and the number of nozzles. The nozzles used to form each raster line easily determined in accordance with the amount.

The nozzles used to form each raster line are determined (step S35) in this way and adjustment pixel allocation setting is performed for each nozzle (step S40). The principle behind the adjustment pixel allocation setting is identical to that explained above. The difference is that whereas the expulsion characteristic data pertained to each ink color in the previous explanation, here the expulsion characteristic data pertains to each nozzle.

Using the method described above, dot formation position misalignment is carried out with consideration of the ink expulsion characteristic of each nozzle. Therefore, dot misalignment is reduced, and higher-quality printing is achieved. Furthermore, this method may be applied to uni-directional printing or bi-directional printing, and the effects described above will be achieved in either case.

In this method, separate expulsion characteristic data need not be prepared for every nozzle. For example, expulsion characteristic data may be prepared only for each nozzle row shown in FIG. 4.

(4) First Embodiment (4-1) Print Data Generation

The configuration of the hardware in this embodiment is as described above (see FIGS. 1 through 4). In this embodiment, correction of dot position misalignment is carried out during bi-directional printing, i.e., printing in which printing is performed while the carriage is moving in both the forward and reverse directions.

Figure 18:
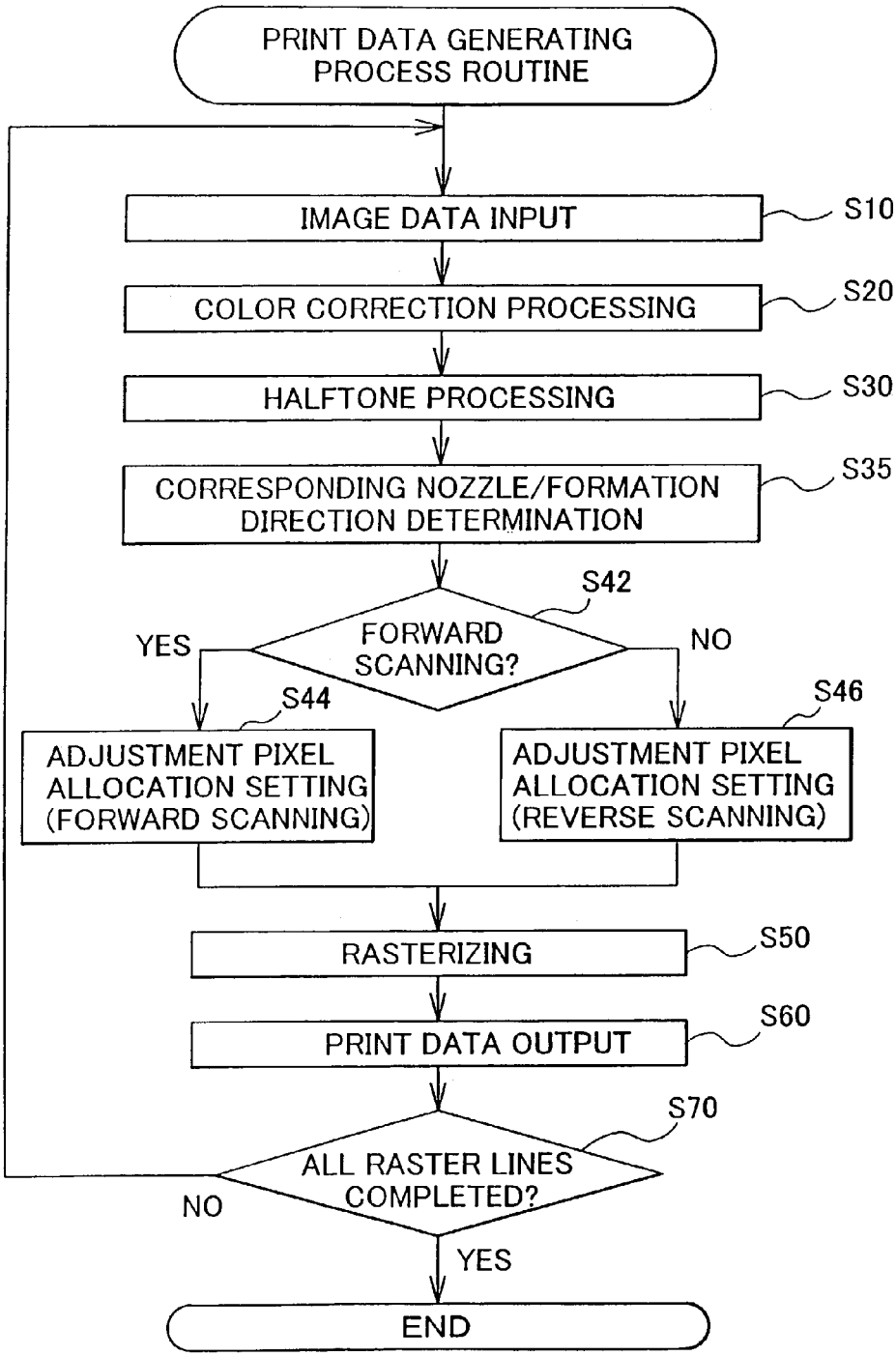
FIG. 18 is a flow chart of the print data generating process routine in the second embodiment.

FIG. 18 is a flow chart of the print data generating process routine for this embodiment. This process is executed by the CPU of the computer PC. When this process is begun, the input unit 100, the color correction processor 101 and the halftone processor 102 (see FIG. 2) carry out image data input, color correction processing and halftoning, respectively (steps S10, S20, S30). These processes are the same as those shown in FIG. 7.

Next, the print data generating unit 103 determines the subject nozzles and the formation direction (step S35). As explained previously (see FIG. 17), where the feed amount for the interlace method is specified, the subject nozzles are determined on a nozzle-to-raster-line basis. In step S35, subject nozzle determination is carried out through the same method as described above. In this embodiment, printing is performed while the carriage is moving in both the forward and reverse directions. Where printing is performed based on the feed amount shown in FIG. 17, printing in odd-numbered scanning sessions is performed with the carriage moving in the forward direction, while printing in even-numbered scanning sessions is performed with the carriage moving in the reverse direction. Therefore, as is clear from FIG. 17, if the feed amount for the interlace method is specified, not only are the nozzles that form each raster line determined, but it is also easily determined whether each raster line is formed during forward carriage movement or reverse carriage movement. In the step S35 of this embodiment, the subject nozzles and the formation direction are determined in accordance with these relationships of correspondence.

It is next determined by the print data generating unit 103 whether or not the raster line that is the subject of processing is to be formed during forward scanning (step S42). If the raster line is to be formed during forward scanning, the adjustment pixel number setting unit 108 specifies the adjustment pixels based on the adjustment pixel allocation table for forward scanning (step S44). If the raster line is to be formed during reverse scanning, the adjustment pixels are specified based on the adjustment pixel allocation table for reverse scanning (step S46). As described above, in this embodiment, the corresponding adjustment pixel allocation table is used depending on the direction of carriage movement when each raster line is formed.

Figure 19A:
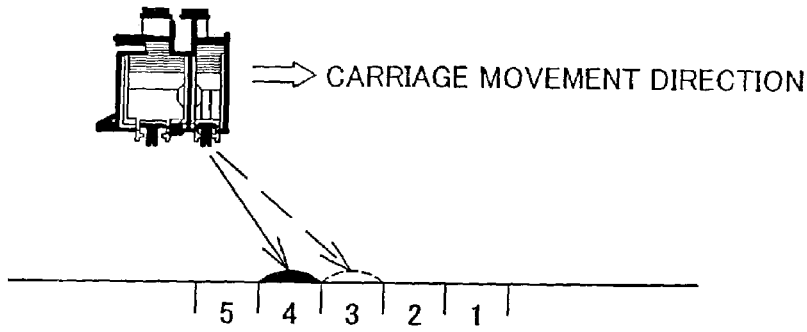
FIGS. 19(*a*) and 19(*b*) are a drawings showing the relationship between the carriage movement direction and the amount of dot formation position misalignment.
Figure 19B:
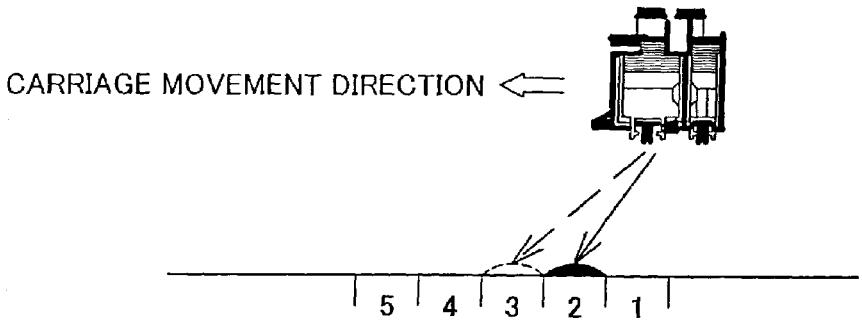

The reason that this use of the corresponding table is necessary will now be explained. FIG. 19 is a drawing showing the relationship between the carriage movement direction and the dot formation position misalignment amount. FIG. 19(*a*) shows the dot placement when dots are formed while the carriage is moving to the right (forward). For example, let us consider the case in which, where the nozzle's expulsion characteristic is such that when ink is ejected at a timing at which a dot should be formed in the third pixel in the drawing, a dot is in fact formed in the fourth pixel. FIG. 19(*b*) shows the dot placement when dots are formed while the carriage is moving to the left (reverse). Where printing is performed while the print head having the expulsion characteristic shown in FIG. 19(*b*) is moving in the reverse direction, when ink is ejected at a timing at which a dot should be formed in the third pixel, the dot is in fact formed in the second pixel. In this fashion, dot misalignment occurs in opposite directions during forward movement and reverse movement.

Figure 20:
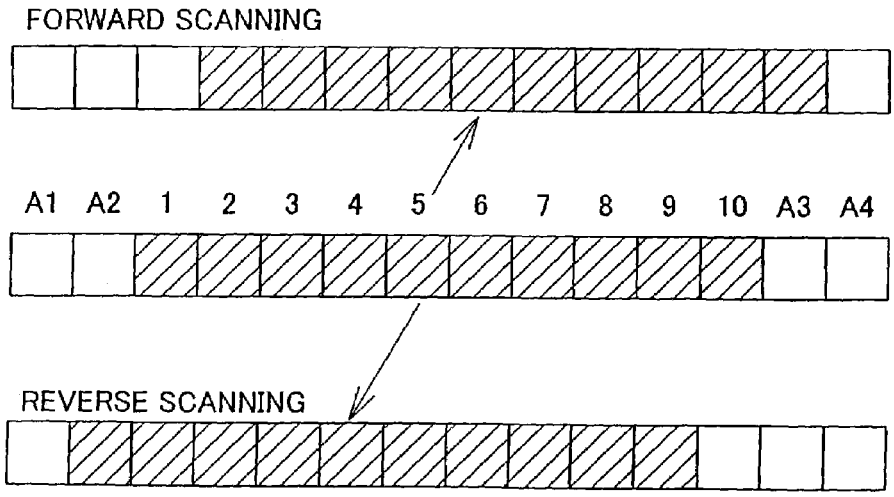
FIG. 20 is a drawing showing the relationship between the carriage movement direction and misalignment amount correction.

FIG. 20 is a drawing showing the relationship between the carriage movement direction and misalignment amount correction. It shows a situation corresponding to the expulsion characteristic shown in FIG. 19. As shown in FIG. 19(*a*), during forward scanning, the dot is formed at a position that is shifted one pixel to the left of the position at which it should have been formed. To correct this misalignment, print data is generated for forward scanning in which the image pixels are shifted to the right by one pixel. In other words, adjustment pixels are allocated such that there are three adjustment pixels on the left side and only one adjustment pixel on the right side. As shown in FIG. 19(*b*), during reverse scanning, the dot is formed at a position that is shifted one pixel to the right of the position at which it should have been formed originally. To correct this misalignment, print data for reverse scanning is generated in which the image pixels are shifted to the left by one pixel. In other words, adjustment pixels are allocated such that there is one adjustment pixel on the left side and three adjustment pixels on the right side. Because the direction of misalignment is different depending on the direction of carriage movement, the adjustment pixel allocation performed to correct the misalignment also differs, in the manner described above.

Taking into account the difference described above, in this embodiment, adjustment pixel allocation setting is performed in accordance with the direction of carriage movement when raster lines are formed (steps S44, S46 in FIG. 18). This allocation setting is executed by preparing two adjustment pixel allocation tables, one each for forward and reverse carriage movement. Where dot formation position misalignment is due solely to a difference in ink expulsion characteristics, the allocation of adjustment pixels to the right and left is reversed for forward and reverse carriage movement, as shown in FIG. 20. To explain using the example of FIG. 20, while the adjustment pixels are allocated such that three adjustment pixels are on the left and one adjustment pixel is on the right during forward movement, during reverse movement they are allocated such that one adjustment pixel is on the left and three adjustment pixels are on the right. Therefore, the adjustment pixel allocation setting process of steps S44 or S46 can be carried out such that the relationship between the single adjustment pixel allocation table and the allocation of adjustment pixels to the left and right is reversed based on the direction of carriage movement.

When adjustment pixel allocation setting is carried out by the adjustment pixel number setting unit 108 in accordance with the direction of carriage movement, the print data generating unit 103 performs rasterizing and outputs print data (steps S50, S60). These processes are identical in substance to the processes shown in FIG. 7. Furthermore, these processes are repeated until processing of all raster lines has been completed (step S70). The structure of the print data in this embodiment will be explained below.

Figure 21:
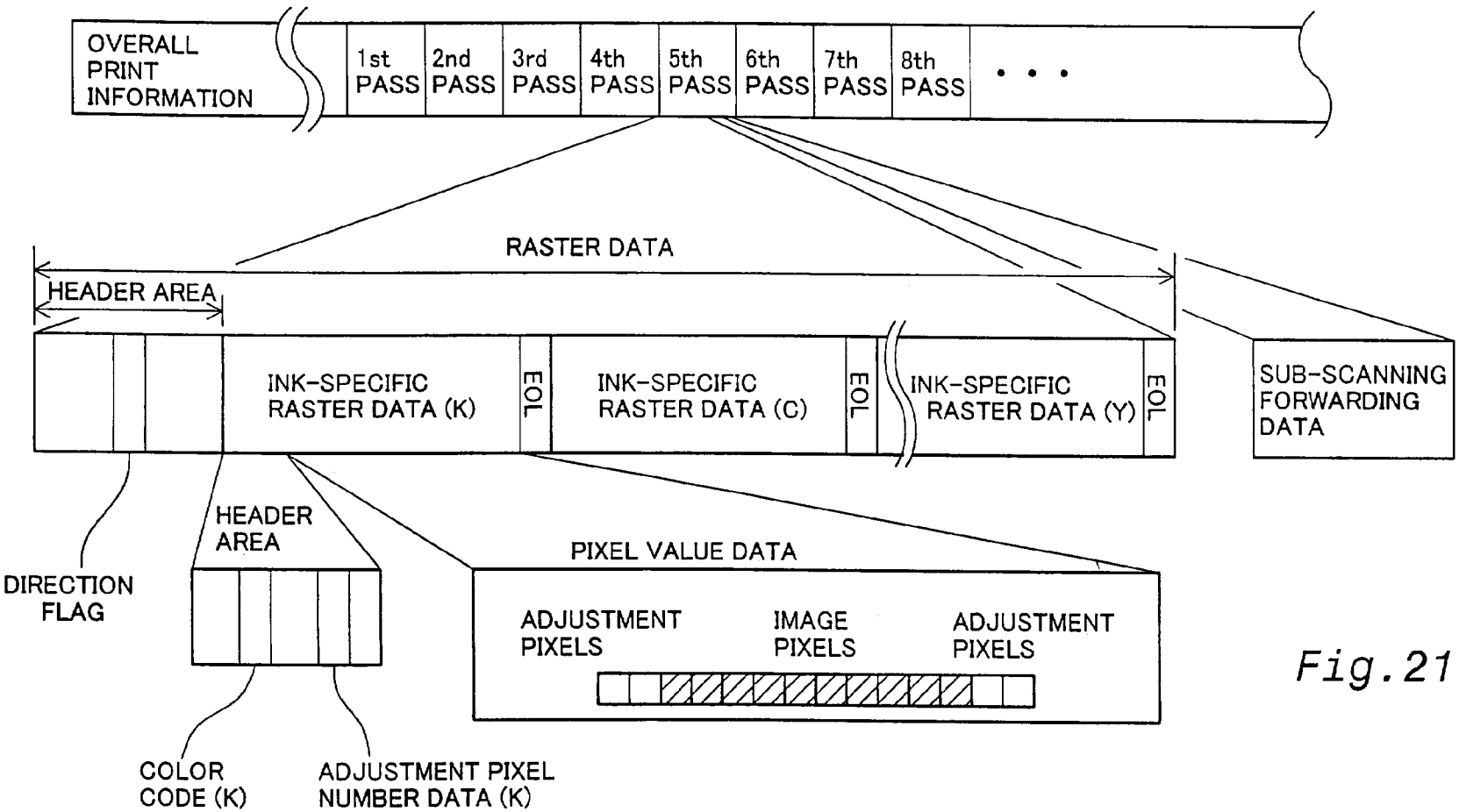
FIG. 21 is a drawing showing the contents of the print data.

FIG. 21 is a drawing explaining the contents of the print data in this embodiment. The print data header contains the general printing information, in which is stored information such as the head nozzle pitch, the image resolution, and the size of the buffer required in the printer PRT. After the header is provided the raster data for each pass (either forward movement or reverse movement during main scanning) and the sub-scan feed data.

A header area is contained at the beginning of each raster data block. In this header area is stored a direction flag that indicates whether the raster data is to be used for forward main scanning or reverse main scanning. The printer PRT forms dots during forward or reverse main scanning based on this directional data. After the header area, each data block contains ink-specific raster data in the order of black, cyan, magenta and yellow, which comprises dot formation information pertaining to each ink color. Header areas are also located at the beginning of each ink-specific raster data block, as shown in the middle and bottom parts of FIG. 21. Stored in this ink-specific raster data block header area are a color code indicating the ink color and adjustment number data (adjustment pixel placement data) indicating the allocation of adjustment pixels to be used for each color. After the header area, each ink-specific raster data block contains pixel value data for each nozzle. This pixel value data has image pixel data and adjustment pixel data for each nozzle (see FIGS. 11 and 20). This image pixel data indicates the status of dot formation at the image pixels constituting the image to be printed. The adjustment pixel data indicates the existence of adjustment pixels that are used to adjust the positions of image pixels in the main scanning direction and in which dots are not formed. This adjustment pixel data is placed at least one of the sides of the image pixel data and has the same format as the image pixel data. Correction based on pixel shifting is performed to the image pixel data and the adjustment pixel data for each nozzle, as shown in FIG. 11. In other words, the number of adjustment pixels to be placed is set so that the misalignment of dot formation positions in the main scanning direction for both forward and reverse movement is reduced. However, the allocation of adjustment pixels is common to all nozzles for the ink of the same color.

In this specification, the term 'raster data' means in a narrow sense the entire dot formation information pertaining to the nozzles for all ink colors during each pass (see the middle part of FIG. 21), but in a wider sense can mean ink-specific raster data comprising dot formation information regarding one pass for one type of ink, or dot formation information regarding one pass by one nozzle.

Using the configuration described above, dot misalignment is corrected for bi-directional printing, enabling image quality to be improved. Bi-directional printing offers the advantage of a higher print speed, and is becoming increasingly widely used. On the other hand, bi-directional printing is easily affected by such phenomena as backlash of the mechanism that performs main scanning, and dot formation position misalignment in the main scanning direction can easily occur. Using the printing apparatus of this embodiment, because such misalignment is easily corrected, image quality during bi-directional printing is significantly improved and high-speed, high-quality printing is achieved.

In this embodiment, an example is used in which misalignment is corrected for each ink. However, misalignment may also be corrected for each nozzle row, or for each nozzle. As shown in FIG. 4, inks of each color may be respectively ejected from a plurality of nozzle rows. Therefore, in such a case, if misalignment is corrected for each nozzle row, more precise dot formation position misalignment correction will be carried out. If misalignment is corrected for each nozzle, dot formation position misalignment correction will be carried out with even greater precision, in accordance with the characteristic of each nozzle.

(4-2) Execution of Printing and Modification of Print Data

In this embodiment, when, because printing is suspended for some reason, the print data originally made for the reverse main scanning is to be used for printing during forward scanning, and when the print data originally made for the forward scanning is to be used for printing during reverse scanning, printing is executed after the print data is modified in the printing apparatus.

The situation in which the direction of the pass performed by the printer PRT is the opposite of the direction indicated by the direction flag in the raster data to be used will now be explained. Normally, print data is prepared such that the direction of the direction flag in the first raster data block in the print data matches the direction of the first pass of the printer PRT. As a result, the direction of the subsequent raster data direction flag normally matches the direction of the next planned pass to be performed by the printer PRT. However, where the following situation occurs, the directions are reversed. For example, where a prescribed event requiring the termination of printing occurs, for a reason such that the cartridge has run out of ink, or the time for regular flushing has arrived, the control circuit 40 of the printer PRT stops printing at the moment that the current pass is completed. The head is then moved to the standby position. The head standby position is located at one end of the movement range of the carriage 31. Therefore, where the head is located at the non-standby position side of the carriage movement range at the moment printing stops, the head is returned toward the standby position. Scanning in which the head moves from the standby position to the printing paper is forward movement (i.e., an odd-numbered pass), while scanning in which the head moves from the printing paper to the standby position is reverse movement (i.e., an even-numbered pass).

While printing is suspended, the printing apparatus PRT automatically carries out prescribed flushing, or the user changes an ink cartridge, or other prescribed processes are carried out. When printing is subsequently resumed, the head of the printer PRT resumes scanning for printing, beginning with main scanning in which the head moves from the standby position to the printing paper (forward movement). Therefore, if the next planned main scanning immediately before printing is stopped is forward scanning, the planned pass direction for the next scanning to be performed immediately after printing is resumed by the printer PRT matches the direction indicated by the direction flag in the raster data to be used next. However, if the next planned main scanning immediately before printing is stopped is reverse scanning, the planned direction for the next pass to be performed immediately after printing is resumed by the printer PRT is the opposite of the direction indicated by the direction flag in the raster data.

Figure 22:
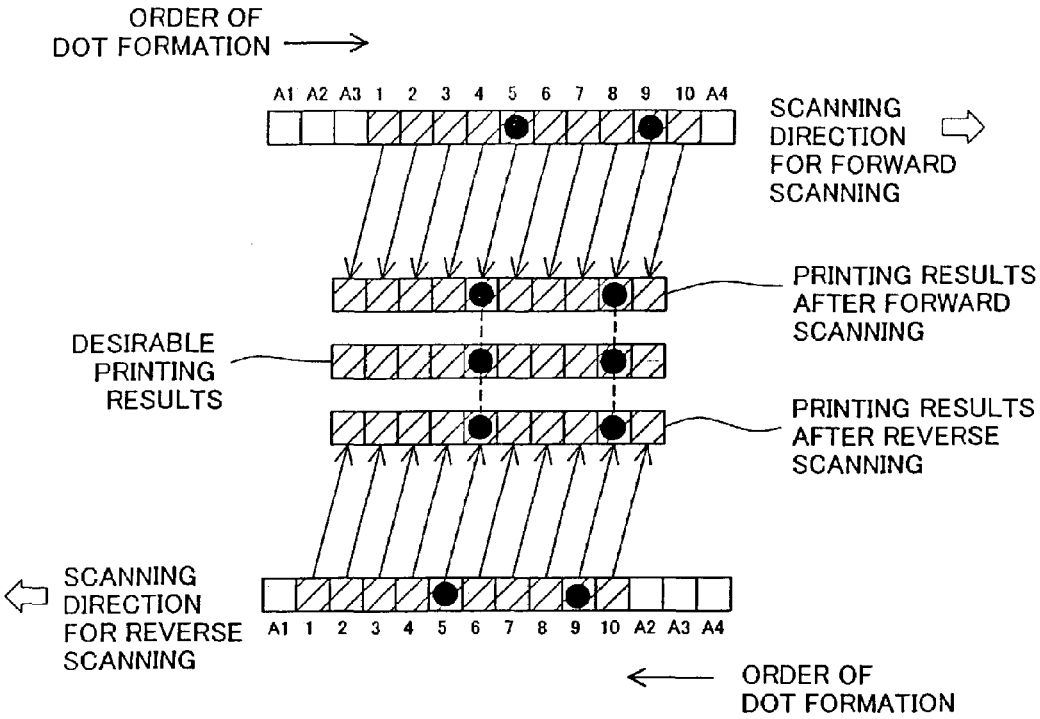
FIG. 22 is a drawing showing the results of printing where the corrected pixel value data is used in the planned direction.

FIG. 22 is a drawing showing the printing results where corrected pixel value data is used in the planned direction. For certain nozzles, where the timing for ink drop expulsion is slightly earlier than estimated, or where the ink expulsion speed is slightly faster than estimated, the position at which the ink drop hits the paper is offset relative to that specified in the raster data in the direction opposite the main scanning direction. FIG. 22 shows a case in which the dot formation position misalignment is essentially equivalent to approximately one pixel. In this case, by reducing by one the number of adjustment pixels at the front of the image pixels in terms of the scanning direction, and by increasing by one the number of adjustment pixels located at the end, the image pixels are shifted forward by one pixel in the scanning direction, and ink drops is placed close to the planned positions. In other words, the pixel value data in the raster data to be used in forward scanning is corrected by subtracting one pixel from the adjustment pixels at the right side in FIG. 22 and adding one pixel to the adjustment pixels at the left side, as shown in the top part of FIG. 22. Because the raster data is used in sequence from the left during forward scanning, this type of correction delaye the timing of ink drop expulsion by an amount equivalent to one pixel. Therefore, the printing results during forward scanning become close to the 'Desirable Printing Results' shown in the middle part of FIG. 22. On the other hand, the pixel value data in the raster data to be used in reverse scanning is corrected by subtracting one pixel from the adjustment pixels on the left side in FIG. 22 and adding one pixel to the adjustment pixels on the right side, as shown in the bottom part of FIG. 22. Because the raster data is used in sequence from the right during reverse scanning, this type of correction delays the timing of ink drop expulsion by an amount equivalent to one pixel. Therefore, the printing results during forward scanning become close to the 'Desirable Printing Results' shown in the middle part of FIG. 22. By correcting pixel value data for both forward scanning and reverse scanning in this way, the misalignment between the dots formed during forward scanning and the dots formed during reverse scanning is reduced.

Figure 23:
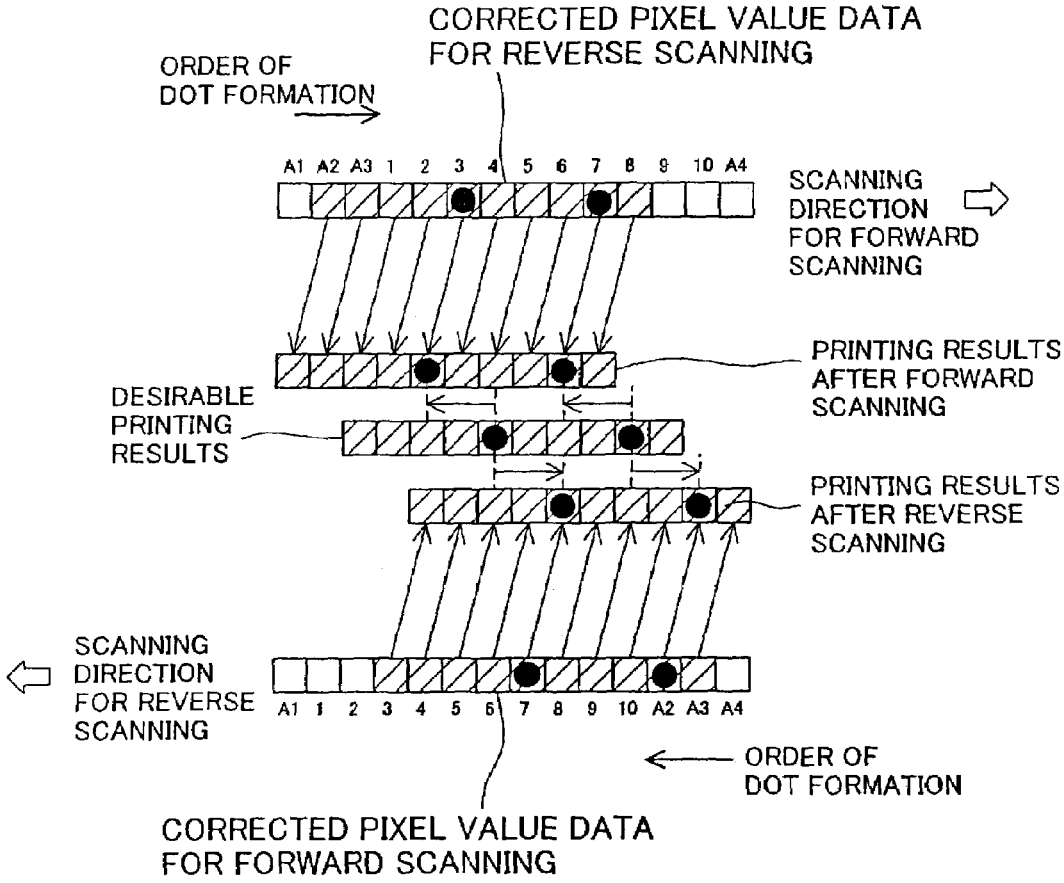
FIG. 23 is a drawing showing the results of printing where the corrected pixel value data is used in the direction opposite from the planned direction.

FIG. 23 is a drawing showing the printing results where the corrected pixel value data is used in a direction opposite the planned direction. When pixel value data that is originally corrected for reverse scanning (in which the head moves in the direction opposite from that used during forward scanning) is used during forward scanning, the dot formation position misalignment amount increases from one pixel to two pixels, as shown in the top part of FIG. 23. The dot formation position misalignment amount also increases when pixel value data that is originally corrected for forward scanning (in which the head moves in the direction opposite from that used during reverse scanning) is used during reverse scanning, as shown in the bottom part of FIG. 23. As a result, an aggregate dot misalignment of four pixels results between the forward and reverse directions. This is due to the fact that the direction of correction is different for forward and reverse movement, and the numbers of adjustment pixels allocated to the left and right are reversed. Therefore, when raster data that is originally corrected for reverse scanning is used during forward scanning, and when raster data that is originally corrected for forward scanning is used during reverse scanning, the numbers of adjustment pixels on the left and right that sandwich the image pixels must be reversed. This explanation involves a case in which the dot formation position is misaligned by one pixel in the direction opposite the scanning direction, but the present principle also applies in cases in which the amount of misalignment is different, or in which the dot formation position is misaligned in the scanning direction.

Figure 24:
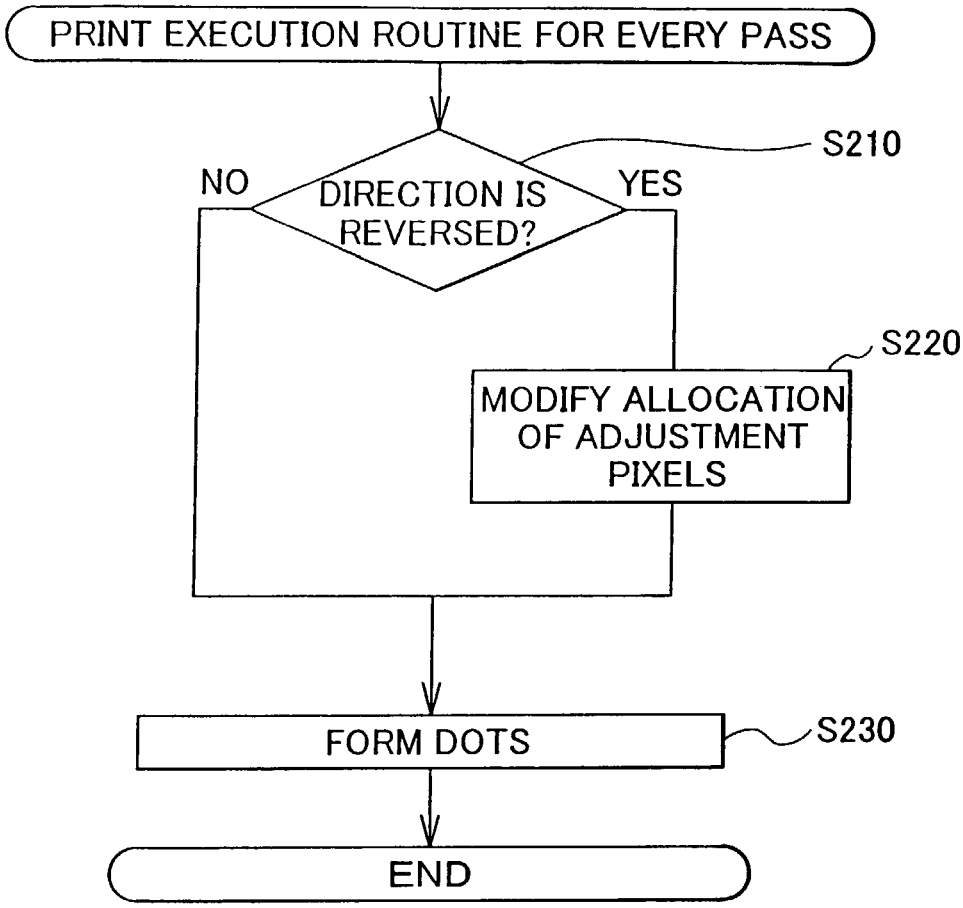
FIG. 24 is a flow chart showing the print execution routine when printing is performed using raster line data for one pass sent to the development buffer 44.

FIG. 24 is a flow chart showing the printing execution routine when printing is performed using raster data for one pass sent to the development buffer 44 (see FIG. 2). When raster data for one pass (see the middle part of FIG. 21, FIG. 2) is sent from the receiving buffer 115 to the development buffer 44, the control circuit 40 of the printer PRT compares the direction of the next scheduled pass with the direction indicated by the direction flag in the raster data (step S210). Where the direction of the pass to be performed by the printer PRT matches the direction of the direction flag, the control circuit 40 of the printer PRT carries out main scanning in accordance with the raster data, and forms dots (step S230). On the other hand, if for some reason the direction of the pass to be performed by the printer PRT does not match the direction of the direction flag, the pixel value data modification unit 120 belonging to the CPU 41 included in the control circuit 40 (see FIGS. 2, 3) modifies the allocation of the adjustment pixels in the print data (step S220). This pixel value data modification unit 120 corresponds to the pass reversal detecting unit and the raster data reconstruction unit in the claimed invention. Specifically, the functions performed by the pixel value data modification unit 120 are achieved through the use of the development buffer 44 by the CPU 41 of the control circuit 40.

Figure 25:
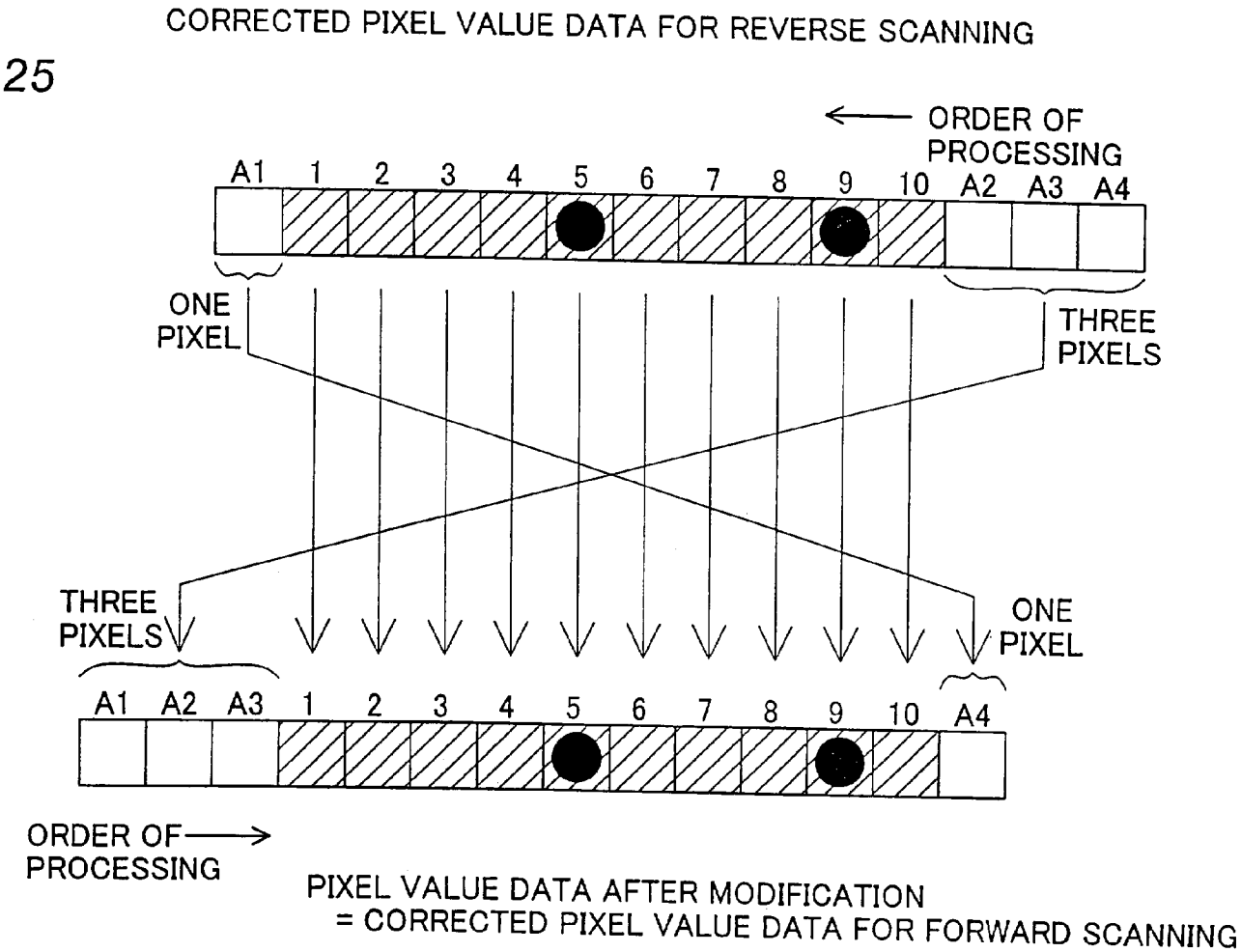
FIG. 25 is a drawing showing the revision of the pixel value data carried out so that the pixel value data corrected for reverse scanning pass may be used during forward scanning pass.

FIG. 25 is a drawing showing the nature of the modification of the pixel value data performed so that pixel value data corrected for reverse scanning is used during forward scanning. The pixel value data modification unit 120 (see FIG. 2) modifies the allocation of adjustment pixels in the print data such that they trade places on either side of the image pixels. In FIG. 25, the shaded squares are image pixels, and the blank squares are adjustment pixels. The control unit 40 treats both the image pixels and the adjustment pixels as simply pixels indifferently. However, the adjustment pixels are specified based on the adjustment pixel number data stored in the header area of the ink-specific raster data, and the process described below is executed thereto.

In FIG. 25, pre-modification pixel value data that has been corrected for reverse scanning has three adjustment pixels allocated to the right and one adjustment pixel allocated to the left. The pixel value data modification unit 120 modifies the data to be suitable for the forward scanning such that one adjustment pixel is allocated to the right and three adjustment pixels are allocated to the left. As a result, the post-modification pixel raster data matches the pixel value data corrected for forward scanning (see the top part of FIG. 22). After the allocation of the adjustment pixels in the pixel value data is modified in this fashion (step S220), the control circuit 40 forms dots in accordance with the modified pixel value data (step S230).

As described above, pixel value data is modified in this embodiment where, due to a termination of printing, the direction indicated in the raster data becomes the opposite of the direction of scanning when the raster data is printed. Therefore, dot formation position misalignment occurring when the directions of misalignment in forward and reverse scanning are opposed can be properly corrected. This dot formation position misalignment also occurs when the ink drop expulsion timing or the expulsion speed for each nozzle is different from the estimated value. Dot position misalignment can also arise due to a difference in ink expulsion speeds caused by a difference in the viscosity of the various inks.

Each block of raster data has directional data. Therefore, it may be determined based on this directional data whether the 'next pass scheduled to be performed before printing was stopped' is forward scanning or reverse scanning. Even where printing is stopped several times while one page is being printed, and the relationship between the raster data and the scanning direction changes several times, the next scheduled scanning to be actually performed can be compared with the directional data, and the raster data can be appropriately modified if necessary.

(4-3) Variation of First Embodiment

The present embodiment is not limited to the embodiment described above, and may be implemented in any form within the essential scope thereof. For example, the variation described below may be adopted.

In the above embodiment, for example, the direction of the pass scheduled to be made next is compared with the direction indicated by the direction flag in the raster data each time printing is performed. However, the present invention is not limited to this implementation. Dots may be formed without comparing the direction of the next scheduled pass with the direction indicated in the direction flag in the raster data printing stops due to the occurrence of a prescribed event, and by carrying out such comparison for each scanning only after printing is stopped due to the occurrence of a prescribed event. This method enables processing to be simplified in the event printing is not terminated.

Furthermore, in the embodiment described above, the standby position is located at one end of the movement range of the carriage 31, and the scanning in which the head moved from the standby position to the printing paper is fixed as forward scanning. Therefore, where the 'next pass scheduled to be performed before printing was stopped' is reverse scanning, the print data is modified. However, where the head can be stopped at either end of the movement range of the carriage 31 when printing is stopped, the pass to be performed when printing is resumed may be forward scanning or reverse scanning. Consequently, in such a case, the 'next pass scheduled to be performed before printing was stopped' and the 'next pass scheduled to be performed after printing is resumed' are compared, and where the scanning directions of the two passes (forward scanning, reverse scanning) do not match, the data must be modified (see FIG. 24).

Figure 26:
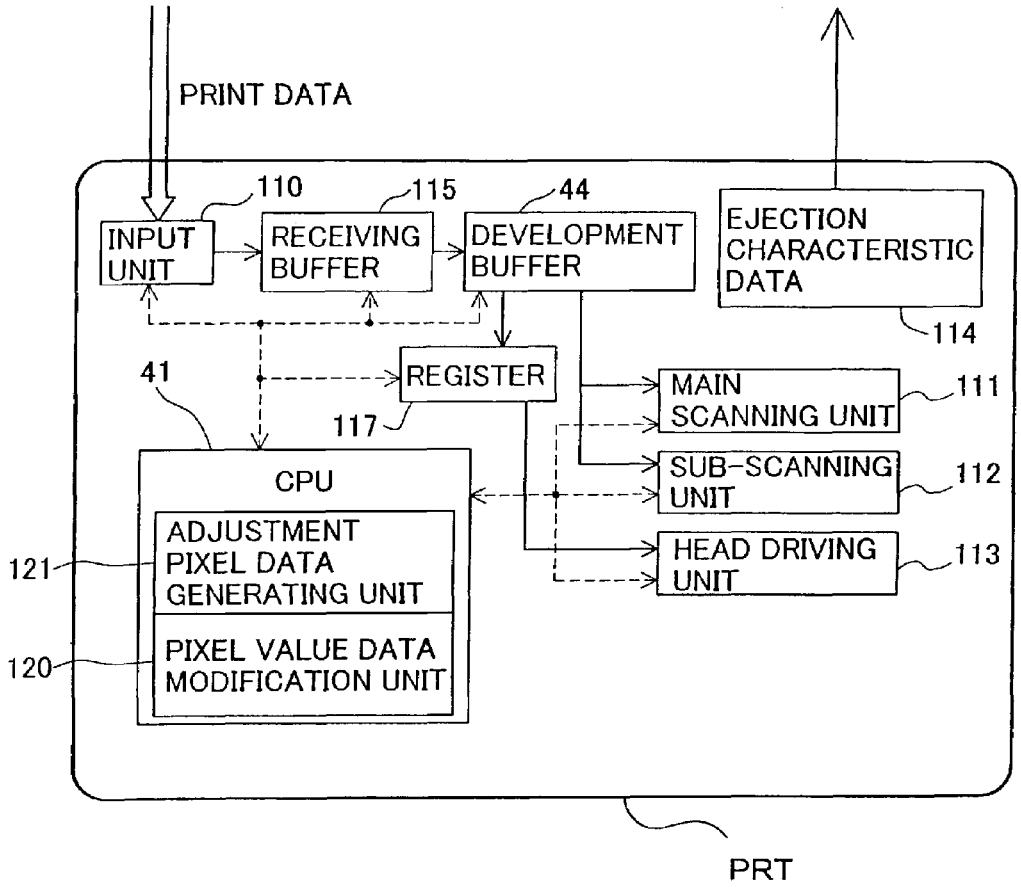
FIG. 26 is a drawing showing a variation of the printer of the first embodiment.

FIG. 26 is a drawing showing the printer in a variation of the first embodiment. In the above embodiment, adjustment pixel data indicating the adjustment pixels is generated in the print data generating unit 103 of the printer driver 96, and this data is sent to the printer PRT together with the image pixel data. However, it is also acceptable if only adjustment number data is generated by the printer driver 96 and adjustment pixel data is not generated, and adjustment pixel data (see FIG. 6, FIG. 20) is generated in the printer PRT based on the adjustment pixel allocation indicated by the adjustment number data. In such an implementation, the CPU 41 functions as the adjustment pixel data generating unit 121 (see FIG. 26), and adjustment pixel data is added to the dot formation information for one pass in the development buffer 44.

In the above embodiment, the adjustment number data is contained in each block of ink-specific raster data (see FIG. 21), but it is acceptable if the adjustment number data is stored in the general print information (see FIG. 21). For example, where the placement of adjustment pixels varies for each ink color, the ink-specific adjustment number data may be stored in the general print information.

(5) Second Embodiment

Figure 27:
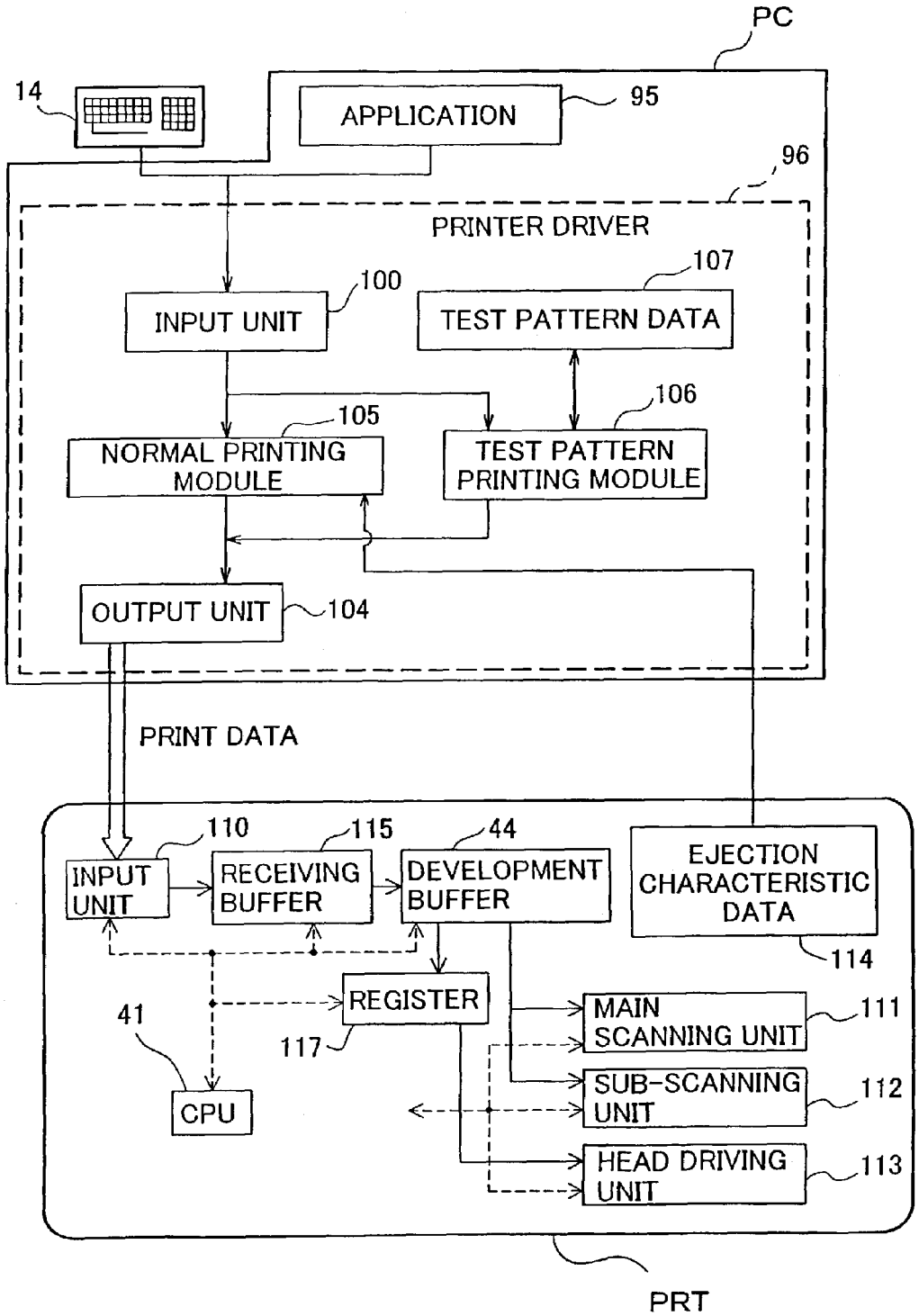
FIG. 27 is a drawing showing the configuration of the function blocks of the second embodiment.

FIG. 27 is a drawing showing the configuration of the function blocks of a second embodiment. In the second embodiment, the printer driver 96 contains function blocks of, in addition to the input unit 100 and the output unit 104, a normal printing module 105, a test pattern printing module 106, and a test pattern memory unit 107. The configuration of the printer PRT is the same as that described above with reference to FIG. 2.

The normal printing module 105 is a comprehensive function block representing the color correction processor 101, the color correction table LUT, the halftone processor 102, the print data generating unit 103, and the adjustment data allocation table AT. The test pattern printing module 106 prints test patterns based on test patterns stored beforehand in the test pattern memory unit 107. Therefore, the second embodiment effectively adds the new function of printing test patterns to the functions included in the above explanation of the principle of the present invention.

The printer driver 96 receives commands from the keyboard 14 and also receives print instructions and other instructions from the application 95 via the input unit 100. When a print instruction is supplied from the application program 95, the printer driver 96 receives image data from the application program and converts it using the normal printing module 105 into signals that may be processed by the printer PRT. The details of this processing are the same as described in the above explanation of the principle of the present invention.

Figure 28:
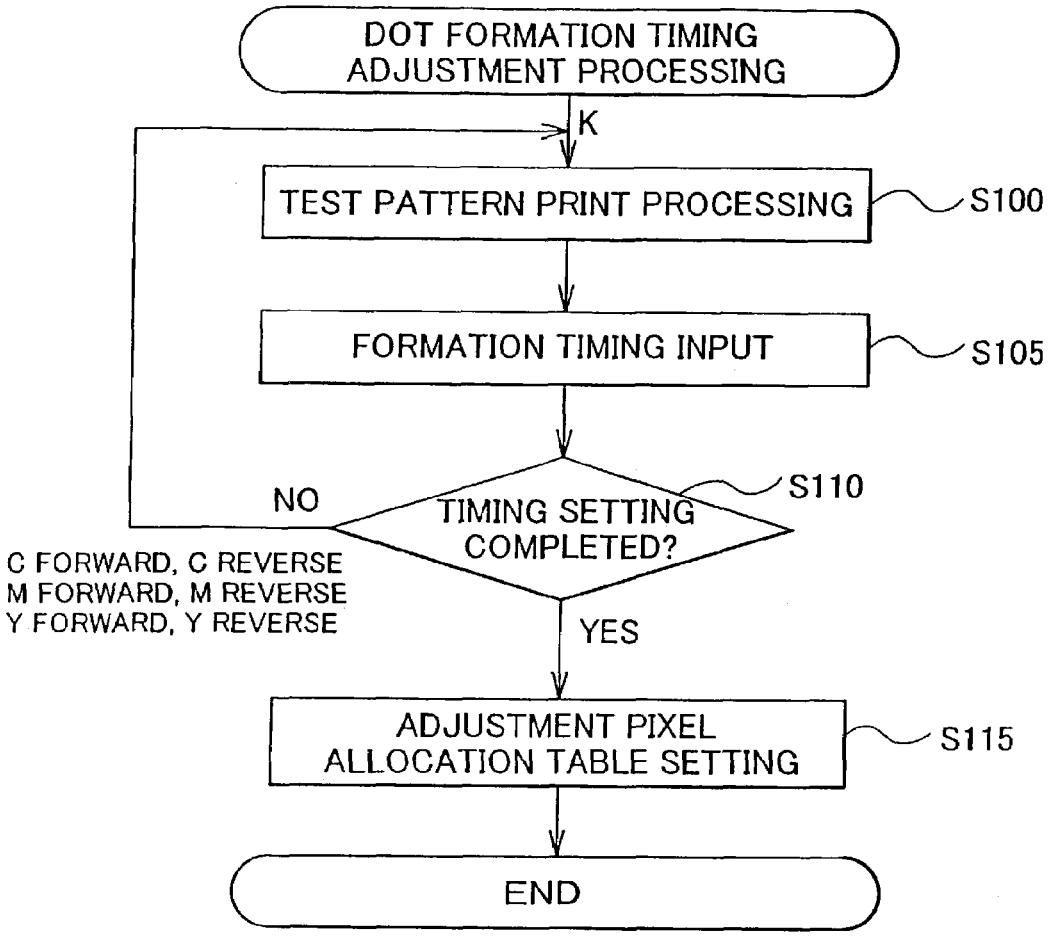
FIG. 28 is a flow chart of a dot formation timing adjustment process.

One of the processes executed by the printer driver 96 in response to an instruction from the keyboard 14 is a process to adjust the timing of dot formation by the printer PRT. When an instruction to execute this dot formation timing adjustment process is issued, the printer driver 96 prints via the test pattern printing module 106 test patterns based on the test pattern data stored beforehand in the test pattern data memory unit 107. The data used for the printing of the test patterns is output to the printer PRT from the output unit 104. The printer PRT receives this data and prints prescribed test patterns.

Where dot formation timing adjustment is performed, the user specifies the optimal print timing using the keyboard 14 based on the results of the printed test patterns. The printer driver 96 inputs the print timing instruction via the input unit 100. In addition, it also performs the setting of adjustment allocation data (see FIG. 2) in accordance with the input timing. It is also acceptable if the input timing is forwarded to the printer PRT and the expulsion characteristic data stored in the printer PRT is overwritten. Through these function blocks, the printing apparatus of the second embodiment can, in addition to printing images in which misalignment has been corrected, specify the amount of misalignment correction and adjust dot formation timing based on the test patterns. An explanation will be provided below for the process to adjust dot formation timings for each color in a bi-directional printing apparatus. FIG. 28 is a flow chart of the dot formation timing adjustment process. This process is executed by the CPU of the computer PC. In other words, the CPU of the computer PC corresponds to the misalignment amount setting unit in the claimed invention.

When this process is begun, the CPU first adjusts the dot formation timing for black (K) dots. In this process, first, test patterns for K are printed (step S100). The test pattern data is stored beforehand as test pattern data in the test pattern data memory unit 107. When the data used to print the test patterns is output to the printer PRT, prescribed test patterns are printed.

Figure 29:
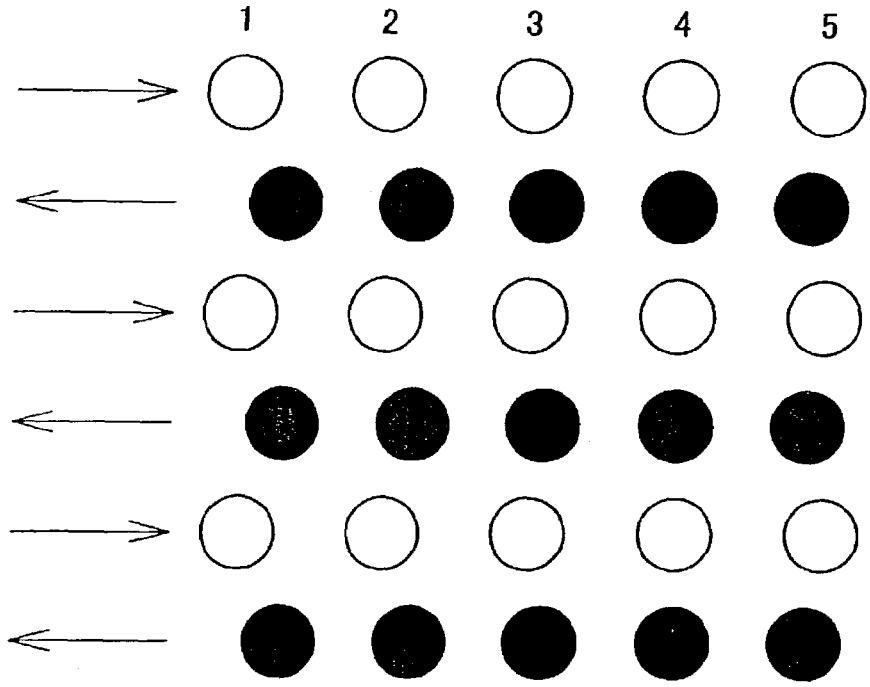
FIG. 29 is a drawing showing an example of test patterns.

FIG. 29 is a drawing showing an example of the test patterns. The open circles indicate dots formed during forward scanning, while the solid circles indicate dots formed during reverse scanning. The test patterns are recorded while the dot formation timing for reverse scanning is changed in one through five increments, respectively, as indicated by the numbers 1 through 5. The changing of the dot formation timing is carried out by shifting the image data for the test pattern in either main scanning direction in pixel-width increments. The patterns shown in FIG. 29 are the result of shifting the positions of the dots recorded during reverse scanning to the right or left relative to the positions of the dots recorded during forward scanning.

The user of the printer PRT compares the printed test patterns, and selects the pattern in which the optimal images are recorded. The CPU inputs the specified value for the selected formation timing (step S105). In the example shown in FIG. 29, the dot recording positions match at the timing indicated by the number '4', and therefore '4' is input as the formation timing. The input data is then stored as a timing table.

The CPU next determines whether or not formation timing setting is completed (step S110). In this embodiment, formation timing is adjusted not only for black, but for all colors, including cyan, magenta and yellow. Because formation timing adjustment has been done for only black at this point, the CPU determines that formation timing adjustment has not been completed, and proceeds to adjust the formation timing for cyan.

Figure 30:
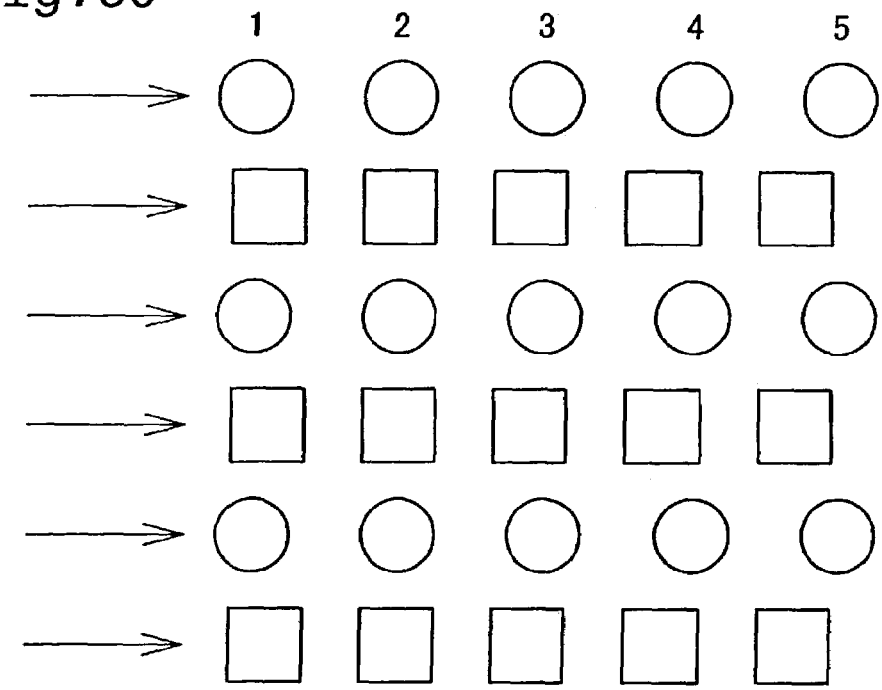
FIG. 30 is a drawing showing test patterns used to adjust the positional relationship between black and cyan.

The formation timing adjustment for cyan is carried out using the same method that was used for black. First, the CPU prints prescribed test patterns (step S100). Here, the formation timing for cyan is adjusted using black as a reference. FIG. 30 is a drawing showing test patterns used to adjust the relative positions of black and cyan. The dots indicated by circles in the drawing represent dots formed during forward scanning for black. The dots indicated by squares in the drawing represent dots formed during forward scanning for cyan. As with the test patterns shown in FIG. 29, the cyan dots are formed while the test pattern image data is incrementally shifted in either main scanning direction in pixel-width increments.

By specifying the optimal formation timing based on the test patterns, the formation timing for forward scanning for cyan may be matched with the formation timing for forward scanning for black. The user of the printer PRT specifies the best formation timing, as with black. The CPU inputs the specified timing (step S105) and stores it in a timing table. In the example shown in FIG. 30, the dot recording positions for cyan and black match at the timing indicated by the number '2', and therefore '2' is input as the formation timing.

The CPU then carries out formation timing adjustment for reverse scanning for cyan. The CPU forms the square dots in FIG. 30 as test patterns during reverse scanning for cyan. Furthermore, formation timing adjustment for magenta and yellow is also carried out separately for forward and reverse scanning. After formation timing adjustment for each color is completed (step S110), an adjustment pixel allocation table is created based on the respective stored formation timings (step S115). The timings for each color and direction are equivalent to the respective dot formation position misalignments expressed in pixel units. In other words, they are equivalent to the expulsion characteristic data described above during the explanation of the principle of the present invention. The method for creating an adjustment pixel allocation table based on this data is identical to the method explained above (see FIG. 11).

Using the printing apparatus of the second embodiment explained above, the user can relatively easily revise the stored dot formation position misalignment amount even where the misalignment occurs after shipment. As a result, high-quality printing is maintained relatively easily, and the ease of use of the printing apparatus will be improved.

The formation timing adjustment method described above is only one example, and the optimal timing may be achieved by repeating the formation timing input and the test pattern printing based on the input formation timing. It is also acceptable if the functions of the computer PC, the printer driver 96 and the input unit 100 are included in the printer PRT, such that the printer PRT can carry out dot formation timing adjustment on its own.

A different formation timing adjust method is shown in FIG. 31 as a variation of the second embodiment. FIG. 31 is a drawing showing the relationships between the color used as a reference for the matching of formation timing and the colors for which the timing is to be adjusted. In the second embodiment, as shown in the drawing, K dots during forward scanning are used as the reference for formation timing adjustment for K dots during reverse scanning, cyan dots during forward and reverse scanning, magenta dots during forward and reverse scanning, and yellow dots during forward and reverse scanning. In this case, a total of seven sets of test patterns are printed.

By contrast, in a first variation, K dots during forward scanning are used as the reference for formation timing adjustment for all colors and directions except for yellow. In this case, it is acceptable if the formation timing for yellow is set to be identical to that for K, or if it is fixed at a pre-set reference timing. In this arrangement, the number of test patterns that are printed can be reduced, and the time required to adjust formation timing can be reduced accordingly. Because dot formation position misalignment for yellow is difficult to perceive, it has little impact on image quality. Therefore, even if formation timing adjustment is omitted for yellow, image quality does not suffer substantially.

Naturally, formation timing adjustment may be omitted for other colors than yellow so long as there is little effect on image quality. In this embodiment, the printer PRT has four colors of ink. However, in a printer having the additional colors of light cyan and light magenta, making a total of six ink colors, formation timing adjustment may be omitted for these two light-colored inks as well.

As shown with regard to 'Variation 2' in FIG. 31, it is also acceptable if dot formation timing adjustment is carried out separately for each color. In other words, using the same method by which K is adjusted for reverse scanning using K during forward scanning as a reference, the formation timings for reverse scanning for C, M and Y are adjusted using the forward scanning timings for C, M and Y as references, respectively. If formation timing adjustment is performed using this method in a printer in which formation timing misalignment between colors occurs rarely, dot formation timing adjustment is carried out easily, and image quality will be improved.

As shown with regard to 'Variation 3' in FIG. 31, it is also acceptable if dot formation timing adjustment is performed for forward scanning and reverse scanning for K, but if formation timing adjustment between colors is performed only for forward scanning. In this case, the formation timing for forward scanning and reverse scanning for all colors is adjusted uniformly based on the adjustment result for K. Where the dot formation timing misalignment between forward and reverse scanning is thought to be due to reasons that do not involve significant differences between colors, such as backlash or paper thickness, if formation timing is adjusted using this adjustment method, the formation timing for each color is easily adjusted and image quality will be improved.

Naturally, various other formation timing adjustment methods may be incorporated herein. For example, adjustment for yellow may be omitted in 'Variation 2' and 'Variation 3' as well. Alternatively, 'Variation 2' and 'Variation 3' may be implemented together. Furthermore, the user may select the formation timing adjustment method from among the methods described above. Moreover, various types of test patterns may be used.

(6) Third Embodiment

Figure 32:
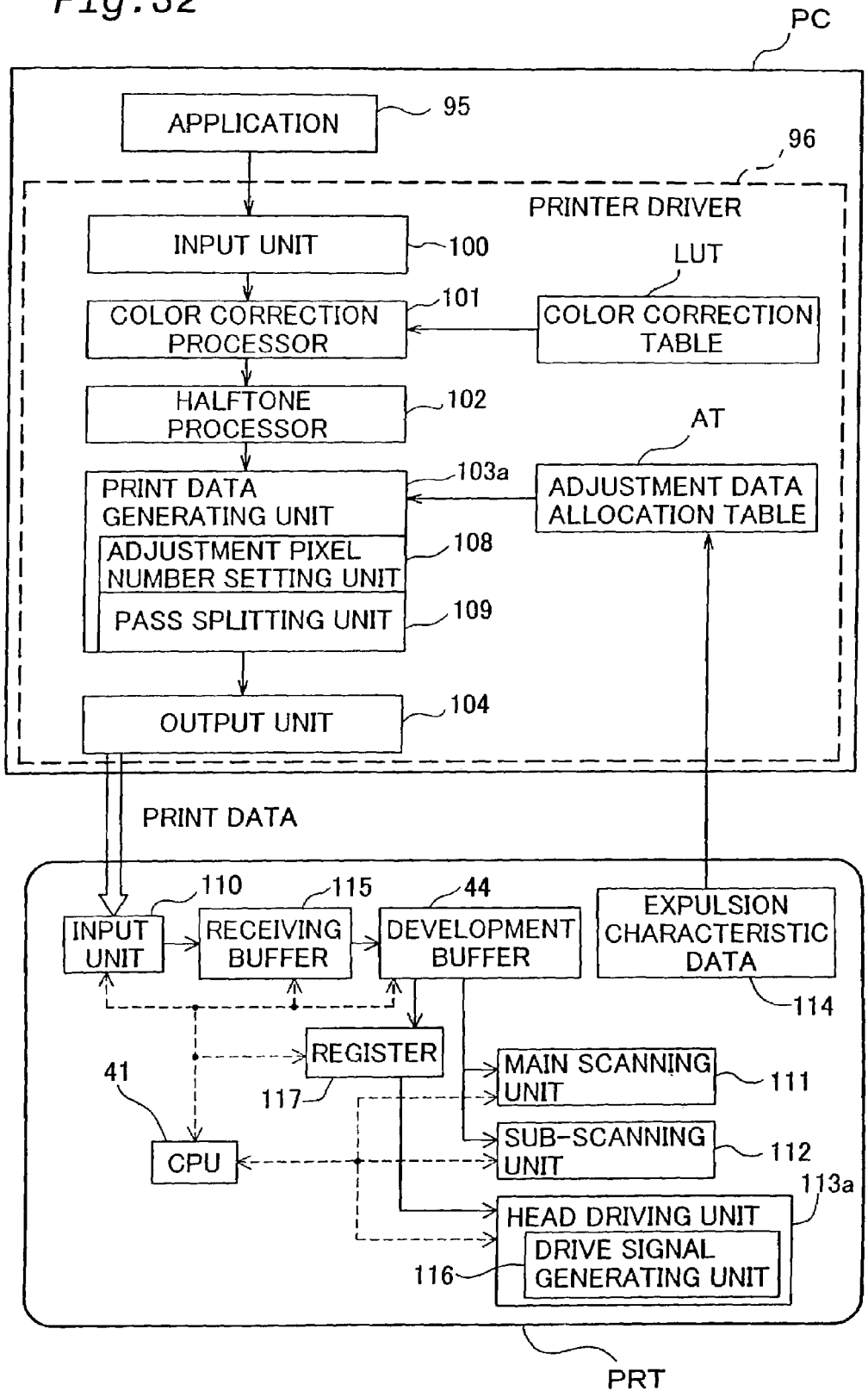
FIG. 32 is a drawing showing the function blocks of the printing apparatus.

FIG. 32 is a drawing showing the function blocks of a printing apparatus. The third embodiment differs from the first embodiment with regard to the head driving unit 113*a* in the printer PRT and the print data generating unit 103*a* in the computer PC. It is identical to the first embodiment regarding other components. The head driving unit 113*a* in the printer PRT has a drive signal generating unit 116. While explanation is omitted in connection with the first embodiment, the head driving unit 113 of the first embodiment also has a drive signal generating unit. However, the drive signal generating unit 116 of the third embodiment is characterized in that it generates drive signals to drive each nozzle based on four base drive signals explained below. The print data generating unit 103*a* has a pass splitting unit 109 that determines which of the base drive signals will be used to record the image pixels in the raster line.

While explanation is omitted in connection with the first embodiment, the above head driving unit 113 in the printer PRT issues base drive signals that repeat the same waveform, and generates drive signals to selectively drive the piezoelectric elements mounted in each nozzle based on the base drive signals, so that ink drops are thereby ejected. Therefore, where the speed of main scanning by the print head 28 is fixed, the density with which the printer PRT can record dots at the pixels depends on how high a frequency is achieved for the base drive signals. However, due to such factors as the mechanical characteristics of the piezoelectric elements, the frequency of the base drive signals cannot be raised beyond a certain level. In the third embodiment, by issuing a plurality of base drive signals with mutually differing phases, dots are recorded with the same high density that could be obtained if the base drive signal were generated at a high frequency equal to several times the actual base drive frequency.

Figure 33:
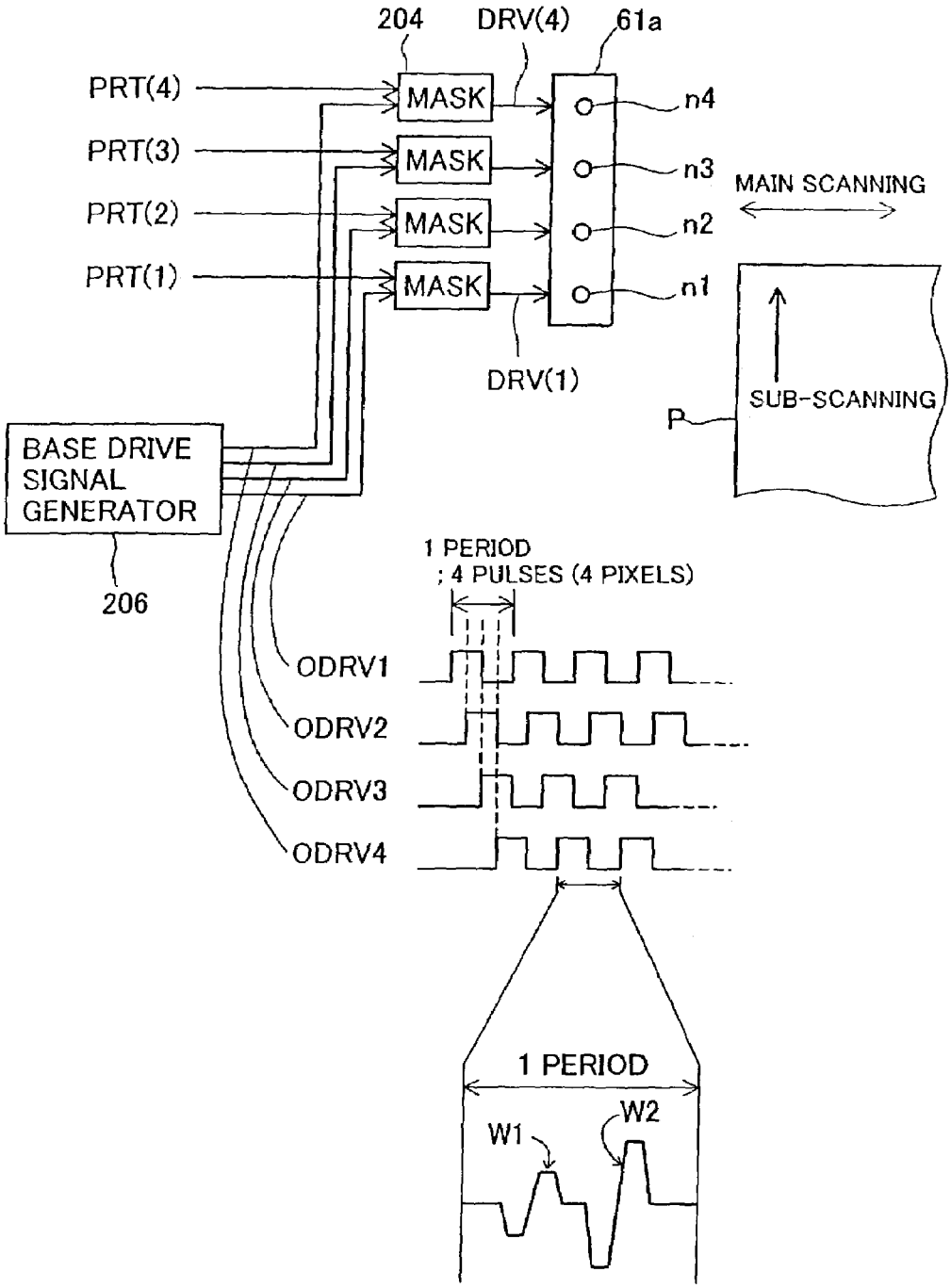
FIG. 33 is a block diagram showing the drive signal generating unit 116 located in the head drive unit 113.

FIG. 33 is a block diagram showing the configuration of the drive signal generating unit 116 located in the head drive unit 113 (see FIG. 2). In actuality, many nozzles are formed in the head, and both uni-directional and bi-directional printing can be performed, but here, the configuration of the drive signal generating unit 116 is explained using the simplest example of four nozzles and uni-directional printing. The drive signal generating unit 116 has multiple mask circuits 204 and a base drive signal generating unit 206. The mask circuits 204 correspond to the multiple piezoelectric elements used to drive the nozzles n1 through n4 respectively in the ink expulsion head 61*a*. In FIG. 33, the number in parentheses that follows the name of each signal indicates the ordinal number of the nozzle to which the signal is supplied. The base drive signal generating unit 206 generates base drive signals ODRV1 through ODRV4 that are supplied to the nozzles n1 through n4, respectively. The phases of these base drive signals are offset from each other by one-quarter of the period, in the order of ODRV1, ODRV2, ODRV3 and ODRV4. Where it is not necessary to differentiate among ODRV1, ODRV2, ODRV3 and ODRV4 in the explanation of the base drive signals below, they will be generally referred to as simply 'ODRV'. In addition, in the drawing, the waveform for one period of a base drive signal is indicated by a single rectangular wave, but in actuality, the waveform is complex due to such factors as the characteristics of the piezoelectric elements, as shown at the lower right of FIG. 33. The waveform for one period that includes pulses W1 and W2 is a waveform for one period to record one pixel.

As shown in FIG. 33, the serial print signal PRT(i) is input to the mask circuit 204 together with the base drive signal ODRV output from the base drive signal generating unit 206. The mask circuit 204 is a gate to mask all or part of the base drive signal ODRV in accordance with the serial print signal PRT(i). In other words, when the serial print signal PRT(i) at is level 1 in a certain zone, the mask circuit 204 allows the corresponding portion of the base drive signal ODRV (pulse W1 or W2) to pass through unchanged, and supplies it to the piezoelectric element as a drive signal DRV. On the other hand, when the serial print signal PRT(i) is at level 0 in another zone, the mask circuit 204 intercepts the corresponding portion of the base drive signal ODRV (pulse W1 or W2).

The base drive signals ODRV1 through ODRV4 are waveforms of one period to record one pixel. However, because they are generated such that their phases are mutually offset by one-quarter of the period, if dots are continuously formed using the base drive signals ODRV1 through ODRV4, four pixels can be recorded in the space of one period of a base drive signal. Therefore, if the base drive signals ODRV1 through ODRV4 are assigned to adjacent pixels in one raster line and dots are formed accordingly, a dot recording density is four times the density that is obtained when only one base drive signal ODRV is used. It is assumed here for the sake of simplicity that there are four nozzles and that each base drive waveform is supplied to only one nozzle. However, in actuality the head has many nozzles, and the base drive waveforms ODRV1 through ODRV4 are each supplied to the piezoelectric elements for a plurality of nozzles.

Figure 34:
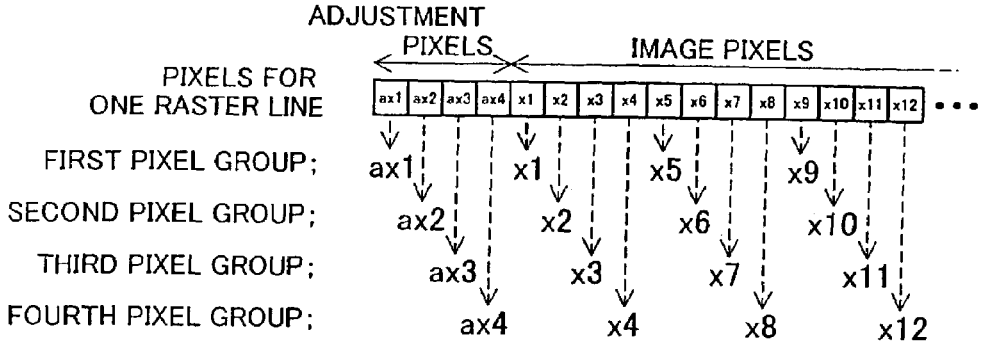
FIG. 34 is a drawing showing the manner in which the pass division unit 109 divides the pixels in the first raster line into pixel groups.

FIG. 34 is a drawing showing the manner in which the pass splitting unit 109 (see FIG. 32) divides the pixels in one raster line into groups. The pass splitting unit 109 divides the pixels in the raster line into first through fourth pixel groups based on the base drive signal used to record the pixel. Because each base drive signal is supplied to only one nozzle, the pixels in each raster line are divided into first through fourth pixel groups based on the nozzle used for recording the pixel. FIG. 34 shows a case in which there are four adjustment pixels prior to the image pixels x1, x2, . . . These adjustment pixels ax1 through ax4 and the image pixels x1, x2, . . . are classified, starting from the first pixel, into the first pixel group, second pixel group, third pixel group, and fourth pixel group, irrespective of whether the pixels are image pixels or adjustment pixels. In other words, in a raster line, the jth pixel from the beginning (j being a natural number) is allocated to the first pixel group where the remainder obtained by dividing j by four is one, and is allocated to the second pixel group where the remainder is two. Similarly, the pixel is allocated to the third pixel group where the remainder is three, and is allocated to the fourth pixel group where j is evenly divisible by four. This allocation method is the same regardless of whether the subject pixel is an image pixel or an adjustment pixel. As shown in FIG. 34, the result of the allocation is that the pixels ax1, x1, x5, x9 and so on belong to the first pixel group, while the pixels ax2, x2, x6, x10 and so on belong to the second pixel group. The pixels belonging to the third pixel group and the fourth pixel group are also shown in the drawing.

Assume that each nozzle arrives at a specific raster line in the order of nozzle n1, n2, n3 and n4 (see FIG. 33) under the sub-scanning forwarding in this example. The first main scanning to record a specific raster line is carried out by the nozzle n1, and the second main scanning is carried out by the nozzle n2. Similarly, the third main scanning to record the specific raster line is carried out by the nozzle n3, and the fourth main scanning is carried out by the nozzle n4. Because a specific base drive signal ODRV1 through ODRV4 is supplied to each nozzle, the first pixel group is recorded based on the base drive signal ODRV1, while the second pixel group is recorded based on the base drive signal ODRV2. Similarly, the third pixel group is recorded based on the base drive signal ODRV3, while the fourth pixel group is recorded based on the base drive signal ODRV4.

Figure 35:
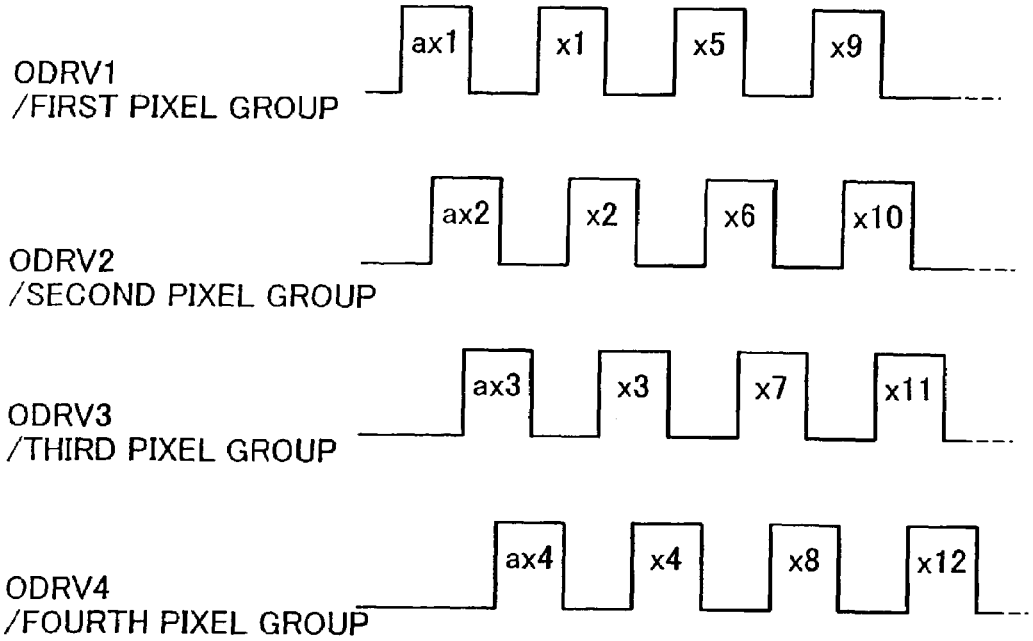
FIG. 35 is a drawing showing the period of each base drive signal waveform to which each pixel corresponds.
Figure 36A:
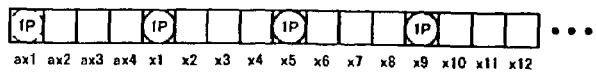
FIGS. 36(*a*)–36(*d*) are drawings showing the manner in which each pixel in the first raster line is recorded.
Figure 36B:
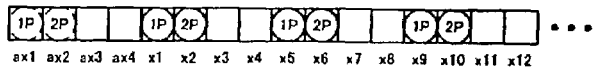
Figure 36C:
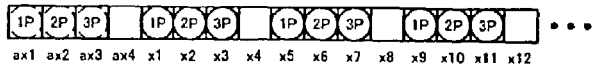
Figure 36D:
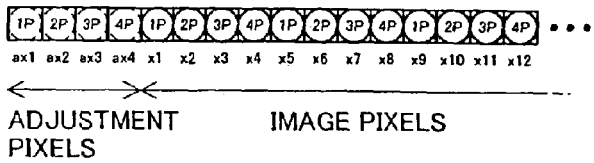

FIG. 35 is a drawing showing the correspondence between each pixel and the periods of each base drive waveform. Each of the pixels ax1, x1, x5, x9 and so on in the first pixel group corresponds to each period of the base drive waveform ODRV1, beginning in sequence from the first period. Similarly, each of the pixels ax2, x2, x6, x10 and so on in the second pixel group corresponds to each period of the base drive waveform ODRV2, beginning in sequence from the first period. The same principle applies regarding the pixels in the third and fourth pixel groups.

FIG. 36 is a drawing showing the method by which each pixel in one raster line is recorded. In the drawing, the square areas represent pixels, and the circle in the pixel indicates a formed dot. However, the dashed-line circles indicate non-formed dots. The symbol '1P' in the circle indicates a dot that is recorded in the first main scanning. Similarly, the symbol '2P' indicates a dot that is recorded in the second main scanning. The same principle applies to the symbols '3P' and '4P'. When the nozzle n1 arrives at the subject raster line and main scanning is performed, the pixels x1, x5, x9 and so on are recorded by the nozzle n1, as shown in FIG. 36(*a*). Because the pixel ax1 is an adjustment pixel, no dot is formed in this pixel. Next, sub-scanning is performed, and when the nozzle n2 reaches the subject raster line, the pixels x2, x6, x10 and so on are recorded, as shown in FIG. 36(*b*). The same principle discussed above applies regarding the non-formation of a dot in the pixel ax2. Because one nozzle forms one dot based on one base drive signal, dots may be formed in one session of main scanning only at a density of one pixel per four pixels. However, because the base drive waveforms ODRV1 and ODRV2 have phases that are offset from each other by one-quarter of the period, dots may be formed in adjacent pixels that are offset by one pixel, which corresponds to one-quarter of the period. Similarly, when the nozzle n3 arrives at the subject raster line during sub-scanning, the pixels x3, x7, x11 and so on are recorded, as shown in FIG. 36(*c*). Finally, when the nozzle n4 reaches the subject raster line, and the pixels x4, x8, x12 and so on are recorded as shown in FIG. 36(*d*), recording of all of the image pixels in the subject raster line is completed.

Here, because one raster line is recorded by four nozzles aligned in the sub-scanning direction, four sessions of main scanning and three sessions of sub-scanning were necessary in order to complete recording of all of the pixels in one raster line. However, the pixels in each pixel group should only be recorded based on mutually differing base drive signals. Consequently, if the nozzles that form dots based on different base drive signals are aligned in the main scanning direction, and if the pixels of each pixel group are recorded by those nozzles, all of the pixels in a raster line can be completely recorded in one main scanning session. In other words, in this third embodiment, the pixels in each pixel group can be recorded based on mutually differing base drive signals, regardless of what main scanning or sub-scanning is performed while they are being recorded. Moreover, so long as the pixels in each pixel group are recorded based on different base drive signals, it does not matter which dot records which pixel.

Figure 37:
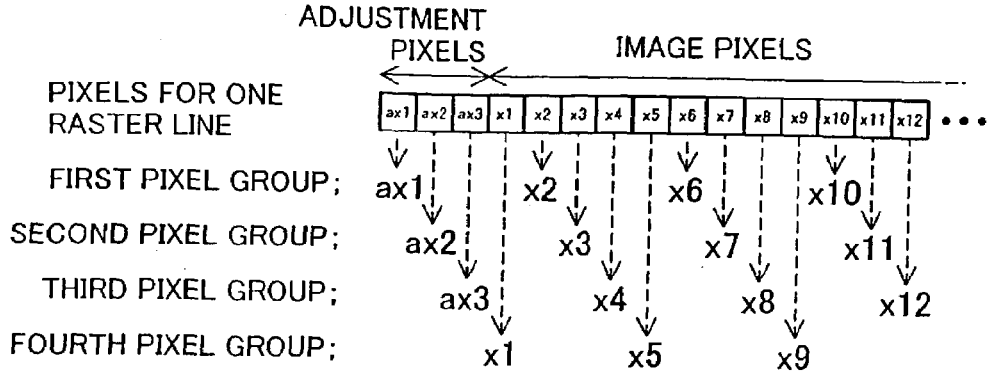
FIG. 37 is a drawing showing the manner in which the pass division unit 109 generates pixel groups when there are three adjustment pixels.

FIG. 37 is a drawing showing the manner in which the pass splitting unit 109 generates pixel groups in the case where there are three adjustment pixels. The previous explanation assumed that there were four adjustment pixels aligned before the image pixels, but here it is assumed that there are three adjustment pixels. The adjustment pixels ax1 through ax3 and the image pixels x1, x2 and so on are classified into the first through fourth pixel groups in a repeating fashion beginning with the first pixel, as described above. The result of the allocation is that the pixels ax1, x2, x6, x10 and so on belong to the first pixel group, while the pixels ax2, x3, x7, x11 and so on belong to the second pixel group. The pixels belonging to the third pixel group and the fourth pixel group are shown in the drawing. As can be seen from FIGS. 34 and 37, when there are four adjustment pixels, the first image pixel x1 occupies the second position in the first pixel group, but here it occupies the first position in the fourth pixel group. The other pixels from pixel x2 onward are also shifted due to the absence of the adjustment pixel ax4, and the pixel group to which they belong changes.

Figure 38:
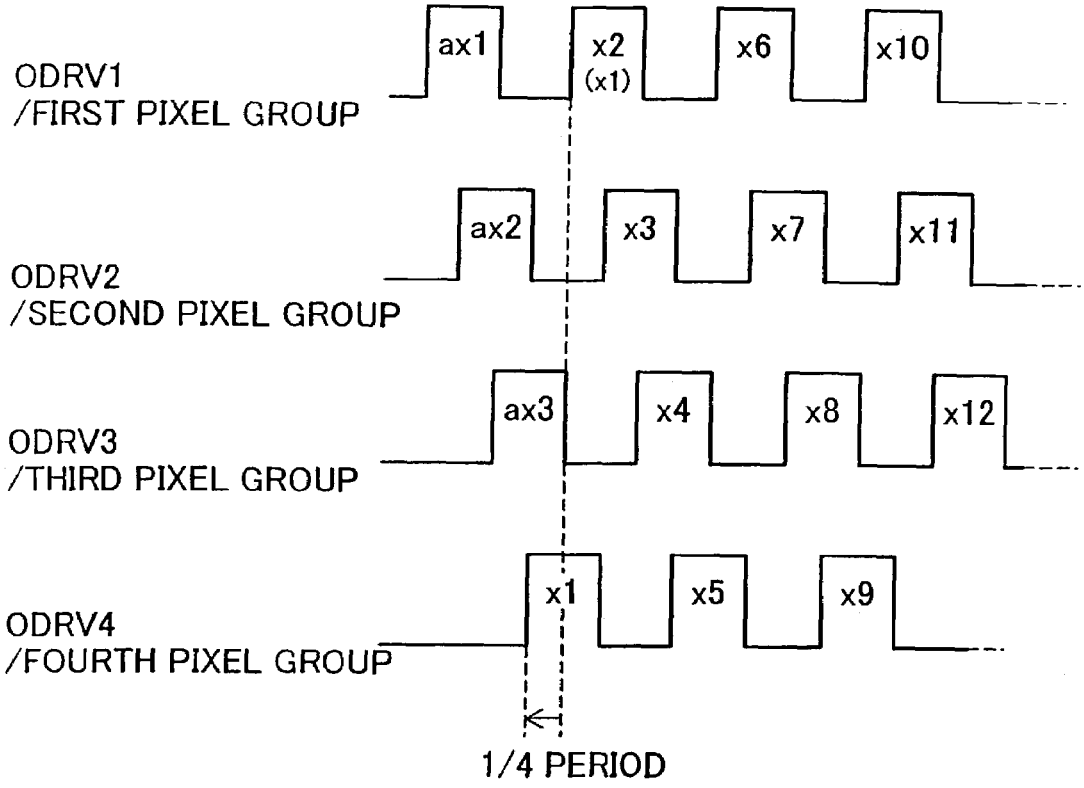
FIG. 38 is a drawing showing the period of each base drive signal waveform to which each pixel corresponds when there are three adjustment pixels.
Figure 39A:
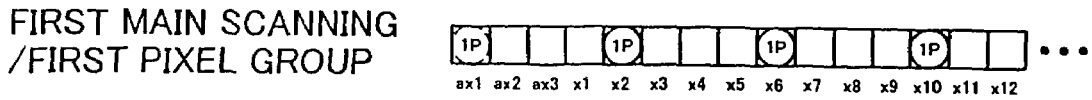
FIGS. 39(*a*)–(*d*) are drawings showing the manner in which each pixel in the first raster line is recorded when there are three adjustment pixels.
Figure 39B:
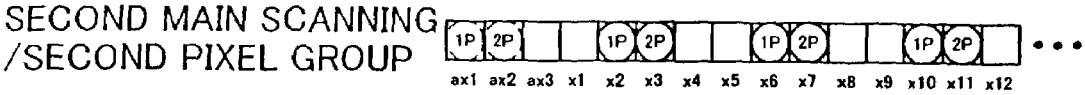
Figure 39C:
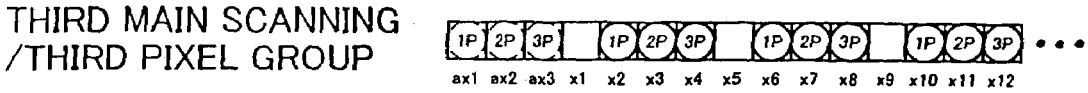
Figure 39D:
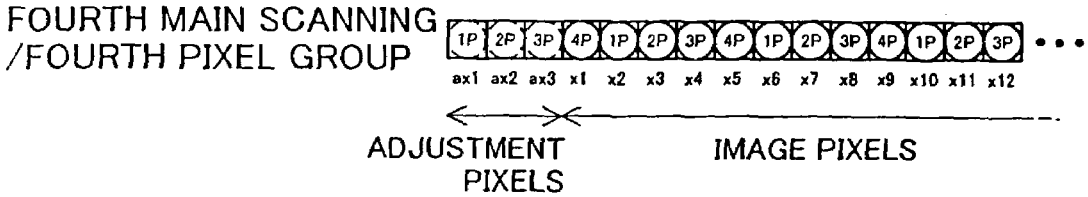

FIG. 38 is a drawing showing the correspondence between each pixel and the periods of each base drive waveform in the case where there are three adjustment pixels. Each of the pixels ax1, x2, x6, x10 and so on in the first pixel group corresponds to each period of the base drive waveform ODRV1, beginning in sequence from the first period. The same principle applies regarding the pixels in the second through fourth pixel groups. As can be seen from FIGS. 35 and 38, when there are four adjustment pixels, the pulse used to record the image pixel x1 is the second pulse of ODRV1, but when there are three adjustment pixels, the pulse used to record the image pixel x1 is the first pulse of ODRV4. In other words, the pulse used to record the image pixel x1 occurs one-quarter period earlier. In FIG. 38, (x1) is written in smaller type in the wave to which the image pixel x1 is allocated in FIG. 35. Though not indicated in FIG. 35, for the image pixels x2 and beyond as well, the corresponding pulse occurs one-quarter period earlier when there are only three adjustment pixels, as can be seen from a comparison of FIGS. 35 and 38.

FIG. 39 is a drawing showing the manner in which each pixel in a raster line is recorded when there are three adjustment pixels. As the nozzles n1 through n4 reach the subject raster line, dots are recorded, as shown in FIGS. 39(*a*) through 39(*d*). However, here the image pixel x1 is recorded in the fourth main scanning session. As a result, the dot for the image pixel x1 is recorded on the printing paper P as the fourth dot, following the three adjustment pixels (from the left). In this way, the image pixel x1 is formed one pixel to the left, as compared with FIG. 36(*d*). While the above explanation involves situations in which there are four and three adjustment pixels, respectively, dots may be formed through the same procedure using a plurality of base drive signals regardless of the number of adjustment pixels.

As described above, in the third embodiment, because four base drive signals are generated to have phases that are offset from each other by one-quarter of the period, and dots are formed using these signals, dots are formed at a high pixel density that is four times the pixel density obtainable when one base drive signal is used. Furthermore, here four base drive signals are generated in which the phases are spaced one-quarter period apart, but any number of base drive signals may be generated. If N base drive signals (N being a natural number greater than 1) having phases mutually offset by the reciprocal of N are generated, pixels may be recorded at a high pixel density that is N times the density obtainable when only one base drive signal is used. This high-density pixel recording is possible regardless of the number of adjustment pixels. Furthermore, if N is an even number, where bi-directional printing is used in which dots are formed during forward main scanning, dots may be formed effectively during both forward scanning and reverse scanning.

(7) Fourth Embodiment

The fourth embodiment differs from the first embodiment with respect to the configuration of the print head 28, the head driving unit 113*b* and the print data generating unit 103*b*. Otherwise, the configuration is identical to that of the first embodiment. In addition, the configuration of the drive signal generating unit (not shown in the drawings) of the head driving unit 113*b* is identical to that in the second embodiment.

Figure 40:
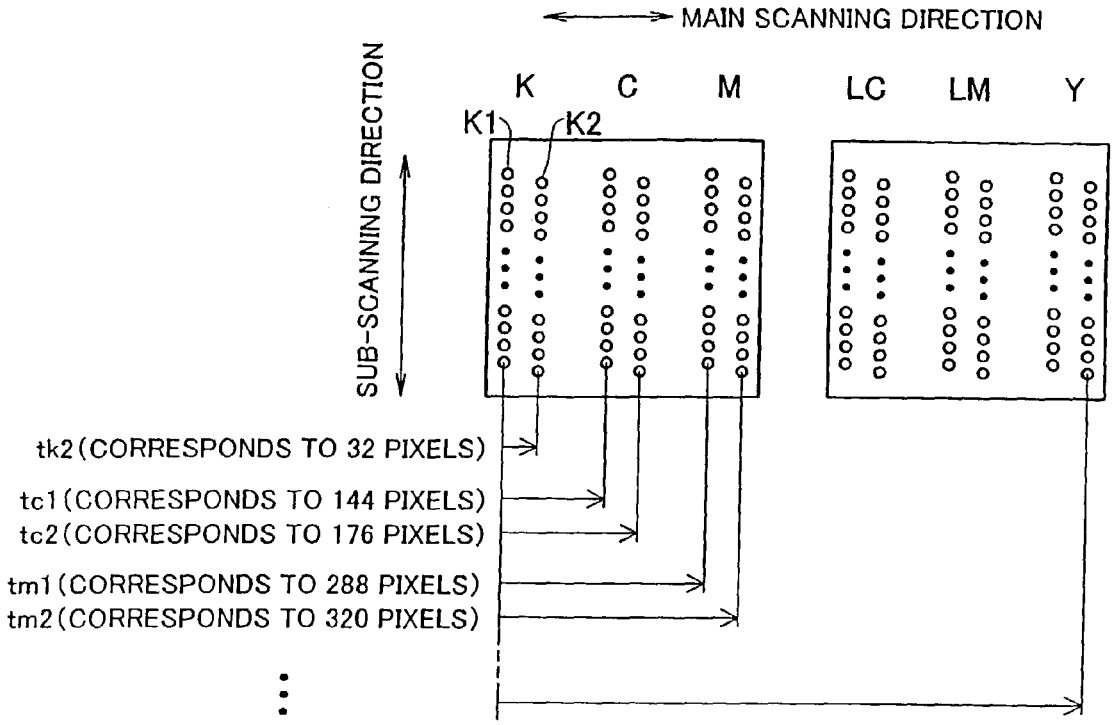
FIG. 40 is a drawing showing the placement of nozzles in the print head 28 and the delay data separately for each nozzle row.

FIG. 40 is a drawing showing the placement of each nozzle in the print head 28 and the delay data for each nozzle row. In the fourth embodiment, the nozzles in the print head 28 are arrayed in nozzle arrays that contain a plurality of nozzles that are aligned in the sub-scanning direction, and there are multiple nozzle arrays aligned in the main scanning direction. These nozzle arrays each comprise two nozzle rows aligned in a so-called zigzag fashion, and form dots in the colors of black (K), cyan (C), magenta (M), light cyan (LC), light magenta (LM) and yellow, respectively. In FIG. 40, the row on the left side of each color-specific nozzle array is referred to as row 1 while the row on the right side is referred to as row 2, e.g., K1 and K2, etc. When the print head 28 is moved from the left to the right in the drawing, the nozzle row K2 arrives at a specific pixel earlier than the nozzle row K1 by an interval tk2 corresponding to the distance between the nozzle row K2 and the nozzle row K1. Similarly, the nozzle row C1 arrives at that pixel earlier than the nozzle row K1 by an interval tc1 corresponding to the distance between the nozzle rows K1 and C1. The same principle applies to the other nozzle rows C2 through Y2. Therefore, when drive signals are generated from pixel value data and supplied unchanged to each nozzle, even if it is intended that ink be ejected onto the same pixel, dots are formed at positions that are shifted in the main scanning direction by an amount equal to the distance between nozzle rows. Consequently, where a nozzle row arrives at a pixel earlier than nozzle row K1, the ink expulsion positions are made to coincide by delaying the ink expulsion from that nozzle row by a prescribed interval tk2, tc1, etc. Moreover, using the nozzle row K1 as a reference, the other nozzle rows in the print head 28 are placed at distances from the nozzle row K1 that are integral multiples of four pixels.

Figure 41:
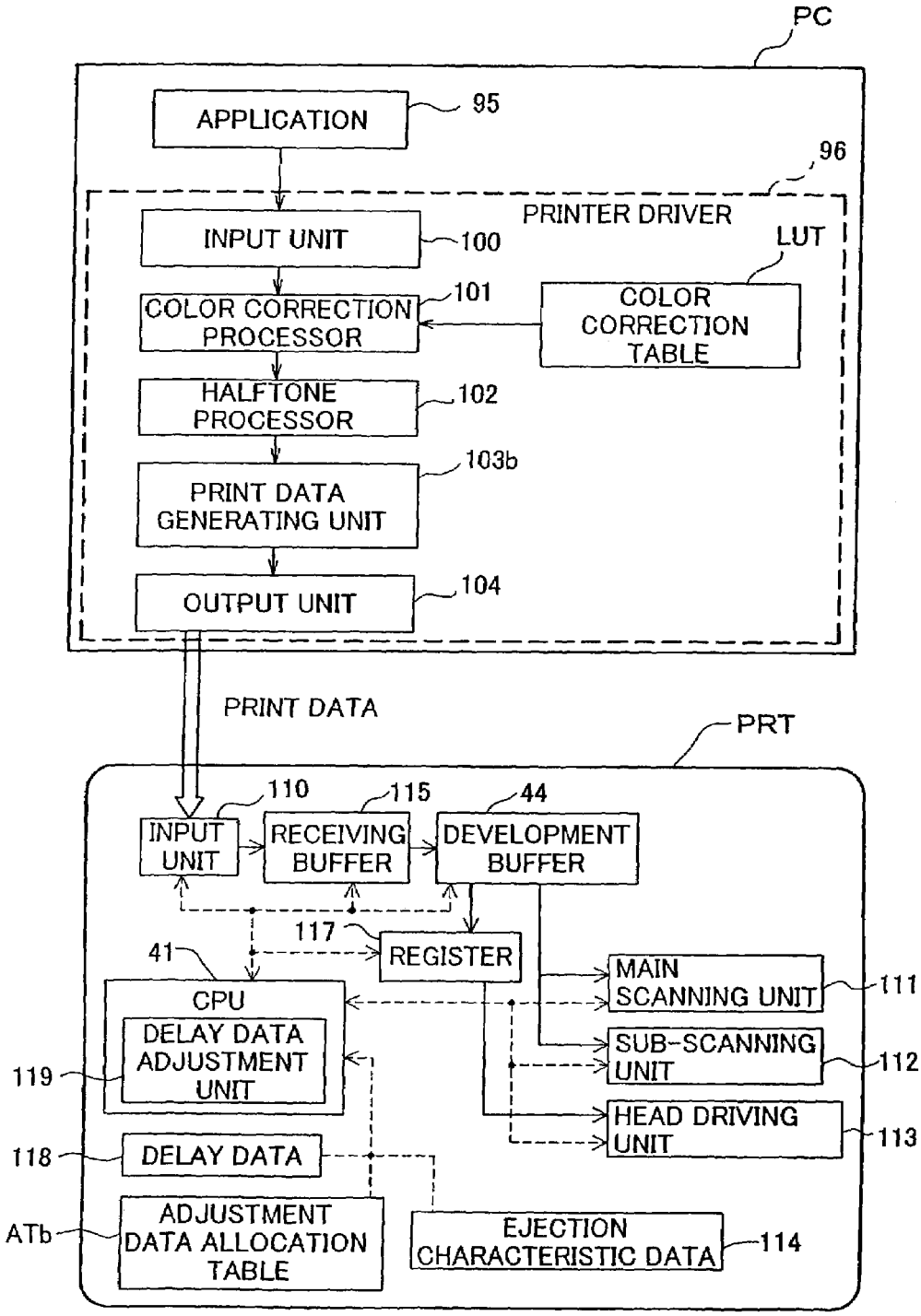
FIG. 41 is a drawing showing the function blocks for the printing apparatus of a fourth embodiment.

FIG. 41 is a drawing showing the function blocks of the printing apparatus pertaining to the fourth embodiment. In the printing apparatus pertaining to the fourth embodiment, the adjustment pixel allocation table AT is not located on the side of the computer PC. The print data generating unit 103*b* of the printer driver 96 generates print data only from the image pixels, and does not carry out adjustment pixel allocation. On the other hand, the printer PRT has a delay data memory unit 118, an expulsion characteristic data memory unit 114, and an adjustment data allocation table ATb.

Figure 42:
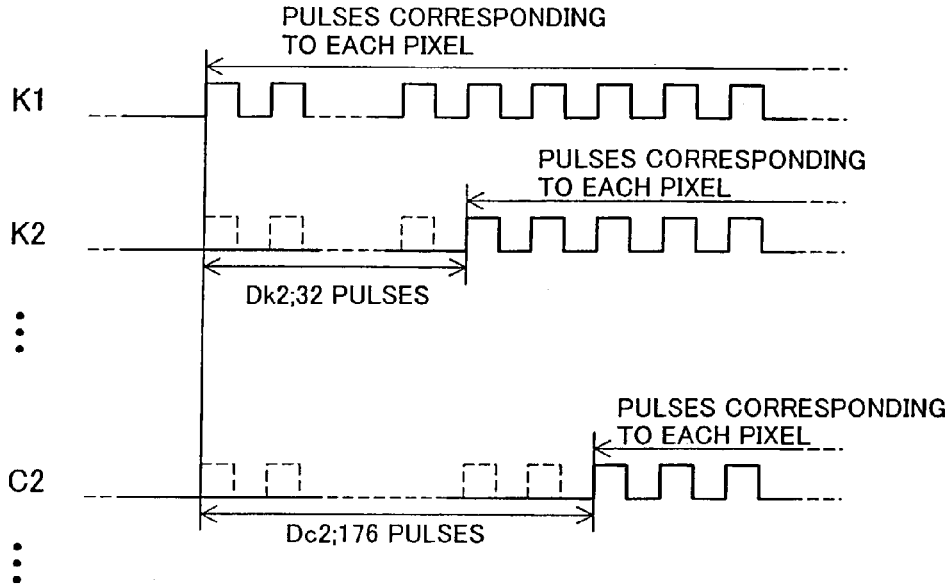
FIG. 42 is a drawing showing the method by which the expulsion of ink drops is put on hold based on the delay data.

FIG. 42 is a drawing showing the method by which ink drop expulsion is delayed using the delay data. In the delay data memory unit 118 are stored delay data values Dk2 and Dc1 through Dy2, for each nozzle row other than K1. These delay data values are values indicating which period of the respective base drive signal is associated with the intervals tk2, tc1, etc. described above. Because each nozzle row is distanced by an integral multiple of four-pixels from the nozzle row K1, the intervals tk2, tc1 and so on are integral multiples of the 'time in which the print head 28 travels four pixels'. On the other hand, because one period of a base drive signal equals the 'time in which the print head 28 travels four pixels', each nozzle row's offset interval tk2, tc1 and so on is evenly divisible by the number of periods of a base drive signal. Therefore, each delay data value is an integer. In the fourth embodiment, for example, Dk2 is 32, while Dc2 is 176. The delay data adjustment unit 119 (see FIG. 41) comprising a function unit of the CPU 41 places, at the beginning of the image pixel value data for each nozzle, a data area indicating non-formation of dots for the number of pixels specified in the delay data, as shown in FIG. 41. In this way, the drive signals corresponding to the image pixels for each nozzle are generated after a delay equivalent to the delay data value for that nozzle. Therefore, ink is ejected correctly in a matching manner where ink is to be ejected onto the same pixel from nozzle rows having different positions in the main scanning direction.

The delay data adjustment unit 119 (see FIG. 41) carries out adjustment of the delay data values in response to the expulsion characteristic (amount of dot formation position misalignment) for each nozzle, before the dot non-formation data based on the delay data value is added to the pixel value data. This delay data adjustment carried out to correct the dot formation position misalignment is performed by increasing or reducing the delay data values in integer increments. A delay data value is a value indicating the number of periods of the respective base drive signal that are included in the interval tk2, tc1, etc., which comprises the amount of time by which the arrival of each nozzle to a pixel is delayed. Therefore, increasing or reducing a delay data value in integer increments means adjusting the delay data value in increments of one period of the base drive signals. The register (serial data generating unit) 117 generates serial data based on the delay data values adjusted in this way and on the pixel-based dot formation information for each nozzle, and supplies the serial data to the head driving unit 113.

Figure 43A:
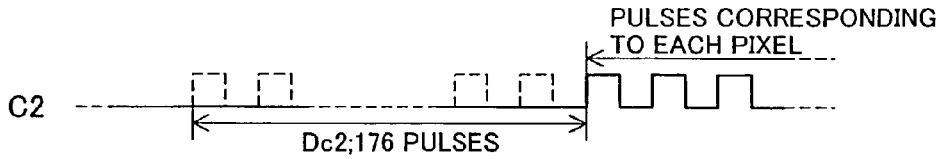
FIGS. 43(*a*) and 43(*b*) are drawings showing the method by which dot formation position misalignment is corrected based on the delay data.
Figure 43B:
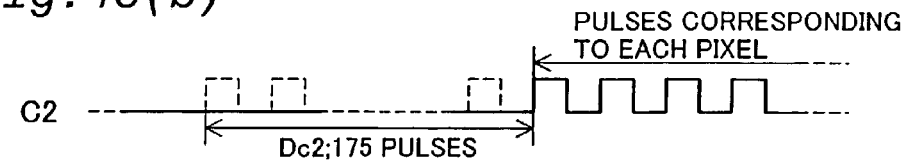
Figure 44:
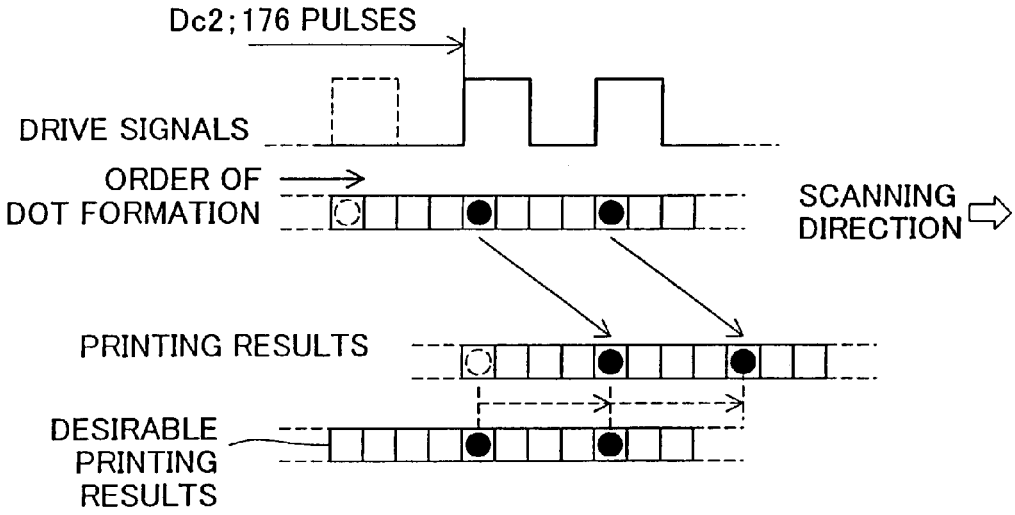
FIG. 44 is a drawing showing a situation wherein the dot formation positions are misaligned.
Figure 45:
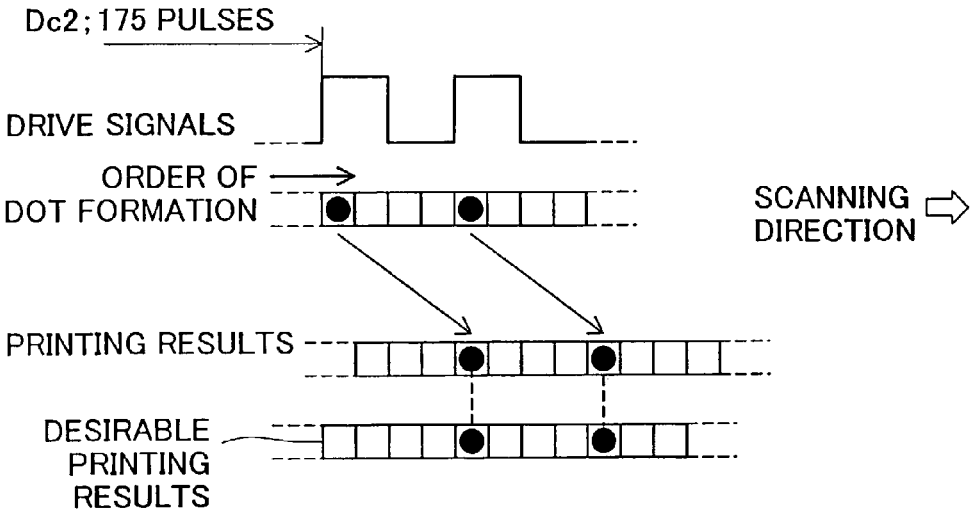
FIG. 45 is a drawing showing a situation wherein the dot formation positions are corrected.

FIG. 43 is a drawing showing the method by which dot formation position misalignment is corrected using delay data. FIG. 44 is a drawing showing dot formation position misalignment. FIG. 45 is a drawing showing the correction of dot formation position misalignment. For example, let us assume that dots are formed while the print head 28 is moved from left to right in FIG. 40, and that the dot formation positions for the nozzle row C2 are offset to the right by four pixels, as shown in FIG. 44. In FIG. 44, the drive wave indicated by the dashed line means that no dot is formed using that wave. Similarly, the circles indicated by dashed lines in the pixels indicate that no dot is formed in that pixel. Where the dot formation positions are offset by four pixels in this way, the delay data adjustment unit 119 reduces the delay data value Dc2 for the nozzle row C2 by one, from 176 to 175, as shown in FIGS. 40(*a*) and 40(*b*). When this is done, the drive waveforms for the nozzle row C2 occur one period earlier. Because these drive signals move the dot formation positions to the left by four pixels, dots are formed at the desired positions, as shown in FIG. 45.

Figure 46:
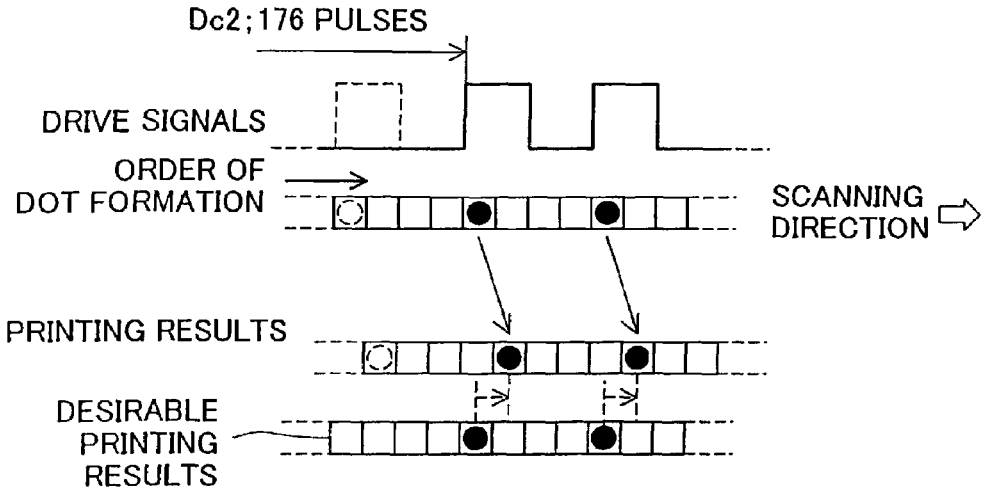
FIG. 46 is a drawing showing a situation wherein the dot formation positions are misaligned.
Figure 47:
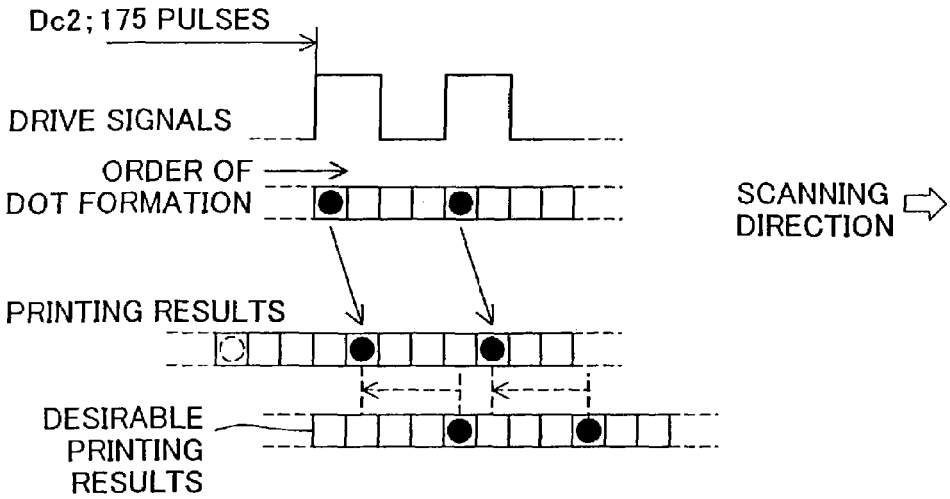
FIG. 47 is a drawing showing a situation wherein the dot formation positions are corrected.

FIG. 46 is a drawing showing dot formation position misalignment. FIG. 47 is a drawing showing the correction of dot formation position misalignment. In the previous explanation, the amount of dot formation position misalignment is four pixels, equivalent to exactly one wavelength of the base drive signals. Here, it will be assumed that the dot misalignment amount is one pixel. In this case, the dot formation positions for the nozzle row C2 are offset to the right by one pixel, as shown in FIG. 46. In this case, if the delay data Dc2 for the nozzle row C2 is reduced to 175 from 176, the drive waveform for the nozzle row C2 now occurs one period earlier, as shown in FIG. 47. With this drive waveform, the dot formation positions become shifted four pixels to the left from their positions when the delay data value Dc2 is 176. As a result, dots are now formed at positions three pixels to the left of the desired positions, as shown in FIG. 47.

The delay data adjustment unit 119 can handle only pixel data that has already been allocated to each nozzle by the print data generating unit 103*b*. In the fourth embodiment, because all pixels in the raster line are recorded over four main scanning sessions, the pixel data allocated to each nozzle comprises not the continuous pixel data for the raster line, but only data for every fourth pixel (one pixel out of every four). Consequently, the delay data adjustment unit 119 can correct dot position misalignment only in units of four pixels. Therefore, where the number of base drive signals generated by the base drive signal generating unit is deemed N, if the remainder when the dot position misalignment amount is divided by the pixel size is N/2 pixels or less, the delay data adjustment unit 119 does not correct the dot misalignment for this fraction. If the fraction is greater than N/2 pixels, the delay data value is further modified by an amount equivalent to extra one period. In this arrangement, a further increase in the dot formation position misalignment due to modification of the delay data by the delay data adjustment unit 119 can be prevented.

In the fourth embodiment, the process to carry out dot formation position misalignment is performed by the CPU 41 of the printer PRT. As a result, the process can be carried out more quickly then when it is carried out by the printer driver 96. Furthermore, the above explanation used an example in which the delay data value D is shortened such that the drive signals will occur earlier, but the delay data adjustment unit can also increase the delay data value D such that the drive signals will be delayed.

The following variations of the present invention are also possible.

(i) The explanation of the above embodiments used the example of an inkjet printer, but the present invention is not limited to an inkjet printer, and may be applied generally to various printing apparatuses that perform printing using a print head.

(ii) In the above embodiments, some of the functions achieved through hardware may be replaced by software, and conversely, some of the functions achieved through software may be replaced by hardware.

INDUSTRIAL APPLICABILITY

This invention may be applied to an inkjet printer, a facsimile device using the inkjet method, a copying machine using the inkjet method, or other printing apparatus that performs printing using a print head.

The invention claimed is:

1. A printing control apparatus that generates print data to be supplied to a printer including a printing head unit, the printing head unit performing main scanning in which a head having a plurality of nozzles that eject ink is moving forward and backward in prescribed directions relative to a print medium, carrying out sub-scanning in which the print medium is forwarded in a sub-scanning direction perpendicular to the main scanning direction relative to the head, and driving the head in accordance with the print data along at least one of the forward or reverse scanning passes such that dots are formed on at least some of a plurality of pixels aligned along the main scanning direction, wherein the printing control apparatus generates the print data before supplying to the printer the print data having pixel value data that includes image pixel value data and adjustment pixel value data irrespective of a size of a blank space on each side of an image in the print data, the image pixel value data indicating a dot formation status regarding image pixels that constitute images, the adjustment pixel value data indicating existence of adjustment pixels in which dots are not formed and are used to adjust positions of the image pixels in the main scanning direction, wherein at least a part of the adjustment pixel value data has a same format as the image pixel value data.

2. The printing control apparatus according to claim 1, wherein the print data includes raster data having the pixel value data including the adjustment pixel value data placed at least one side of the image pixel value data; and wherein the printing control apparatus further comprises:

an image pixel value data memory unit that stores the image pixel value data;

a misalignment amount memory unit that stores an amount of the dot formation position misalignment;

an allocation setting unit that allocates the adjustment pixels to one or both ends of the image pixel value data so that the dot formation position misalignment amount is corrected; and a raster data generating unit that generates the raster data from the image pixel value data and the allocation of adjustment pixels.

3. The printing control apparatus according to claim 2, wherein the head of the printing head unit forms dots of various colors by ejecting ink of prescribed colors from each nozzle;

the misalignment amount memory unit stores the formation position misalignment amount separately for each ink color; and the allocation setting unit sets the allocation separately for each ink color.

4. The printing control apparatus according to claim 2, wherein the plurality of nozzles belonging to the printing unit are classified into a plurality of nozzle rows that extend in the sub-scanning direction and that are aligned in the main scanning direction;

the misalignment amount memory unit stores the formation position misalignment amount for each nozzle row; and the allocation setting unit sets the allocation separately for each nozzle row.

5. The printing control apparatus according to claim 2, wherein the misalignment amount memory unit stores the formation position misalignment amount for each nozzle; and the allocation setting unit sets the allocation separately for each nozzle.

6. The printing control apparatus according to claim 5, wherein the image pixel value data stored in the image pixel value data memory unit is two-dimensional image data indicating the pixels aligned in the two dimensions of the main scanning direction and the sub-scanning direction;

the printing control apparatus has a determining unit that determines the relationship of correspondence between each nozzle mounted in the head and the two-dimensional image data in accordance with an amount of sub-scan feed; and the allocation setting unit sets the allocation of the adjustment pixels based on the determination.

7. The printing control apparatus according to claim 2, wherein the printing head unit (i) has a driving device for each nozzle to eject ink, (ii) generates a plurality of base drive signals in which signals for a nozzle to record one pixel are repeated, and (iii) generates from the base drive signals drive signals to drive the driving devices to eject ink, the plurality of base drive signals having the same periods but different phases that are mutually offset from each other; and the raster data generating unit has a pass splitting unit that classifies the image pixels and the adjustment pixels aligned in each main scanning line into a plurality of pixel groups; and the dots on respective pixels in the plurality of pixel groups are formed based on the different base drive signals respectively.

8. The printing control apparatus according to claim 7, wherein the plurality of base drive signals includes N base drive signals having phases that are sequentially offset by an amount equal to 1/N of one period (N being a natural number equal to or greater than 2); and the number of the pixel groups is N.

9. The printing control apparatus according to claim 8, wherein the pass splitting unit classifies every Nth pixel of the image pixels and the adjustment pixels aligned in a main scanning line into the same pixel group in the order of their placement.

10. The printing control apparatus according to claim 1, wherein the printing head unit drives the head along both the forward and reverse scanning passes;

the print data includes:

raster data block having at least the image pixel value data with regard to each nozzle for each main scanning session, sub-scan feed data that indicates a feed amount for sub-scanning performed after main scanning session, adjustment pixel placement data, that is separate from the raster data block, indicating numbers of adjustment pixels to be placed at opposite ends of the image pixel value data, the adjustment pixel placement data functioning as at least a part of the adjustment pixel value data; and the printing control apparatus includes:

a pass reversal detecting unit that detects that a direction of a scheduled pass for each raster data block is reversed, and a raster data reconstruction unit that reconstructs the raster data block by reversing placement of the adjustment pixels across the image pixels sandwiched between the adjustment pixels, for the raster data block regarding which the pass is reversed, and by aligning, based on the reversed placement of the adjustment pixels, the adjustment pixel value data at at least one of the opposite ends of the image pixel value data.

11. The printing control apparatus according to claim 10, wherein each raster data block also includes a direction flag indicating the direction of the scheduled pass for each raster data block.

12. The printing control unit according to claim 1, wherein the plurality of nozzles belonging to the printing head unit are classified into a plurality of nozzle rows that extend in the sub-scanning direction and that are aligned in the main scanning direction with a prescribed interval therebetween; and wherein the printing control apparatus has a delay data memory unit that stores delay data indicating an amount of delay needed to correct for a difference in times that nozzles arrive at a particular pixel during main scanning, in accordance with a design distance between the nozzle rows aligned in the main scanning direction with the prescribed interval therebetween;

a misalignment amount memory unit that stores the dot formation position misalignment amount;

a delay data adjustment unit that readjusts the delay data so that the misalignment is corrected; and a serial data generating unit that, for each nozzle during each main scanning session, generates serial data using the readjusted delay data as the adjustment pixel value data, and supplies this serial data to the printing head unit, the serial data includes the readjusted delay data and the image pixel value data that follows the readjusted delay data.

13. A printing method comprising the steps of:

while performing main scanning in which a head having a plurality of nozzles that eject ink is moved in prescribed forward and reverse directions relative to a print medium, carrying out sub-scanning in which the print medium is forwarded in a sub-scanning direction perpendicular to the main scanning direction relative to the head;

driving the head in accordance with print data supplied to a printer including the head along at least one of the forward or reverse scanning passes; and forming dots in at least some of a plurality of pixels aligned in the main scanning direction; wherein the printing method corrects the dot formation position misalignment for each nozzle in the main scanning direction by generating the print data before supplying to the printer the print data having pixel value data that includes image pixel value data and adjustment pixel value data irrespective of a size of a blank space on each side of an image in the print data, the image pixel value data indicating a dot formation status regarding image pixels that constitute images, the adjustment pixel value data indicating existence of adjustment pixels in which dots are not formed and are used to adjust positions of the image pixels in the main scanning direction, wherein at least a part of the adjustment pixel value data has a same format as the image pixel value data.

14. The printing method according to claim 13, further comprising the steps of:

(a) setting the allocation of the adjustment pixels to one or both ends of the image pixel value data so that the amount of the dot formation position misalignment is corrected;

(b) generating, from the image pixel value data and the allocation of the adjustment pixels, raster data having the pixel value data including the adjustment pixel value data placed at least at one side of the image pixel value data;

(c) generating the print data including the raster data; and (d) driving the head in accordance with the print data while main scanning is being performed.

15. The printing method according to claim 14, wherein the step (d) includes a step of forming dots of various colors by ejecting ink of a prescribed color from each nozzle; and the step (a) includes a step of setting the allocation separately for each ink color.

16. The printing method according to claim 14, wherein the step (d) includes a step of forming dots using a plurality of nozzles that are classified into a plurality of nozzle rows that extend in the sub-scanning direction and that are aligned in the main scanning direction; and the step (a) includes a step of setting the allocation separately for each nozzle row.

17. The printing method according to claim 14, wherein the step (a) includes a step of setting the allocation separately for each nozzle.

18. The printing method according to claim 17, wherein the image pixel value data comprises two-dimensional image data indicating pixels aligned in the two dimensions of the main scanning direction and the sub-scanning direction, and wherein the step (a) further comprising the steps of:

(a1) determining the relationship of correspondence between each nozzle mounted in the head and the two-dimensional image data in accordance with an amount of sub-scan feed; and (a2) setting the allocation of the adjustment pixels based on the determination.

19. The printing method according to claim 14, wherein the step (d) includes a step of driving the head along both the forward and reverse passes of main scanning.

20. The printing method according to claim 14, wherein the step (d) includes a step of driving the head in either the forward or reverse scanning passes.

21. The printing method according to claim 14, wherein the step (d) includes a step of completing dot recording for each main scanning line during one pass of the head.

22. The printing method according to claim 14, wherein the method further comprising the steps of:

(e) printing prescribed test patterns designed to enable detection of the amount of dot formation position misalignment for each nozzle; and (f) specifying the misalignment amount based on the test patterns.

23. The printing method according to claim 14, wherein the step (c) includes a step of classifying the image pixels and the adjustment pixels aligned in each main scanning line into a plurality of pixel groups; and wherein the step (d) further comprising the steps of:

(d1) generating a plurality of base drive signals in which signals for the nozzles to record one pixel are repeated;

(d2) generating from the base drive signals drive signals to drive the driving devices mounted in each nozzle to eject ink; and (d3) forming dots on respective pixels in the plurality of pixel groups based on the different base drive signals respectively; and wherein the plurality of base drive signals having same periods but different phases that are mutually offset from each other.

24. The printing method according to claim 23, wherein the plurality of base drive signals includes N base drive signals having phases that are sequentially offset by an amount equal to 1/N of one period (N being a natural number equal to or greater than 2); and the number of the pixel groups is N.

25. The printing method according to claim 24, wherein the step (c) includes a step of classifying every Nth pixel of the image pixels and the adjustment pixels aligned in a main scanning line into the same pixel group in the order of their placement.

26. The printing method according to claim 13, wherein the method further comprising the steps of:

(a) generating the print data that includes raster data block that has at least the image pixel value data with regard to each nozzle for each main scanning session;

sub-scan feed data that indicates a feed amount for the sub scanning performed after each main scanning session; and adjustment pixel placement data, that is separate from the raster data block, indicating numbers of adjustment pixels to be placed at opposite ends of the image pixel value data, the adjustment pixel placement data functioning as at least a part of the adjustment pixel value data;

(b) driving the head and forming dots in both the forward and reverse scanning passes in accordance with the print data;

(c) detecting that a direction of a scheduled pass for each raster data block is reversed; and (d) reconstructing the raster data block by reversing placement of the adjustment pixels across the image pixels sandwiched between the adjustment pixels, for the raster data block regarding which the pass is reversed, and by aligning, based on the reversed placement of the adjustment pixels, the adjustment pixel value data at at least one of the opposite ends of the image pixel value data.

27. The printing method according to claim 26, wherein the step (a) includes a step of placing a directional flag indicating the direction of the scheduled scanning pass for each raster data block.

28. The printing method according to claim 26, wherein the step (b) includes a step of forming dots of various colors through ejection of ink of a prescribed color from each nozzle; and the step (a) includes a step of setting the adjustment pixel placement number in the adjustment pixel placement data separately for each ink color.

29. The printing method according to claim 26, wherein the step (b) includes a step of forming dots using a plurality of nozzles that are classified into a plurality of nozzle rows that extend in the sub-scanning direction and that are aligned in the main scanning direction; and the step (a) includes a step of setting the adjustment pixel placement number in the adjustment pixel placement data separately for each nozzle row.

30. The printing method according to claim 26, wherein the step (a) includes a step of setting the adjustment pixel placement number in the adjustment pixel placement data separately for each nozzle.

31. The printing method according to claim 13, further comprising the steps of:

(a) readjusting the delay data indicating an amount of delay needed to correct for a difference in times that nozzles arrive at a particular pixel during main scanning, in accordance with a design distance in the main scanning direction between the plurality of nozzles classified into a plurality of nozzle rows that extend in the sub-scanning direction and that are aligned in the main scanning direction with a prescribed interval therebetween, so that the dot formation position misalignment amount may be corrected;

(b) generating serial data that includes the readjusted delay data and the image pixel value data that follows the readjusted delay data, for each nozzle during each main scanning session, using the readjusted delay data as the adjustment pixel value data; and (c) forming dots based on the serial data.

32. The printing method according to claim 31, wherein the step (c) includes (c1) generating a plurality of base drive signals in which signals for the nozzles to record one pixel are repeated; and (c2) generating from the base drive signals drive signals to drive the driving devices mounted in each nozzle to eject ink; and wherein the delay data is prepared in units of one period of the base drive signals;

the step (a) includes a step of readjusting the delay data in units of one period of the base drive signals based on the misalignment amount; and the step (c2) includes a step of generating the drive signals from the serial data and the base drive signals for each nozzle.

33. The printing method according to claim 32, wherein the plurality of nozzles are classified into N nozzle groups (N being a natural number equal to or greater than 2);

the step (c1) includes steps of generating N base drive signals that have same periods but different phases that are sequentially offset by an amount equal to 1/N of one period, and supplying the base drive signals to the driving devices of the nozzle group corresponding to each of the base drive signal; and the step (c2) includes a step of generating the drive signals from the serial data for each nozzle and the base drive signals supplied to the driving device for each nozzle.

34. The printing method according to claim 33, wherein the nozzle rows aligned in the main scanning direction have an interval therebetween equal to the multiple (N×m) (m being a natural number equal to or greater than 1) of a pixel pitch corresponding to the print resolution.

35. The printing method according to claim 32, wherein the step (c) further comprising the step of:

(c3) driving the head along both the forward and reverse scanning passes of main scanning.

36. The printing method according to claim 32, wherein the step (c) further comprising the step of:

(c3) driving the head only along either the forward or the reverse scanning pass.

37. A recording medium on which is recorded a computer program to execute printing from a computer having a printing apparatus including a printer head unit that, while performing main scanning in which a head having a plurality of nozzles that eject ink is moved in prescribed forward and reverse directions relative to a print medium, carries out sub-scanning in which the print medium is forwarded in a sub-scanning direction perpendicular to the main scanning direction relative to the head, drives the head in accordance with print data along at least one of the forward or reverse scanning passes in accordance with the print data provided to the printing apparatus, and forms dots in at least some of a plurality of pixels aligned in the main scanning direction, wherein recorded on the recording medium is a computer program to achieve the function of correcting dot formation position misalignment for each nozzle in the main scanning direction by generating the print data before supplying to the printer the print data having pixel value data that includes image pixel value data and adjustment pixel value data irrespective of a size of a blank space on each side of an image in the print data, the image pixel value data indicating a dot formation status regarding image pixels that constitute images, the adjustment pixel value data indicating existence of adjustment pixels in which dots are not formed and are used to adjust the position of the image pixels in the main scanning direction, wherein at least a part of the adjustment pixel value data has a same format as the image pixel value data.

38. The recording medium according to claim 37, wherein recorded on the recording medium is a computer program to achieve a function to set the allocation of the adjustment pixels to one or both ends of the image pixel value data so that the dot formation position misalignment amount is corrected;

a function to generate, from the image pixel value data and the allocation of the adjustment pixels, raster data having the pixel value data including the adjustment pixel value data placed at least at one side of the image pixel value data;

a function to generate the print data including the raster data; and a function to drive the head in accordance with the print data while performing main scanning.

39. The printing method according to claim 38, wherein the method achieves a function to classify the image pixels and the adjustment pixels aligned in each main scanning line into a plurality of pixel groups when the raster data is generated; and when the head is driven and dots are formed, a function to generate a plurality of base drive signals in which signals for the nozzles to record one pixel are repeated;

a function to generate from the base drive signals drive signals to drive the driving devices mounted in each nozzle to eject ink; and a function to form dots on respective pixels in the plurality of pixel groups based on the different base drive signals respectively; and wherein the plurality of base drive signals have same periods but different phases that are mutually offset from each other.

40. The recording medium according to claim 37, wherein recorded on the recording medium is a computer program to achieve a function to generate the print data including raster data block that has at least image pixel value data with regard to each nozzle for each main scanning session;

sub-scan feed data that indicates a feed amount for the sub-scanning performed after each main scanning session; and adjustment pixel placement data, that is separate from the raster data block, indicating numbers of adjustment pixels to be placed at opposite ends of the image pixel value data, the adjustment pixel placement data functioning as at least a part of the adjustment pixel value data;

a function to drive the head and form dots in both the forward and reverse scanning passes;

a function to detect that a direction of a scheduled pass for each raster data block is reversed; and a function to reconstruct the raster data block by reversing placement of the adjustment pixels across the image pixels sandwiched between the adjustment pixels, for the raster data block regarding which the pass is reversed, and by aligning, based on the reversed placement of the adjustment pixels, the adjustment pixel value data at at least one of the opposite ends of the image pixel value data.

41. The recording medium according to claim 37, wherein recorded on the recording medium is a computer program to achieve a function to readjust the delay data indicating an amount of delay needed to correct for a difference in times that nozzles arrive at a particular pixel during main scanning, in accordance with the design distance in the main scanning direction between the plurality of nozzles classified into a plurality of nozzle rows that extend in the sub-scanning direction and that are aligned in the main scanning direction with a prescribed interval therebetween, so that the dot formation position misalignment amount may be corrected;

a function to generate serial data that includes the readjusted delay data and the image pixel value data that follows the readjusted delay data, for each nozzle during each main scanning session, using the readjusted delay data as the adjustment pixel value data; and a function to form dots based on the serial data.

42. A printing apparatus comprising:

a head having a plurality of nozzles that eject ink;

a main scanning unit that carries out main scanning by moving the head forward and backward in prescribed directions relative to a print medium;

a head driving unit that drives the head in at least one of the forward and reverse directions in accordance with print data and forms dots on at least some of a plurality of pixels aligned in the main scanning direction;

a sub-scanning unit that carries out sub-scanning by moving the print medium forward relative to the head in a sub-scanning direction that is perpendicular to the main scanning direction; and a control unit that controls printing, the control unit correcting, in dot formation in accordance with the print data, dot formation position misalignment in the main scanning direction for each nozzle by generating the print data before supplying to the printer the print data having pixel value data that includes image pixel value data and adjustment pixel value data irrespective of a size of a blank space on each side of an image in the print data, the image pixel value data indicating a dot formation status at image pixels that constitute images, and the adjustment pixel value data indicating existence of adjustment pixels in which dots are not formed and which are used to adjust positions of the image pixels in the main scanning direction, wherein at least a part of the adjustment pixel value data has a same format as the image pixel value data.

* * * * *